US005643085A

United States Patent [19]

Aityan et al.

[11] Patent Number: 5,643,085

[45] Date of Patent: Jul. 1, 1997

[54] TWO-DIMENSIONAL CYCLIC GAME FOR CREATING AND IMPLEMENTING PUZZLES

[76] Inventors: Sergey K. Aityan, 8242 Bryant Dr., Huntington Beach, Calif. 92647; Alexander V. Lysyansky, 21 Tecoma Cir., Littleton, Colo. 80127

[21] Appl. No.: 533,116

[22] Filed: Sep. 25, 1995

[51] Int. Cl.[6] ..... A63F 9/06

[52] U.S. Cl. ..... 463/9; 463/1; 273/153 R; 273/153 S

[58] Field of Search ..... 273/153 R, 157 R, 273/153 S; 463/1, 9, 30–31, 36, 32, 33

[56] References Cited

U.S. PATENT DOCUMENTS

| | | | |
|---|---|---|---|
| 4,483,535 | 11/1984 | LeCart | 273/153 S |
| 4,509,756 | 4/1985 | Moscovich | 273/153 S |
| 4,735,417 | 4/1988 | Gould | 273/153 S |
| 4,863,172 | 9/1989 | Rosenwinkel et al. | 273/153 S |
| 5,074,561 | 12/1991 | Johnson | 273/153 S |
| 5,080,368 | 1/1992 | Weisser | 273/241 |
| 5,083,788 | 1/1992 | Conotter | 273/153 S |
| 5,100,142 | 3/1992 | Cannata | 273/155 |
| 5,135,225 | 8/1992 | Pszotka et al. | 273/153 S |
| 5,236,199 | 8/1993 | Thompson, Jr. | 273/439 |
| 5,267,732 | 12/1993 | Bowen et al. | 273/157 R |
| 5,267,865 | 12/1993 | Lee et al. | 434/350 |
| 5,296,845 | 3/1994 | Haller | 345/168 |
| 5,312,113 | 5/1994 | Ta-Hsien et al. | 273/434 |
| 5,377,997 | 1/1995 | Wilden et al. | 273/434 |
| 5,396,590 | 3/1995 | Kreegar | 395/137 |
| 5,417,425 | 5/1995 | Blumberg et al. | 273/153 R |
| 5,423,556 | 6/1995 | Latypov | 273/153 R |
| 5,427,375 | 6/1995 | Breckwoldt | 273/153 S |
| 5,431,400 | 7/1995 | Metz | 273/157 R |
| 5,529,301 | 6/1996 | Feller | 273/153 S |
| 5,542,673 | 8/1996 | Lammertink | 273/153 S |

*Primary Examiner*—Jessica Harrison
*Assistant Examiner*—Mark A. Sager
*Attorney, Agent, or Firm*—John R. Flanagan

[57] ABSTRACT

A two-dimensional cyclic game for creating and implementing puzzles and the like includes a two-dimensional playing field of either planar or curved configurations, a plurality of fixed sites defined on the playing field, and a plurality of game objects occupying the fixed sites. The game objects are movable only in groups. The groups are repositionable through performance of a series of consecutive moves to restore the game objects on the sites to a desired pattern. Also, in each of the moves, the game objects in a selected one of the groups are cyclically moved simultaneously in a given direction through translation or rotation along an endless cyclic path. In each cyclic translational move, the game objects of the selected one group are moved such that one of the game objects of the selected group located adjacent to a first portion of the playing field border is moved off the field at the first portion thereof and back onto the playing field at a second portion of the playing field border. In each cyclic rotational move, each of the game objects of the selected one of the groups remains on the same one of the playing field sites and rotates thereon through a portion of a complete rotation cycle.

21 Claims, 6 Drawing Sheets

TWO-DIMENSIONAL CYCLIC GAME FOR CREATING AND IMPLEMENTING PUZZLES

BACKGROUND OF THE INVENTION

1. Field of the Invention

The present invention generally relates to puzzle-type games and, more particularly, is concerned with a cyclic plane computer game for creating and implementing puzzle-type games employing cyclic translational and rotational moves of selected groups of game objects on sites of a two-dimensional game field displayed on a computer monitor screen to reposition the game objects on the sites of the game field from an initial pattern to a final desired pattern.

2. Description of the Prior Art

Computer games are played on computer systems. A typical computer system include a central processing unit or microprocessor, a floppy or hard disk memory, a display monitor, a movable cursor displayed on the monitor, and one or more input devices, usually a mouse, keyboard and/or joystick, for sending instructions to the microprocessor for causing movement of the cursor and performance of other functions. The computer game is provided in the form of a software program typically stored on the floppy or hard disk memory and the internal memory of the microprocessor of the computer system. During operation of the software program, the microprocessor causes display of images on the screen of the display monitor and produces changes in the images in response to actuation of the input device by the player.

Due to the growing presence and usage of computers in the home, many mechanical type games which have been widely enjoyed heretofore will likely be implemented as computer games so that they can continue to be enjoyed by people now using computers. In fact, some puzzle-type games have already been implemented as computer games. Examples of several puzzle computer games are disclosed in U.S. Pat. No. 5,296,845 to Hallet and U.S. Pat. No. 5,312,113 to Ta-Hsien et al.

The Haller patent discloses a computer system employing left and right keyboards used with a software program for playing games or solving puzzles. The software program causes generation of a plurality of partial pictures randomly arranged in a grid of columns and rows on the screen of a display monitor. The left keyboard has a rectangular pattern of keys used for direct exchange of the positions occupied by two of the partial pictures. The direct exchange is carried out by depressing any two keys on the left keyboard. The exchanged partial pictures can be located within any of the columns or rows. The right keyboard has a pair of keys designating "yes" and "no" functions for moving the displayed picture column by column either left or right and a pair of keys designating "+" and "–" functions for turning a selected partial picture in either a clockwise direction or counterclockwise direction by 90° for each depression of the appropriate key.

The Ta-Hwien et al patent discloses a video puzzle cube game in which a plurality of keys are used to drive a computer game software program to show a hexahedron pattern having six sides. Each side of the pattern is divided into nine equal divisions. Each division is further divided into nine blanks filled with or for filling with squares.

The above-identified patents appear to represent steps in the right direction for implementing puzzle-type games as computer games. However, these patents appear to provide approaches which are too limited in the variety of moves allowed and in their degree of difficulty to be successful in transforming mechanical puzzle-type games into enjoyable computer game puzzles and in creating new puzzle-type computer games. For example, one of the most popular mechanical puzzle games is a game well-known as Rubik's Cube. The puzzle game consists of twenty-seven small cubes which are color identified and are combined in a manner to form a large cube and permit the rotation of each of the six faces of the large cube in order to change the respective locations of each of the small cubes relative to one another in order to arrive at a desired pattern or arrangement. Another popular mechanical puzzle game is know as Fifteen Bars by Lloyd. It has an enclosed frame with sixteen spaces in a four-by-four grid and fifteen square bars occupying fifteen of the spaces, leaving one space open. The bars can be moved in orthogonal directions such that any one of the bars bordering the one open space can be moved into that one space leaving its previous position as the new open space. It is unlikely that these mechanical puzzle games could be implemented nor that many new puzzle-type games could be created merely by employing the approaches of the above-described patents.

Consequently, a need still exists for a different approach to implement and create a wider variety of puzzles as computer games.

SUMMARY OF THE INVENTION

The present invention provides a two-dimensional cyclic game designed to satisfy the aforementioned need. The two-dimensional cyclic game of the present invention is particularly suited for creating and implementing puzzle-type games; however, it is also applicable to other subject matters as well. The two-dimensional cyclic game allows cyclic rotational and translational moves of selected groups of game objects on sites of a two-dimensional playing field, for example displayed on a computer monitor screen, to reposition the game objects on the sites of the playing field from an initial pattern to a final desired pattern. The puzzle game is preferably, although not necessarily, implemented by means of a software program run on a conventional computer or the like using a display monitor and, preferably, a mouse input device, as opposed to keyboard or joystick input devices, although the latter devices could be used. Alternatively, the puzzle game can be implemented mechanically wherein the two-dimensional playing field takes the form of a game board having the sites drawn thereon and the game objects are separate pieces placed on the game broad sites.

Accordingly, the present invention is directed to a two-dimensional cyclic game for creating and implementing a puzzle-type game or the like. The two-dimensional cyclic game comprises: (a) a generally planar two-dimensional playing field having a border; (b) a plurality of fixed sites defined on the playing field within the border thereof; and (c) a plurality of game objects occupying the fixed sites on the playing field. The game objects are movable relative to the fixed sites to restore the game objects from an initial pattern to a final pattern through performance of a succession of moves of the game objects.

Preferably, the game objects are movable in groups of the objects. The groups of game objects can occupy any combination of sites on the playing field. Where the playing field is in the form of a rectangular grid made up of rows and columns of sites, some groups of game objects will occupy sites in common rows and common columns extending between opposite portions of the border of the playing field, whereas other groups of game objects may occupy sites in different rows and/or columns. Also, the game objects of a selected group need not be adjacent to one another but can have other game objects not in the group being located between the game objects of the particular group.

The groups of game objects are repositionable through performance of a succession of moves to restore the game objects from the initial pattern to the final desired pattern. Also, in each of the moves, the game objects in a selected one of the groups are moved simultaneously in a given direction through translation or rotation about a portion of an endless cyclic path. In each cyclic translational move, the game objects of the selected one group are moved such that one of the game objects located adjacent to a first portion of the playing field border is moved off the playing field at such location and back onto the playing field at a second portion of the playing field border, preferably being located opposite from the first portion. In each cyclic rotational move, the game objects of the selected one group are moved such they remain on the same playing field sites and rotate thereon through a portion of a complete rotation cycle.

The present invention also is directed to a two-dimensional cyclic game in which the playing field has a generally curved two-dimensional configuration instead of a generally planar configuration. The curved playing field can be implemented in many forms, for example, as a cylinder, sphere, hemisphere, toroid and the like. In some of these forms, such as a cylinder and hemisphere, the curved playing field will only have some portions with borders. In other of these forms, such as a sphere and toroidal, the curved playing field can have no borders.

The groups of game objects are repositionable on the curved playing field through performance of a succession of moves to restore the game objects from the initial pattern to the final desired pattern. In each of the moves, the game objects in a selected one of the groups are moved simultaneously in a given direction through translation or rotation about a portion of an endless cyclic path. In the case of the curved playing field with some border portions the game objects of the selected one group may undergo a cyclic translational move such that one of the game objects located adjacent to a first portion of the playing field border is moved off the playing field at such location and back onto the playing field at a second portion of the playing field border. On the other hand, in the case of a curved playing field without borders the game objects of the selected one group undergo a cyclic translational move such that none of the game objects leaves nor returns to the playing field. The cyclic rotational moves in the case of the curved playing field are the same as in the case of the planar playing field.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
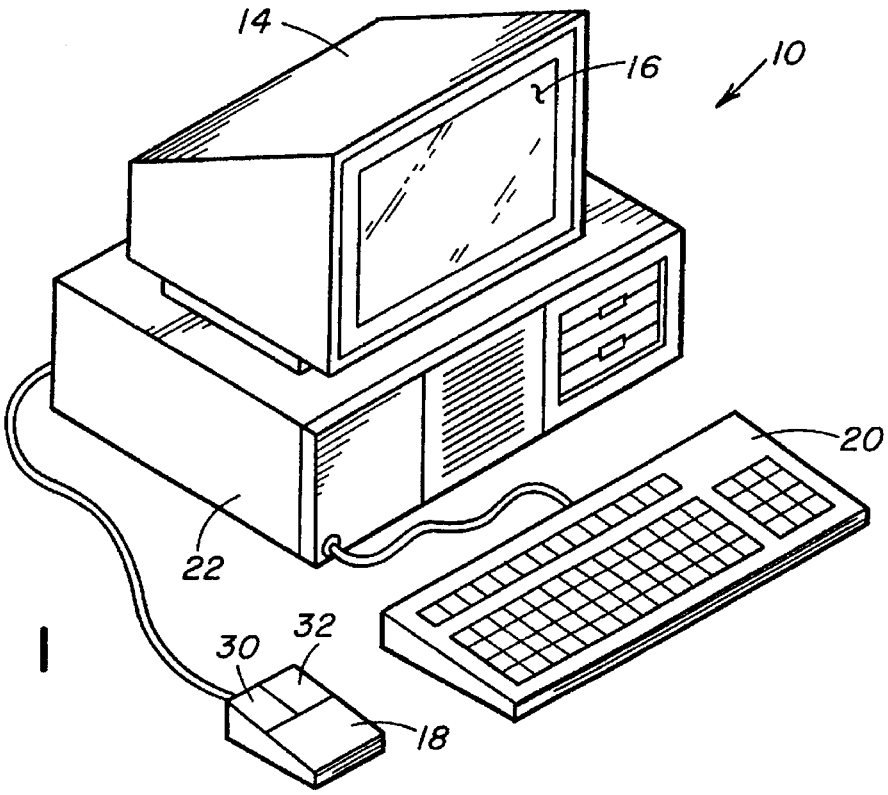
FIG. 1 is a perspective view of a computer system for playing a two-dimensional cyclic game of the present invention.
Figure 2:
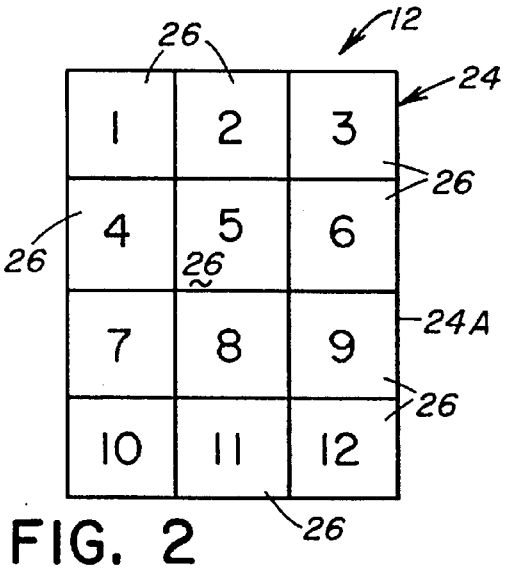
FIG. 2 is a diagram of one example of a generally planar two-dimensional playing field of the game having a 3×4 pattern of sites thereon.
Figure 3:
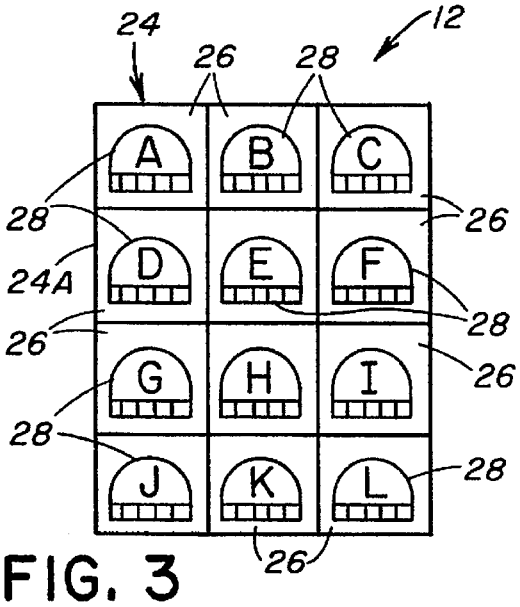
FIG. 3 is a diagram of one example of a pattern of game objects of the game being located on the pattern of sites of the playing field of FIG. 2.
Figure 4A:
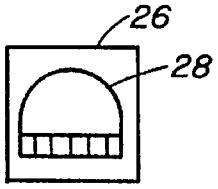
FIGS. 4A to 4D are diagrams of the four different orientations of each of the game objects on each of the sites of the playing field as a result of four cyclic rotational moves of the game object.
Figure 4B:
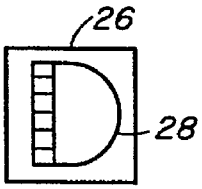
Figure 4C:
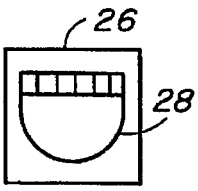
Figure 4D:
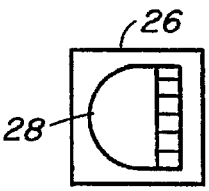
Figure 5A:
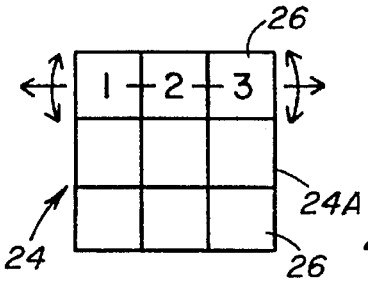
FIGS. 5A to 5F are diagrams of groups of sites on a playing field having an exemplary 3×3 pattern thereof wherein the groups of game objects which occupy such sites are arranged in common rows or columns of the sites and can undergo either cyclic translational or rotational moves in the directions of the arrows.
Figure 5B:
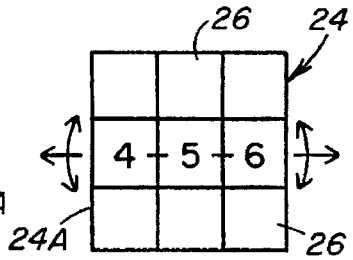
Figure 5C:
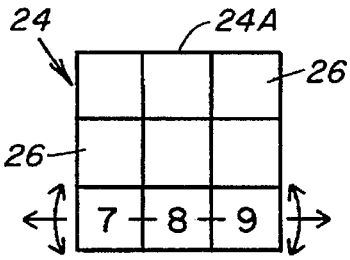
Figure 5D:
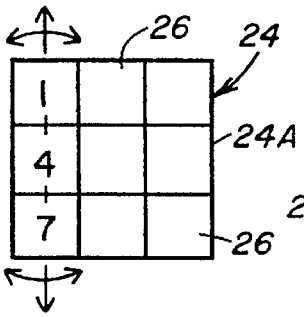
Figure 5E:
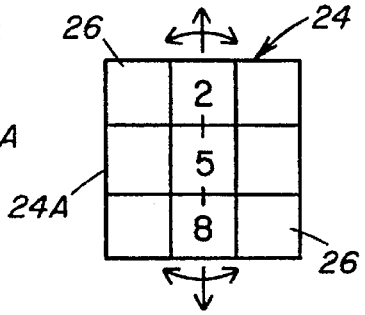
Figure 5F:
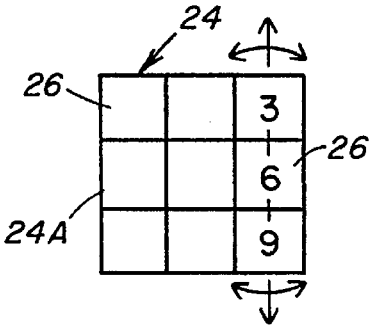
Figure 6A:
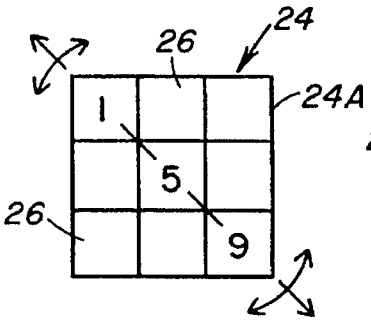
FIGS. 6A to 6F are diagrams of other groups of sites on a playing field also having an exemplary 3×3 pattern thereof wherein the groups of game objects which occupy such sites are arranged in different columns and/or rows thereof and can undergo cyclic rotational moves in the directions of the arrows.
Figure 6B:
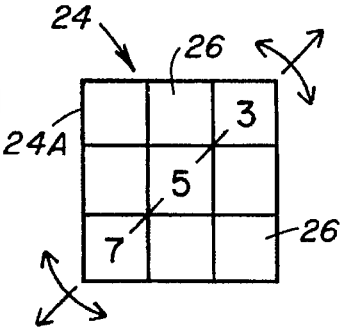
Figure 6C:
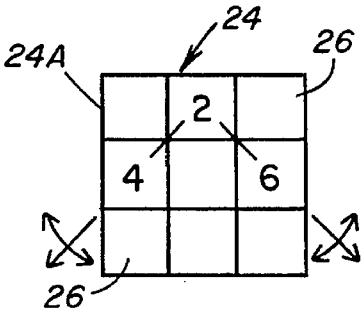
Figure 6D:
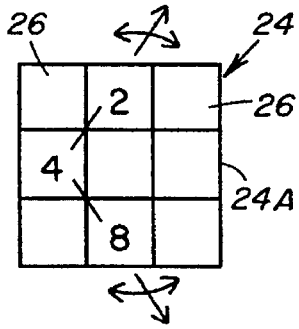
Figure 6E:
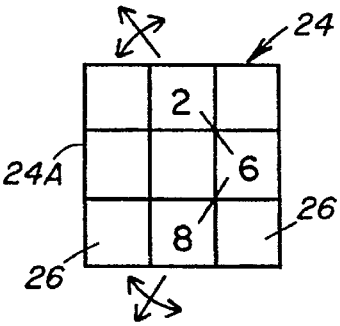
Figure 6F:
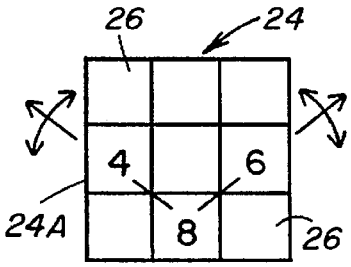

Referring to the drawings, and particularly to FIG. 1, there is illustrated a conventional computer system 10 for generating, monitoring, displaying and controlling the operations of a two-dimensional cyclic game 12 of the present invention, as represented in one exemplary form in FIGS. 2 and 3.

The game 12 is a puzzle-type game, preferably, implemented by a software program installed and run on the conventional computer system 10. The source code of one example of the software program is set forth in the Appendices A through E. The computer system 10 employs a display monitor 14 necessarily although not necessarily a color monitor, having a video display screen 16 and an input device in the form of a mouse 18. Additionally, in most computer systems, another input device in the form of a keyboard 20 is provided for use in conjunction with or as an alternative to the mouse 18. Inside a housing 22 of the computer system 10 are provided a central processing unit, or microprocessor, and a floppy or hard disk drive memory. Also, a movable cursor is typicaly displayed on the video display screen 16 of the display monitor 14. A game player actuates the mouse 18 in a known manner for sending instructions to the microprocessor of the computer system 10 to cause movement of the cursor and performance of puzzle game functions. The software program implementing the puzzle game is typically stored on the floppy or hard disk memory of the computer system 10 and in the internal memory of the microprocessor of the computer system 10. During operation of the software program, the microprocessor generates and causes display of images, to be described hereinafter, on the video display screen 16 and produces changes in those images in response to actuation of the mouse 18 by the game player.

Referring to FIGS. 2 and 3, there is illustrated three basic components making up the two-dimensional cyclic puzzle game 12 of the present invention. In the implementation of the game 12 in a software program for use with the computer system 10, these basic components are displayed on the video display screen 16 of the display monitor 14 of the computer system 10 of FIG. 1.

Figure 20:
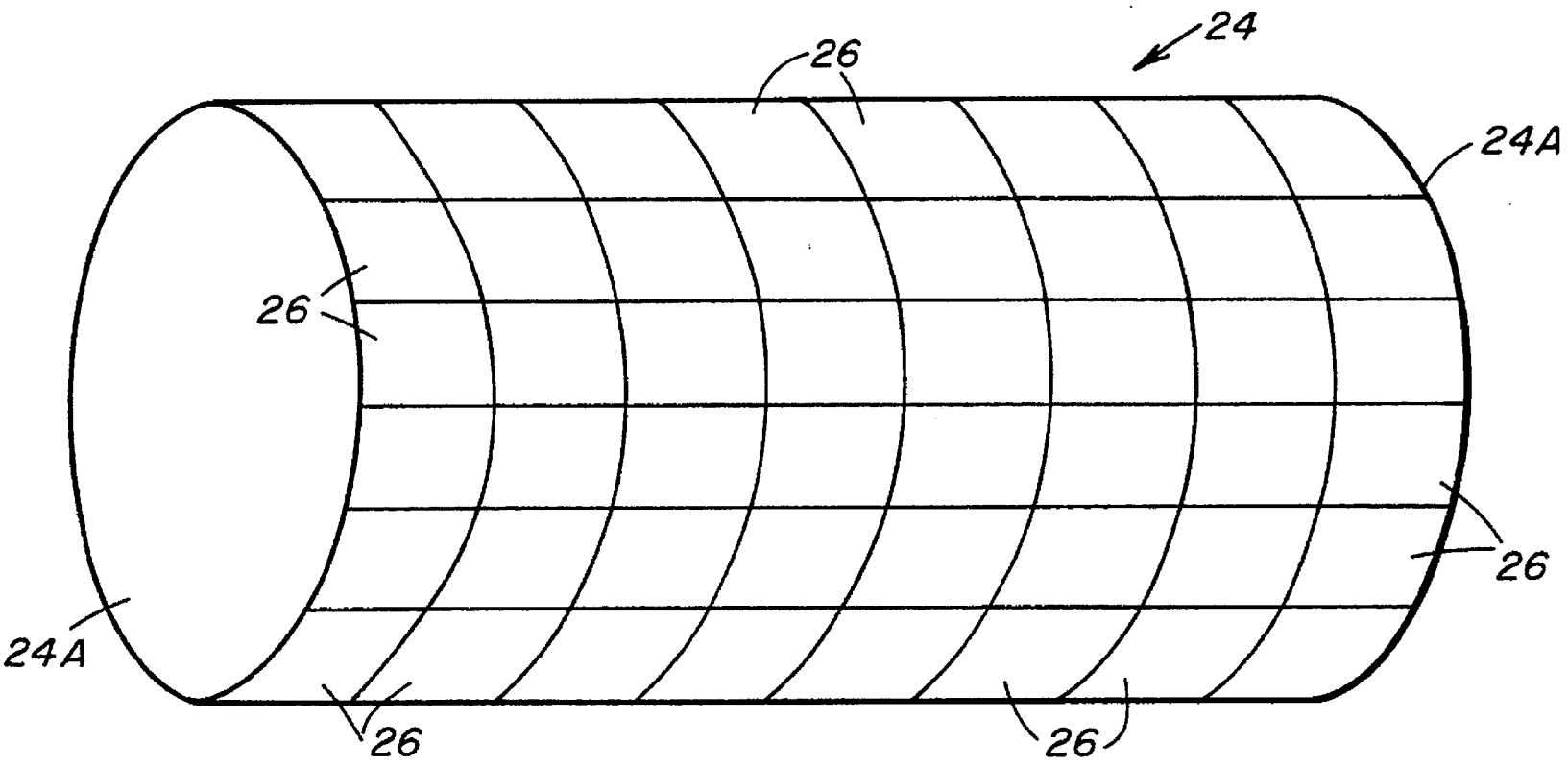
FIG. 20 is a diagram of one example of a generally curved, namely a cylindrical, two-dimensional playing field of the game.

The first component of the puzzle game 12, as shown in FIGS. 2 and 3, is a playing field 24 having a border 24A encompassing the entire perimeter of the playing field 24, whereas the second component of the puzzle game 12 is a pattern of fixed sites 26 on the playing field 24. In the one exemplary embodiment of the puzzle game 12 of FIGS. 2 and 3, the playing field 24 has a planar configuration such that the fixed sites 26 are contained within the border 24A of the playing field 24. As seen in FIG. 20, alternatively, it is within the purview of the present invention that the playing field 24 can have a curved configuration with borders 24A encompassing only portions of the playing field 24. In FIG. 20, the curved configuration of the playing field 24 is that of a cylinder and the borders 24A are located at opposite ends of the cylinder. Other shapes of the curved two-dimensional playing field 24 are possible, such as spherical and toroidal which may or may not have borders.

The third component of the puzzle game 12, as shown in FIG. 3, is a plurality of game objects 28 located on and occupying the sites 26 of the playing field 24 of FIG. 2. In the exemplary embodiment of the puzzle game 12 illustrated in FIGS. 2 and 3, the border 24A of the playing field 24 is a large rectangle which encloses a grid-like pattern of smaller rectangles that constitute the fixed sites 26. The fixed sites 26 fit within and substantially fill the larger rectangular border 24A of the field 24. As one example, FIGS. 2 and 3 show the fixed sites 26 and game objects 28 in a 3×4 grid pattern. Many other numbers of rows and columns are possible. The configurations and arrangements of the playing field 24, fixed sites 26 and game objects 28 shown in FIGS. 2 and 3 are only one of many possible implementations of the puzzle game 12 of the present invention. For example, other geometrical shapes, such as hexagonal and octagonal, of the playing field 24, fixed sites 26 and game objects 28 are equally possible. Also, the game objects 28 can be distinguished from one another by other schemes and coding techniques, for instance, by different colors. The scheme shown in FIG. 3 utilizes different letters of the alphabet.

Referring to FIGS. 4 to 6, there is illustrated the two types of moves the groups of playing objects 28 can undergo and further there is numerically identified the various different sets of sites 26 for locating various different selected groups of the playing objects 28 on the playing field 24. More particularly, FIGS. 4A to 4D show the four orientations each of the game objects 28 can have on the one site 26 of the playing field 24 occupied by the game object 28 as a result of four cyclic rotational moves of the game object 28. FIGS. 5A to 5F illustrate various different sets of sites 26 on the playing field 24 wherein the sites 26 are arranged in a 3×3 grid in either common rows (namely, sites numbered 1, 2 and 3 in FIG. 5A; sites numbered 4, 5 and 6 in FIG. 5B; and sites numbered 7, 8 and 9 in FIG. 5C) or common columns (namely sites numbered 1, 4 and 7 in FIG. 5D; sites numbered 2, 5 and 8 in FIG. 5E; and sites numbered 3, 6 and 9 in FIG. 5F). The game objects 28 which would occupy the various sets of sites 26 would correspondingly be arranged in either common rows (in FIGS. 5A to 5C) or common columns (in FIGS. 5D to 5F). FIGS. 6A to 6F depict various different sets of sites 26 on the playing field 24 wherein the sites 26 are also arranged in a 3×3 grid in different columns (namely, sites numbered 1, 5 and 9 in FIG. 6A; sites numbered 3, 5 and 7 in FIG. 6B; and sites numbered 2, 4 and 6 in FIG. 6C) and/or different rows (namely, sites numbered 2, 4 and 8 in FIG. 6D; sites numbered 2, 6 and 8 in FIG. 6E; and sites numbered 4, 6 and 8 in FIG. 6F), objects. The game objects 28 which would occupy the various sets of sites 26 would correspondingly be arranged in either different columns (in FIGS. 6A to 6C) and/or different rows (in FIGS. 6D to 6F).

Figure 7:
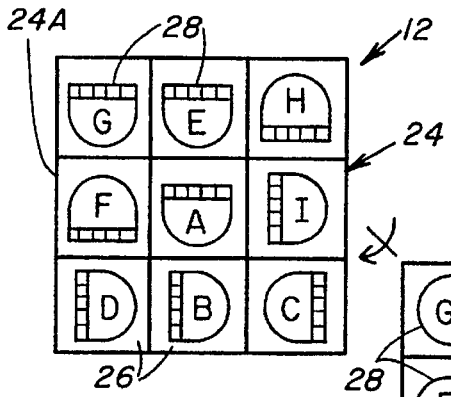
FIG. 7 is a diagram of a first embodiment of a puzzle game showing an initial pattern of game objects on the playing field sites at the start of the game.
Figure 15:
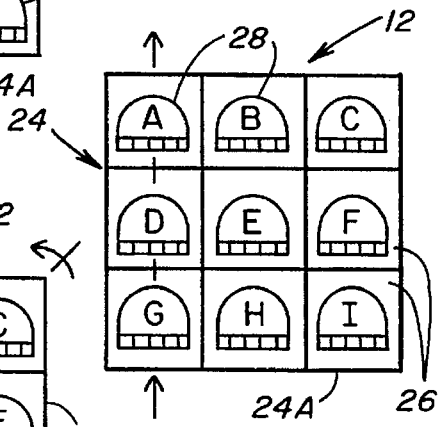
FIG. 15 is a diagram of a final desired pattern of the game objects after performance of a cyclic translational move of an eighth group of the game objects.

The cyclic game 12 of the present invention provides for cyclic translational and rotational moves, as represented by the arrows shown in FIGS. 5A to 5F and 6A to 6F, of the selected groups of game objects 28 on the sets of fixed sites 26 of the two-dimensional playing field 24, such as when displayed on the computer monitor screen 16, to reposition the game objects 28 on the sites 26 of the playing field 24 from an initial pattern, such as seen in FIG. 7, to a final desired pattern, such as seen in FIG. 15. In each of the two different moves, the game objects 28 in the selected groups are moved simultaneously in a given direction through translation or rotation about a portion of an endless cyclic path. For example, in each cyclic translational move on a playing field 24 of a planar configuration, the game objects 28 in the selected group occupying one set of the sites 26 on the playing field 24 corresponding in number with the game objects 28 of the selected group are moved simultaneously between the sites 26 of the one set such that with reference to the given direction of the move the leading the one of the game objects located adjacent to a first portion of the playing field border 24A moves off or leave the playing field 24 from one site 26 thereof at the first border portion and reenters back onto the playing field 24 into another site 26 thereof at a second portion of the playing field border 24A occupied by a trailing one of the game objects 28 at the start of the move and from which the trailing game object 28 moves during the same translational move of the game objects 28. The first and second border portions may be oppositely displaced (thus 180°) from one another or angularly displaced (thus 90°) from one another. On the other hand, in each cyclic rotational move, each of the game objects 28 in the selected group is moved such they remain on the same playing field site 26 and just rotate thereon through a quarter of a complete rotation cycle.

Referring to FIGS. 7 to 15, there is illustrated a first representative embodiment of a multiple object puzzle, such as implemented by the computer game 12 and displayed on the monitor screen 16 of the computer system 10 of FIG. 1. FIG. 7 depicts an initial pattern of the game objects 28 of the puzzle game at the start of the game. FIG. 15 depicts a final desired pattern of the game objects 28 at the finish of the game.

Referring to FIGS. 8 to 15, an exemplary succession of cyclic rotational and translational moves of game objects 28 of various selected groups thereof are illustrated which function to transform the puzzle from the initial pattern of FIG. 7 to the final desired pattern of FIG. 15. The arrangement of the game objects 28 in the initial pattern can be formed in various ways, ranging from randomized to ordered in some manner.

Figure 8:
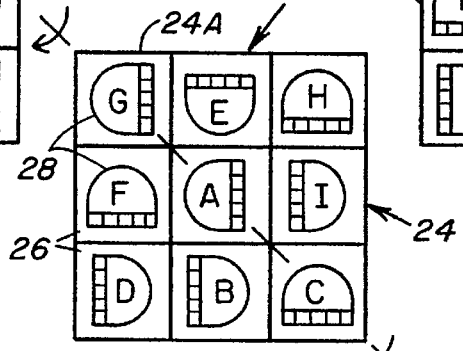
FIG. 8 is a diagram of the pattern of the game objects after performance of a cyclic rotational move of a first group of the game objects.
Figure 9:
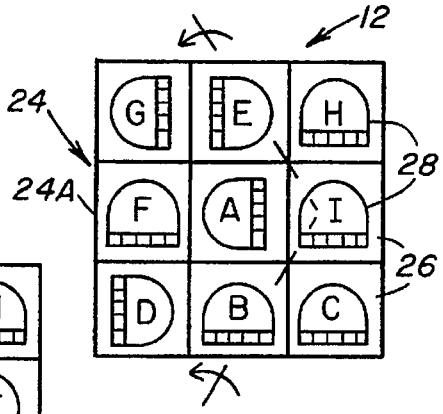
FIG. 9 is a diagram of the pattern of the game objects after performance of a cyclic rotational move of a second group of the game objects.
Figure 10:
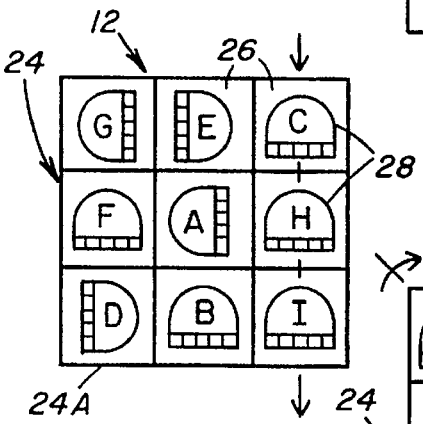
FIG. 10 is a diagram of the pattern of the game objects after performance of a cyclic translational move of a third group of the game objects.
Figure 11:
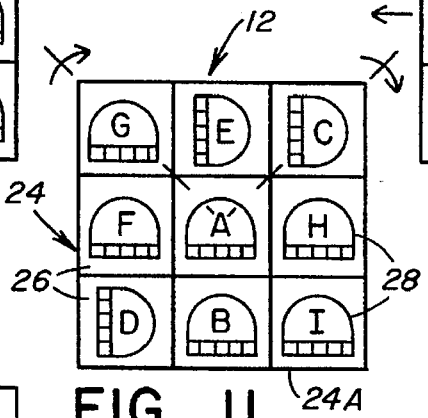
FIG. 11 is a diagram of the pattern of the game objects after performance of a cyclic rotational move of a fourth group of the game objects.
Figure 12:
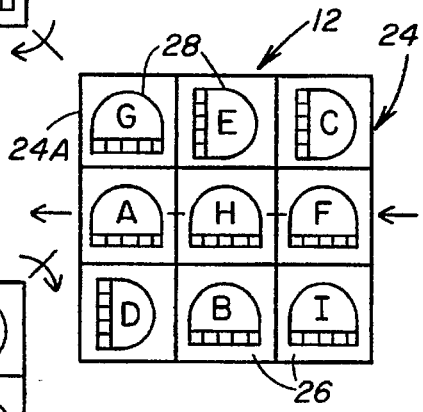
FIG. 12 is a diagram of the pattern of the game objects after performance of a cyclic translational move of a fifth group of the game objects.
Figure 13:
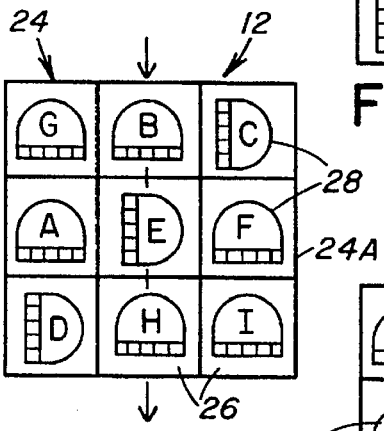
FIG. 13 is a diagram of the pattern of the game objects after performance of a cyclic translational move of a sixth group of the game objects.
Figure 14:
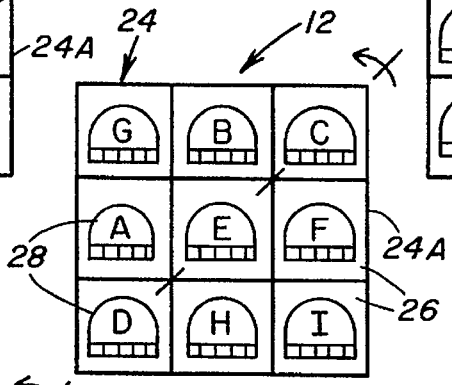
FIG. 14 is a diagram of the pattern of the game objects after performance of a cyclic rotational move of a seventh group of the game objects.

More particularly, FIG. 8 depicts a first transitional pattern of the game objects 28 of the puzzle after performance of a cyclic rotational move of a first group of the game objects 28 identified by the letters G, A and C. FIG. 9 depicts a second transitional pattern of the game objects 28 of the puzzle after performance of another cyclic rotational move of a second group of the game objects 28 identified by the letters E, I and B. FIG. 10 depicts a third transitional pattern of the game objects 28 of the puzzle after performance of a cyclic translational move of a third group of the game objects 28 identified by the letters C, H and I. FIG. 11 depicts a fourth transitional pattern of the game objects 28 of the puzzle after performance of still another cyclic rotational move of a fourth group of the game objects 28 identified by the letters G, A and C. FIG. 12 depicts a fifth transitional pattern of the game objects 28 of the puzzle after performance of another cyclic translational move of a fifth group of the game objects 28 identified by the letters A, H and F. FIG. 13 depicts a sixth transitional pattern of the game objects 28 of the puzzle after performance of still another cyclic translational move of a sixth group of the game objects 28 identified by the letters B, E and H. FIG. 14 depicts a seventh transitional pattern of the game objects 28 of the puzzle after performance of a further cyclic rotational move of a seventh group of the game objects 28 identified by the letters D, E and C. Lastly, FIG. 15 depicts the final desired pattern of the game objects 28 of the puzzle after still another cyclic translational move of an eighth group of the game objects 28 identified by the letters A, D and G.

Figure 17:
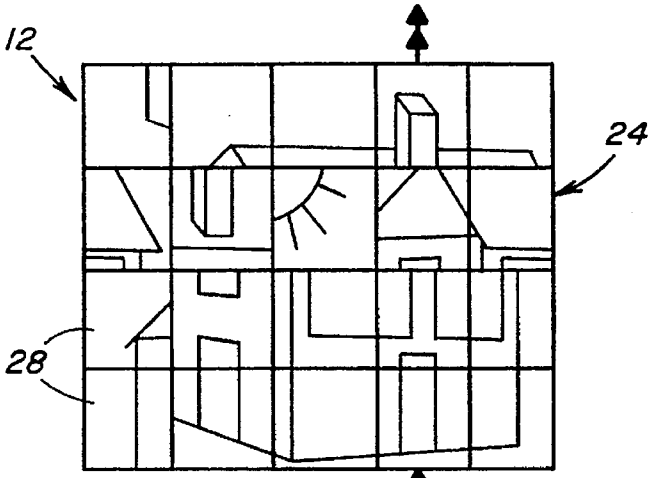
FIG. 17 is a diagram of the pattern of picture segments after performance of two successive cyclic translational moves of a first group of the picture segments.
Figure 19:
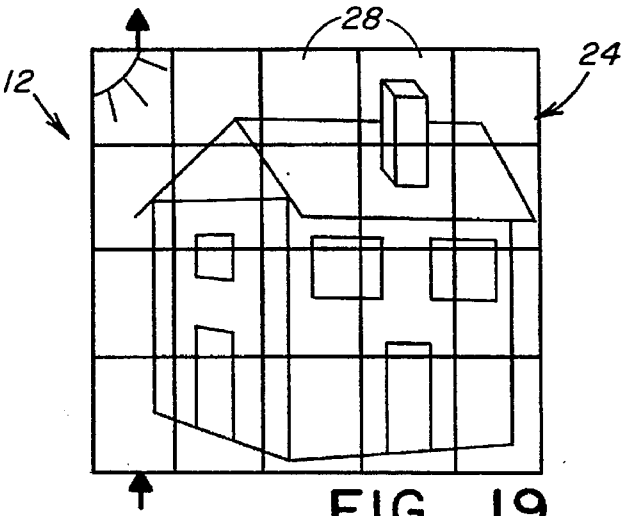
FIG. 19 is a diagram of a final pattern of the picture segments in which the picture is completed after performance of a cyclic translational move of a third group of the picture segments.
Figure 16:
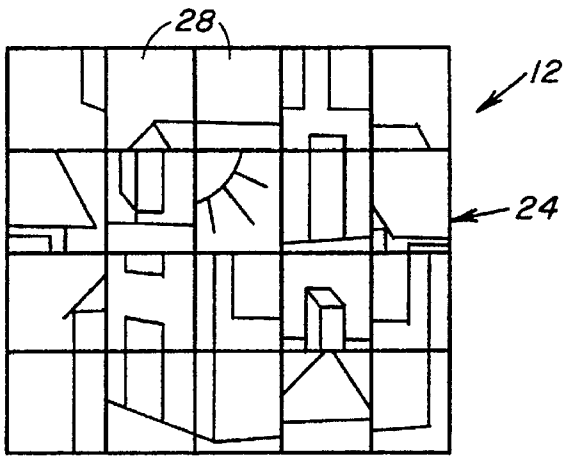
FIG. 16 is a diagram of a second embodiment of a puzzle game showing an initial pattern of picture segments on playing field sites at the start of the game.
Figure 18:
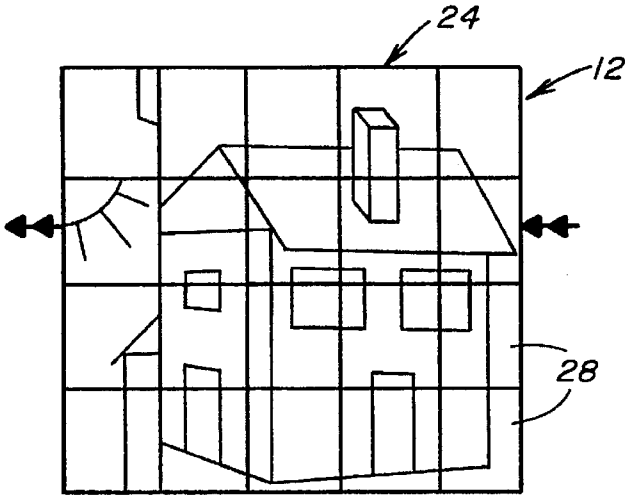
FIG. 18 is a diagram of the pattern of picture segments after performance of two successive cyclic translational moves of a second group of the picture segments.

Referring to FIGS. 16 to 19, there is illustrated a second representative embodiment of a puzzle in the form of a picture implemented by the computer game 12 and displayed on the monitor screen 16 of the computer system 10 of FIG. 1. More specifically, FIG. 16 depicts an initial pattern of segments of the picture puzzle. FIG. 17 depicts a first transitional pattern of the picture segments after performance of two successive cyclic translational moves of a first group of the picture segments. FIG. 18 depicts a second transitional pattern of the picture segments of the puzzle after performance of two successive cyclic translational moves of a second group of the picture segments. FIG. 19 depicts the final pattern of the picture segments of the puzzle after a cyclic translational move of a third group of the picture segments in which the picture is now completed. Thus, it will be understood that a puzzle game can be implemented where only a succession of cyclic translational moves are utilized as well as of a succession of cyclic translational or rotational moves.

To play the two-dimensional cyclic game 12 of the present invention using the computer system 10, a player must first selects the design or layout of the components of the game on the display screen 16 by selecting the geometry (rectangular, hexagonal, etc.) of the field 24 and sites 26, the dimensions (number of rows and columns in rectangular games and appropriate dimensions in games of other geometries) of the field 24, and the design of the particular object 28 to occupy each site 26. The selections are made by any suitable technique or means, one such being from a menu on the display screen 16 by appropriately actuating the mouse 18, keyboard 20 or other input device. In case of use of the mouse 18, the cursor on the screen 16 is set on the selected option and then the left button 30 of the mouse 18 is pressed to make the selection.

The game consists of a series or succession of moves as described above to reposition the game objects 16 on the sites 26 of the field 24 from an initial pattern to a final desired pattern. The playing of the game can be timed and scored by elapsed time, number of moves and other parameters which may be of interest to the player. These parameters can be measured and displayed. Each move by the player implies the performance of the following Steps 1 through 5.

Step 1: SELECTING OBJECT. A game object 28 occupying a site 26 on the field 24 is selected by using the mouse 18, keyboard 20 or other input device. In the case of the mouse 18, the cursor is set on the object selected and the left button 30 is pressed and kept down.

Step 2: SELECTING GROUP. A group of game objects 28 is selected by starting an appropriate movement by using the mouse 18, keyboard 20 or other input device. In the case of the mouse 18, the initial move shows the group which is automatically identified if the left button 30 is kept depressed.

Step 3: MOVE. The selected game object 28 is moved translationally (linearly) or rotationally by using the mouse 18, keyboard 20 or other input device. In the case of the mouse 18, the mouse movement with the left button 30 pressed provides the appropriate translation group move; if the control key of the keyboard 20 is simultaneously pressed then the movement is rotational.

Step 4: MOVE COMPLETION. The player initiates the move completion by the appropriate use of the mouse 18, keyboard 20 or other input device. In the case of the mouse 18, to indicate the move is completed, the player releases the left button 30 of the mouse 18.

Step 5: POST MOVE GROUP CORRECTION. After the move completion is initiated, the positions of all moved game objects 28 are automatically corrected to the closest sites of the selected group. In the case of the mouse 18, when the left button 30 is released, the positions of all moved game objects are automatically corrected to the closest sites of the selected group.

Other features of the game includes Give Up, Clue and Help menu options. If the player gives up, then to restore the game objects order or the proper picture, the Give Up option assists the player to complete the game by displaying the solution. The player also can select the Clue option from the menu or by using the mouse 18 to see the properly ordered objects or the properly completed picture. In the case of the mouse 18, the player can see the clue on the display screen 16 when the right button 32 of the mouse 18 is pressed. When the mouse right button 32 is released the clue disappears. Help is always available on the menu or by pressing an assigned key, normally F1, on the keyboard 20.

Referring now to FIG. 20, there is illustrated a diagram of an example of a generally curved, namely a cylindrical, two-dimensional playing field 24 of the game 12. The playing field 24 has a pair of opposite end borders 24A and a plurality of sites 26 thereon which are arranged in longitudinal or axial rows which extend between and terminate at the opposite end and in circumferential columns which are endless and thus have no borders. Other shapes of the curved two-dimensional playing field 24 are possible, such as spherical and toroidal which may or may not have borders.

Figure 21:
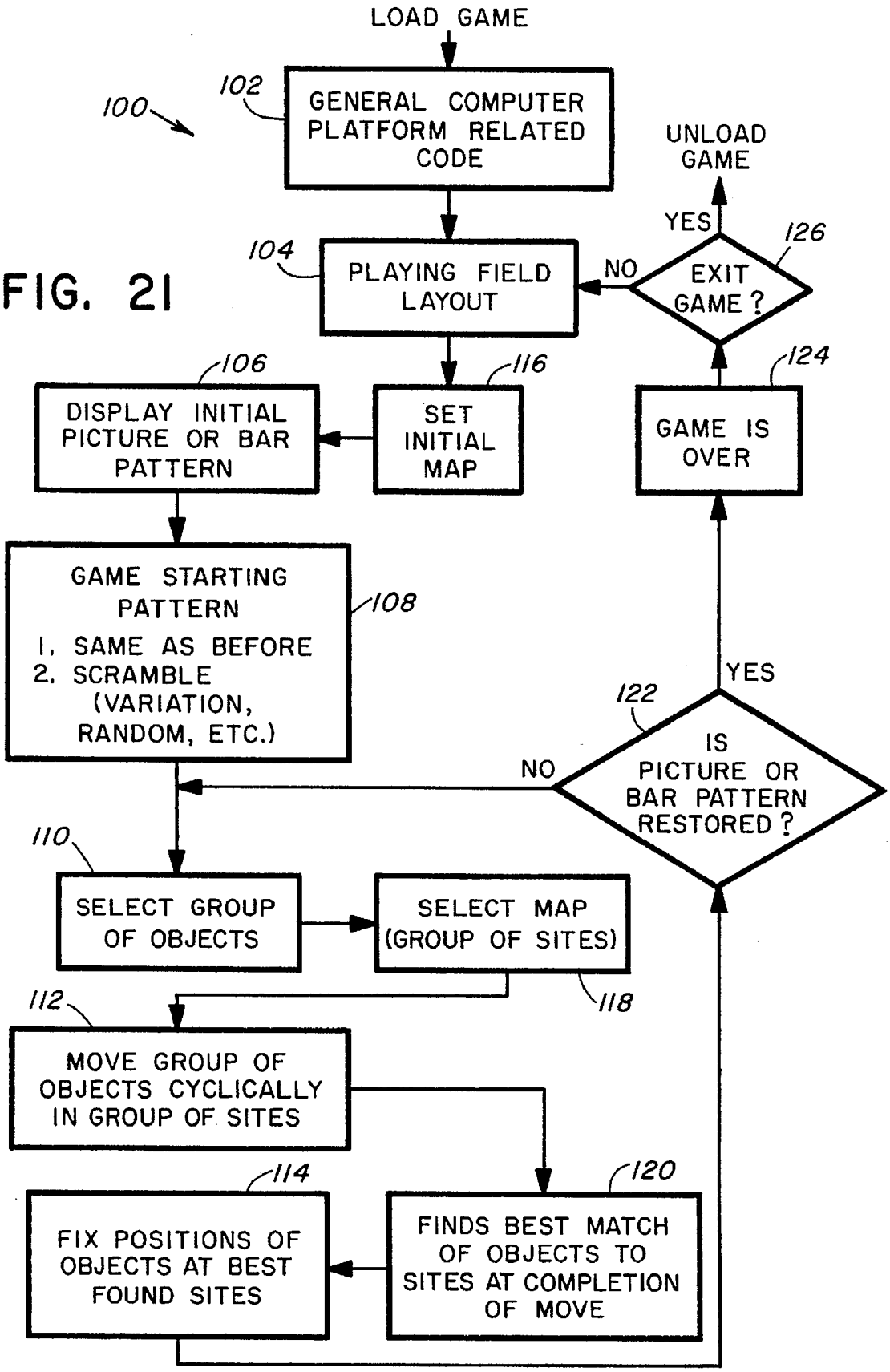
FIG. 21 is a flowchart depicting overall operations performed by a software program which is but one implementation of the two-dimensional cyclic game of the present invention on a computer, the source code of the software program being provided in the appendices to the subject application.

Referring to FIG. 21, there is illustrated a flowchart, generally designated 100, depicting overall operations performed by the modules of a software program providing one exemplary implementation of the two-dimensional cyclic game of the present invention on the computer system 10 of FIG. 1. The source code of the different modules of the software program written in "c" code are provided in the attached appendices. More specifically, Appendix A entitled "botta.c" provides a general Windows operations module of the program which is represented by block 102 of the flowchart 100 and functions to adapt the game to a Windows environment. Appendix B entitled "field.c" provides a program module which is represented by block 104 of the flowchart 100 and functions to establish the selected layout of the playing field 24 on the display screen 16. Appendix C entitled "bar.c" provides a program module which is represented by blocks 106 to 114 of the flowchart 100 and functions to position and display on the screen 16 the selected game objects 28 on the respective sites 26 of the playing field 24 and to cause the movements of the game objects 28 on the screen 16 relative to the sites 26 of the playing field 24 as directed by each player using the mouse 18. Appendix D entitled "map.c" provides a program module which is represented by blocks 116 to 126 of the flowchart 100 and functions as a map not seen on the display screen 16 that monitors the sites and sites groups to determine the positions of the game objects 28, for instance, in order to cause them to assume the sites 26 on the playing field 24 closest to the locations of the respective game objects 28 within the site group at the completion of each move so that a player can complete the move of the objects approximate the desired positions, and to determine whether or not the pattern is restored and the game is over. Appendix E entitled "control.c" provides a program module which is not represented in the flowchart 100 and functions to inform a player on the current status of the game. The software program includes other modules dealing with various software services which are not necessary to describe herein for an understanding of the game of the present invention.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

Two-botta.c Dimensional Cyclic Game - BOTTA Page 1

APPENDIX A

```
/*****************************************************************************
        Copyright by Sergey K. Aityan and Alexander V. Lysyansky

  BOTTA       Version 1.2
  PROGRAM: botta.c

        August 11, 1995

  PURPOSE:    2-Dimensional Cyclic Game
                        Major Windows Procedures

  FUNCTIONS:

  WinMain()        - calls initialization function, processes message loop
  InitApplication() - initializes window data and registers window
  InitInstance()   - saves instance handle and creates main window
  MainWndProc()    - processes messages
  About()          - processes messages for "About" dialog box
  Help()                          - processes help window

        SetSelections()

  CaseBar()
  CasePicture()
  CaseChangeNumRows()
  CaseChangeNumColumns()
  CaseVariate()
  CaseGame()

        void CheckDLLs(HMENU hMenu);
  void NewGame(HMENU hMenu)
*****************************************************************************/

#include "windows.h"
#include "string.h"
#include <math.h>
//#include <malloc.h>
#include <time.h>
#include <stdio.h>
//#include <stdlib.h>
#include <io.h>                                  // for ACCESS() function

//#include <shellapi.h>

#include "resource.h"

#include "botta.h"
#include "field.h"
#include "controls.h"
#include "debug.h"

HWND hWnd = NULL;
HWND hHelpWnd = NULL;
```

Two - botta.c Dimensional Cyclic Game - BOTTA Page 2

```
HANDLE hInst;

HDC hDC;
HDC hHelpDC;
int ih = 1;

short cxClient, cyClient;
short codeMove = 0;                    // 1 - Hor, 2 - ver
short flagStart     = 0;
BOOL flagFirstMove      = FALSE;
BOOL flagFinish         = FALSE;
BOOL flagBarNumber      = FALSE;
BOOL flagPicture        = FALSE;
BOOL flagField;                                          // TRUE if the coordinate is inside
the rectField
BOOL flagVariateAuto = TRUE;
BOOL flagHelp = FALSE;                          // TRUE - Help Window is Up
short nVariate = N_HORIZONTAL + N_VERTICAL;                    // Prepare nVariate for
AUTO
//BOOL flagClue          = TRUE;

char str[255];                 // general-purpose string buffer

HCURSOR hSaveCursor;               // handle to current cursor
HCURSOR hArrowCursor, hHourCursor;

BOOL bTrack = FALSE;               // TRUE if left button clicked
POINT org       = {0,0};
POINT prev      = {0,0};
POINT currMapIndex = {0,0};
POINT move = {0,0};
POINT PXY       = {0,0};
//int OrgX = 0, OrgY = 0;          // original cursor position
//int PrevX = 0, PrevY = 0;        // current cursor position
//int X = 0, Y = 0;                // last cursor position

POINT ptCursor;                    // x and y coordinates of cursor
int repeat = 1;                    // repeat count of keystroke
clock_t clPause = 30L;
clock_t clStart, clFinish, clTemp;

int numMoves;

short nHor = N_HORIZONTAL;
short nVer = N_VERTICAL;

RECT rectPage   = {0, 600, 800, 0};
//RECT rectPage = {0, 8400, 8400, 0};
//RECT rectPage = {0, 6000, 8000, 0};
RECT rectField; //        = {250, 450, 550, 150};
RECT Rect = {100, 300, 180, 100};
RECT rectClue;
POINT fieldSize;
```

```
POINT barSize;

CONTFRAME cont_frame_1, cont_frame_2, cont_frame_3;

//////////////////////////////////////////////////////////////////////////

HBRUSH hNewBrush, hOldBrush;//,hNewBallBrush, hOldBallBrush ;
HBITMAP hBitmap;
//HBITMAP hBitmap1, hBitmap2, hBitmap3, hBitmap4, hBitmap5, hBitmap6, hBitmap7, hBitmap8,
hBitmap9;
HBITMAP hBitmapCongratulations;

HBITMAP hMenuBitmap1;

BITMAP Bitmap;
HDC hMemoryDC;

int fStretchMode;                // type of stretch mode to use
//////////////////////////////////////////////////////////////////////////

BAR *barSet;
int *fieldGridHor, *fieldGridVer;

//////////////////////////////////////////////////////////////////////////


//int GetMapColumnIndex(int);
//int GetMapRowIndex(int);
//void MoveRow(HDC, POINT*, POINT*);
//void MoveColumn(HDC, POINT*, POINT*);
//void FixRowPosition(HDC, POINT);
//void FixColumnPosition(HDC, POINT);
MAP *map;


/****************************************************************************

  FUNCTION: WinMain(HANDLE, HANDLE, LPSTR, int)

  PURPOSE: calls initialization function, processes message loop

****************************************************************************/

int PASCAL WinMain(hInstance, hPrevInstance, lpCmdLine, nCmdShow)
HANDLE hInstance;
HANDLE hPrevInstance;
LPSTR lpCmdLine;
int nCmdShow;
{
  MSG msg;

  if (!hPrevInstance)
    if (!InitApplication(hInstance))
```

Two -

```
        return (FALSE);

    if (!InitInstance(hInstance, nCmdShow))
      return (FALSE);

    /*
    MessageBox (GetFocus (),
            "Use the mouse button in this program for an example of graphics "
            "selection, or the <Enter> key for an example of "
            "using a special cursor to reflect a program state.",
            "Cursor Sample Application",
            MB_ICONASTERISK | MB_OK);
    */

    while (GetMessage(&msg, NULL, NULL, NULL))
    {
      TranslateMessage(&msg);
      DispatchMessage(&msg);
    }
    return (msg.wParam);
}

/****************************************************************************

    FUNCTION: InitApplication(HANDLE)

    PURPOSE: Initializes window data and registers window class

****************************************************************************/

BOOL InitApplication(hInstance)
HANDLE hInstance;
{
    WNDCLASS  wc;

        // Register Main Window
    wc.style = CS_HREDRAW | CS_VREDRAW;
    wc.lpfnWndProc = MainWndProc;
    wc.cbClsExtra = 0;
    wc.cbWndExtra = 0;
    wc.hInstance = hInstance;
    wc.hIcon = LoadIcon(NULL, IDI_APPLICATION);
    wc.hCursor = LoadCursor(hInstance, IDC_ARROW);
    //wc.hbrBackground = GetStockObject(WHITE_BRUSH);
    wc.hbrBackground = GetStockObject(LTGRAY_BRUSH);
    wc.lpszMenuName =  "BottaMenu";
//   wc.lpszMenuName =  NULL;
    wc.lpszClassName = "BottaWClass";

    (RegisterClass(&wc));

        // Register Help Window
```

Two -

```
    wc.style = NULL;
    wc.lpfnWndProc = HelpWndProc;
    wc.cbClsExtra = 0;
    wc.cbWndExtra = 0;
    wc.hInstance = hInstance;
    wc.hIcon = LoadIcon(NULL, IDI_APPLICATION);
    wc.hCursor = LoadCursor(hInstance, IDC_ARROW);
    wc.hbrBackground = GetStockObject(WHITE_BRUSH);
    wc.lpszMenuName =  "HelpMenu";
    wc.lpszClassName = "HelpWClass";

    return (RegisterClass(&wc));
}


/****************************************************************************

    FUNCTION:  InitInstance(HANDLE, int)

    PURPOSE:  Saves instance handle and creates main window

****************************************************************************/

BOOL InitInstance(hInstance, nCmdShow)
HANDLE          hInstance;
int             nCmdShow;
{
    //HWND hWnd;

    hInst = hInstance;

    strcpy(str,"KU-KU");

    hWnd = CreateWindow(
                                        "BottaWClass",
                "Botta",
                WS_OVERLAPPEDWINDOW,
//                                              WS_MAXIMIZE,
/*
                CW_USEDEFAULT,
                CW_USEDEFAULT,
                CW_USEDEFAULT,
                CW_USEDEFAULT,
*/
                                                -1,
                                        -1,
                                        //10000,
                                        //10000,
                                                GetSystemMetrics (SM_CXSCREEN),
                                                GetSystemMetrics (SM_CYSCREEN),
                NULL,
                NULL,
                hInstance,
```

```
            NULL
            );

  if (!hWnd)
    return (FALSE);

  //if (!SetTimer (hWnd, 1, 50, NULL))
  if (!SetTimer (hWnd, 1, 1, NULL))
  {
    MessageBox (hWnd, "Too many clocks or timers!",
          "BOTTA", MB_ICONEXCLAMATION | MB_OK) ;
      return FALSE ;
  }

  ShowWindow(hWnd, nCmdShow);
  UpdateWindow(hWnd);
  return (TRUE);

}

/*****************************************************************************

  FUNCTION: MainWndProc(HWND, UINT, WPARAM, LPARAM)

  PURPOSE:  Processes messages

  MESSAGES:

  WM_TIMER                    - timer provides time count
  WM_COMMAND        - application menu
    IDM_GAME_EXIT  -
    IDM_GAME_NEWGAME
    IDM_GAME_VARIATE
    IDM_GAME_RANDOMIZE
    IDM_PICTURE_BARCOLOR
                _BARNUMBER
                _PICTURE_ ...
    IDM_SIZE_
    IDM_OPTIONS_
    IDM_ABOUT                                    -        About dialog box
    IDM_HELP

      WM_CHAR        - ASCII key value received
      WM_LBUTTONDOWN  - left mouse button
      WM_MOUSEMOVE    - mouse movement
      WM_LBUTTONUP    - left button released
      WM_RBUTTONDOWN  - right mouse button
      WM_RBUTTONUP    - right button released
      WM_KEYDOWN      - key pressed
      WM_KEYUPS       - key released
      WM_PAINT        - update window
  WM_DESTROY        - destroy window
```

Two -

```
  COMMENTS:

     When the left mouse button is pressed, btrack is set to TRUE so that
     the code for WM_MOUSEMOVE will keep track of the mouse and update
     the box accordingly.  Once the button is released, btrack is set to
     FALSE, and the current position is saved.  Holding the SHIFT key
     while pressing the left button will extend the current box rather
     then erasing it and starting a new one.

     When an arrow key is pressed, the cursor is repositioned in the
     direction of the arrow key.  A repeat count is kept so that the
     longer the user holds down the arrow key, the faster it will move.
     As soon as the key is released, the repeat count is set to 1 for
     normal cursor movement.

*****************************************************************************/

long FAR PASCAL __export MainWndProc(hWnd, message, wParam, lParam)
HWND hWnd;
UINT message;
WPARAM wParam;
LPARAM lParam;
{
        HANDLE      hInstance;
        static HMENU hMenu, hMenu1, hMenu2, hMenu3;
        HDC hDC2;
  FARPROC lpProcAbout; //, lpProcHelp;  // Pointers to "About" and "Help" Procedures
  static int checkRowIndex, checkColIndex;
  static WORD mess;
  static WORD barNumberSelection        = IDM_PICTURE_COLORONLY;
  //static WORD clueSelection           = IDM_PICTURE_SHOWCLUE;
  static WORD numRowSelection           = IDM_SIZE_NUMBEROFROWS_4;
  static WORD numColSelection           = IDM_SIZE_NUMBEROFCOLUMNS_4;
  static WORD numVarSelection           = IDM_OPTIONS_VARMOVES_AUTO;
  //static BOOL flagFirstMove = FALSE;
        static POINT prevBarIndex;
        //static short nVariate = N_HORIZONTAL + N_VERTICAL ;        // Number of variation
moves
        static HANDLE hLibrary = 5, hLibraryFinish = 0;
        static nCurrent = 1;
        static char strdll[225];

  switch (message)
  {

        case WM_TIMER:

                if (!flagFinish)
                        if (flagFirstMove)
                        {
                                hDC2 = InitDraw(hWnd);
                                PrintTime(hDC2, &cont_frame_1);
                                ReleaseDC(hWnd, hDC2);
```

```
                }

                return 0;

    case WM_COMMAND:
    {
        hMenu = GetMenu(hWnd);
        switch (wParam)
        {
                case IDM_GAME_EXIT:
                        DestroyWindow(hWnd);
                        return 0;

                case IDM_GAME_NEWGAME:
                        hMenu = hMenu1;
                        NewGame(hMenu);
                        /*
                                        SetField();
                                        hDC = InitDraw(hWnd);
                                        ShowBarSet(hDC);
                                        ShowControlField(hDC, &cont_frame_1);
                                        ShowControlField(hDC, &cont_frame_2);
                                        PrintNewGame(hDC, &cont_frame_3);
                                        ReleaseDC(hWnd, hDC);
                                        // Set Menu1 - Options & Size Enabled
                                        hMenu = hMenu1;
                                        SetMenu(hWnd, hMenu);
                        flagStart= 0;
                                        CaseGame(hMenu);
                                        flagFirstMove = FALSE;
                                        numMoves = 0;
                                        //InvalidateRect (hWnd, NULL, TRUE);
                                        */
                        return 0;

                case IDM_GAME_VARIATE:
                                        SetField();
                                                //PrintMap(10, 400);
                                        SetVariatedMap();
                                        SetBarSetMap();
                                                //PrintMap(400, 400);
                                        hDC = InitDraw(hWnd);
                                        ShowBarSet(hDC);
                                        PrintVariation(hDC, &cont_frame_3);
                                        ReleaseDC(hWnd, hDC);
                                                //PrintBarSetIndeces(20, 400);
                                                //PrintMap(400, 400);
                                        // Set Menu2 - Options & Size Grayed
                                        hMenu = hMenu2;
                                        SetMenu(hWnd, hMenu);
                        flagStart= 1;
                                        CaseGame(hMenu);
                                        flagFirstMove = TRUE;
```

```
                        clStart = clock();
                        numMoves = 0;
                        //InvalidateRect (hWnd, NULL, TRUE);
                return 0;

        case IDM_GAME_RANDOMIZE:

                        SetField();
                        SetRandomizedMap();
                        SetBarSetMap();
                        hDC = InitDraw(hWnd);
                        ShowBarSet(hDC);
                        PrintRandomize(hDC, &cont_frame_3);
                        ReleaseDC(hWnd, hDC);
                                //PrintBarSetIndeces(20, 400);
                                //PrintMap(400, 400);
                        // Set Menu2 - Options & Size Grayed
                        hMenu = hMenu2;
                        SetMenu(hWnd, hMenu);
                flagStart= 2;   // 2 - Show Solution doesn't allowed
                        CaseGame(hMenu);
                        flagFirstMove = TRUE;
                        clStart = clock();
                        numMoves = 0;
                        //InvalidateRect (hWnd, NULL, TRUE);

                return 0;

        case IDM_PICTURE_COLORONLY:
                        flagBarNumber = FALSE;
                mess = IDM_PICTURE_COLORONLY;
                        CaseBar(hMenu, mess, &barNumberSelection);
                return 0;

        case IDM_PICTURE_COLORANDNUMBER:
                        flagBarNumber = TRUE;
                mess = IDM_PICTURE_COLORANDNUMBER;
                        CaseBar(hMenu, mess, &barNumberSelection);
                return 0;

        case IDM_PICTURE_PICTURE_FACE:
                strcpy(strdll,"DLL/FACE.DLL");
                mess = IDM_PICTURE_PICTURE_FACE;
                        CasePicture(hMenu, mess, &barNumberSelection,
&hLibrary, strdll);
                return 0;

        case IDM_PICTURE_PICTURE_FLOWERS:
                strcpy(strdll,"DLL/FLOWERS.DLL");
                mess = IDM_PICTURE_PICTURE_FLOWERS;
                        CasePicture(hMenu, mess, &barNumberSelection,
&hLibrary, strdll);
                return 0;
```

```
            case IDM_PICTURE_PICTURE_CIRCLES:
                    strcpy(strdll,"DLL/CIRCLES.DLL");
                    mess = IDM_PICTURE_PICTURE_CIRCLES;
                                    CasePicture(hMenu, mess, &barNumberSelection,
&hLibrary, strdll);
                    return 0;

            case IDM_PICTURE_PICTURE_DOLLAR:
                    strcpy(strdll,"DLL/DOLLAR.DLL");
                    mess = IDM_PICTURE_PICTURE_DOLLAR;
                                    CasePicture(hMenu, mess, &barNumberSelection,
&hLibrary, strdll);
                    return 0;

            case IDM_PICTURE_PICTURE_MESSAGE:
                    strcpy(strdll,"DLL/MESSAGE.DLL");
                    mess = IDM_PICTURE_PICTURE_MESSAGE;
                                    CasePicture(hMenu, mess, &barNumberSelection,
&hLibrary, strdll);
                    return 0;

            case IDM_PICTURE_PICTURE_DOG:
                    strcpy(strdll,"DLL/DOG.DLL");
                    mess = IDM_PICTURE_PICTURE_DOG;
                                    CasePicture(hMenu, mess, &barNumberSelection,
&hLibrary, strdll);
                    return 0;

            case IDM_PICTURE_PICTURE_CAT:
                    strcpy(strdll,"DLL/CAT.DLL");
                    mess = IDM_PICTURE_PICTURE_CAT;
                                    CasePicture(hMenu, mess, &barNumberSelection,
&hLibrary, strdll);
                    return 0;

            case IDM_PICTURE_PICTURE_ARCHES:
                    strcpy(strdll,"DLL/ARCHES.DLL");
                    mess = IDM_PICTURE_PICTURE_ARCHES;
                                    CasePicture(hMenu, mess, &barNumberSelection,
&hLibrary, strdll);
                    return 0;

            /*
            case IDM_PICTURE_SHOWCLUE:
                    if (flagClue)
                    {
                            flagClue = FALSE;
                            CheckMenuItem(hMenu, clueSelection, MF_UNCHECKED);
                            //InvalidateRect(hWnd, NULL, FALSE);
                    }
              else
                    {
```

```
                flagClue = TRUE;
                CheckMenuItem(hMenu, clueSelection, MF_CHECKED);
        }
                hDC = InitDraw(hWnd);
                ShowClue(hDC, &rectClue, flagClue, TRUE);
                ReleaseDC(hWnd, hDC);
        //}
        return 0;
*/

                case IDM_SIZE_NUMBEROFROWS_2:
                        nVer = 2;
                        mess = IDM_SIZE_NUMBEROFROWS_2;
                        CaseChangeNumRows(hMenu, mess, &numRowSelection);
                        return 0;

                case IDM_SIZE_NUMBEROFROWS_3:
                        nVer = 3;
                        mess = IDM_SIZE_NUMBEROFROWS_3;
                        CaseChangeNumRows(hMenu, mess, &numRowSelection);
                        return 0;

                case IDM_SIZE_NUMBEROFROWS_4:
                        nVer = 4;
                        mess = IDM_SIZE_NUMBEROFROWS_4;
                        CaseChangeNumRows(hMenu, mess, &numRowSelection);
                        return 0;

                case IDM_SIZE_NUMBEROFROWS_5:
                        nVer = 5;
                        mess = IDM_SIZE_NUMBEROFROWS_5;
                        CaseChangeNumRows(hMenu, mess, &numRowSelection);
                        return 0;

                case IDM_SIZE_NUMBEROFROWS_6:
                        nVer = 6;
                        mess = IDM_SIZE_NUMBEROFROWS_6;
                        CaseChangeNumRows(hMenu, mess, &numRowSelection);
                        return 0;

                case IDM_SIZE_NUMBEROFROWS_7:
                        nVer = 7;
                        mess = IDM_SIZE_NUMBEROFROWS_7;
                        CaseChangeNumRows(hMenu, mess, &numRowSelection);
                        return 0;

                case IDM_SIZE_NUMBEROFROWS_8:
                        nVer = 8;
                        mess = IDM_SIZE_NUMBEROFROWS_8;
                        CaseChangeNumRows(hMenu, mess, &numRowSelection);
                        return 0;

                case IDM_SIZE_NUMBEROFCOLUMNS_2:
```

```
                    nHor = 2;
                    mess = IDM_SIZE_NUMBEROFCOLUMNS_2;
                    CaseChangeNumColumns(hMenu, mess,
&numColSelection);
                    return 0;

                case IDM_SIZE_NUMBEROFCOLUMNS_3:
                    nHor = 3;
                    mess = IDM_SIZE_NUMBEROFCOLUMNS_3;
                    CaseChangeNumColumns(hMenu, mess,
&numColSelection);
                    return 0;

                case IDM_SIZE_NUMBEROFCOLUMNS_4:
                    nHor = 4;
                    mess = IDM_SIZE_NUMBEROFCOLUMNS_4;
                    CaseChangeNumColumns(hMenu, mess,
&numColSelection);
                    return 0;

                case IDM_SIZE_NUMBEROFCOLUMNS_5:
                    nHor = 5;
                    mess = IDM_SIZE_NUMBEROFCOLUMNS_5;
                    CaseChangeNumColumns(hMenu, mess,
&numColSelection);
                    return 0;

                case IDM_SIZE_NUMBEROFCOLUMNS_6:
                    nHor = 6;
                    mess = IDM_SIZE_NUMBEROFCOLUMNS_6;
                    CaseChangeNumColumns(hMenu, mess,
&numColSelection);
                    return 0;

                case IDM_SIZE_NUMBEROFCOLUMNS_7:
                    nHor = 7;
                    mess = IDM_SIZE_NUMBEROFCOLUMNS_7;
                    CaseChangeNumColumns(hMenu, mess,
&numColSelection);
                    return 0;

                case IDM_SIZE_NUMBEROFCOLUMNS_8:
                    nHor = 8;
                    mess = IDM_SIZE_NUMBEROFCOLUMNS_8;
                    CaseChangeNumColumns(hMenu, mess,
&numColSelection);
                    return 0;

                case IDM_OPTIONS_VARMOVES_AUTO:
                    nVariate = nHor + nVer;
                    mess = IDM_OPTIONS_VARMOVES_AUTO;
                    CaseVariate(hMenu, mess, &numVarSelection);
                    return 0;
```

```
case IDM_OPTIONS_VARMOVES_1:
        nVariate = 1;
        mess = IDM_OPTIONS_VARMOVES_1;
        CaseVariate(hMenu, mess, &numVarSelection);
        return 0;

case IDM_OPTIONS_VARMOVES_2:
        nVariate = 2;
        mess = IDM_OPTIONS_VARMOVES_2;
        CaseVariate(hMenu, mess, &numVarSelection);
        return 0;

case IDM_OPTIONS_VARMOVES_3:
        nVariate = 3;
        mess = IDM_OPTIONS_VARMOVES_3;
        CaseVariate(hMenu, mess, &numVarSelection);
        return 0;

case IDM_OPTIONS_VARMOVES_4:
        nVariate = 4;
        mess = IDM_OPTIONS_VARMOVES_4;
        CaseVariate(hMenu, mess, &numVarSelection);
        return 0;

case IDM_OPTIONS_VARMOVES_5:
        nVariate = 5;
        mess = IDM_OPTIONS_VARMOVES_5;
        CaseVariate(hMenu, mess, &numVarSelection);
        return 0;

case IDM_OPTIONS_VARMOVES_6:
        nVariate = 6;
        mess = IDM_OPTIONS_VARMOVES_6;
        CaseVariate(hMenu, mess, &numVarSelection);
        return 0;

case IDM_OPTIONS_VARMOVES_7:
        nVariate = 7;
        mess = IDM_OPTIONS_VARMOVES_7;
        CaseVariate(hMenu, mess, &numVarSelection);
        return 0;

case IDM_OPTIONS_VARMOVES_8:
        nVariate = 8;
        mess = IDM_OPTIONS_VARMOVES_8;
        CaseVariate(hMenu, mess, &numVarSelection);
        return 0;

case IDM_OPTIONS_VARMOVES_9:
        nVariate = 9;
        mess = IDM_OPTIONS_VARMOVES_9;
        CaseVariate(hMenu, mess, &numVarSelection);
```

```
                        return 0;

                    case IDM_OPTIONS_VARMOVES_10:
                        nVariate = 10;
                        mess = IDM_OPTIONS_VARMOVES_10;
                        CaseVariate(hMenu, mess, &numVarSelection);
                        return 0;

            case IDM_ABOUT:
            //MessageBox(hWnd, "Boatta\nVersion 1\nCopyright", "About Botta", MB_OK);
            lpProcAbout = MakeProcInstance(About, hInst);
            DialogBox(hInst, "AboutBotta", hWnd, lpProcAbout);
            FreeProcInstance(lpProcAbout);
            return 0;

            case IDM_HELP:
            //MessageBox(hWnd, "OnHelp Starts", "IDM_HELP", MB_OK);
                    //OnHelp(hWnd);
                    OnHelp();
            //MessageBox(hWnd, "OnHelp Passed", "IDM_HELP", MB_OK);
            /*
            lpProcHelp = MakeProcInstance(Help, hInst);
            DialogBox(hInst, "HelpBotta", hWnd, lpProcHelp);
            FreeProcInstance(lpProcHelp);
            */
            return 0;

    default:
            return (DefWindowProc(hWnd, message, wParam, lParam));

    } // switch (wParam)
                    /*
    if (wParam == IDM_ABOUT)
    {
      lpProcAbout = MakeProcInstance(About, hInst);
      DialogBox(hInst, "AboutBox", hWnd, lpProcAbout);
      FreeProcInstance(lpProcAbout);
      break;
    }
    else
      return (DefWindowProc(hWnd, message, wParam, lParam));
                    */
            } // case WM_COMMAND

case WM_LBUTTONDOWN:
                    if (flagHelp)
                    {
                            //flagHelp = FALSE;
    hHelpDC = GetDC(hHelpWnd);
    wsprintf(str, "LeftButtonDown - BREAK %5d      ", clock()/CLOCKS_PER_SEC);
                            TextOut(hHelpDC, 10, 20, str, strlen(str));
                            ReleaseDC(hHelpWnd, hHelpDC);
```

```
                        hDC = InitDraw(hWnd);
                        ReleaseDC(hWnd, hDC);

                        break;
                }
        if (hHelpWnd)
        {
         hHelpDC = GetDC(hHelpWnd);
         wsprintf(str, "LeftButtonDown - BEGIN  %5d      ", clock()/CLOCKS_PER_SEC);
                        TextOut(hHelpDC, 10, 20, str, strlen(str));
                        ReleaseDC(hHelpWnd, hHelpDC);
                }


        if (!flagFinish)
        {
                        //bTrack = TRUE;
         hDC = InitDraw(hWnd);
        /*
        if (hHelpWnd)
        {
         hHelpDC = GetDC(hHelpWnd);
         sprintf(str, "LeftButtonDown - 1      %5d      ", clock()/CLOCKS_PER_SEC);
                        TextOut(hHelpDC, 10, 20, str, strlen(str));
                        ReleaseDC(hHelpWnd, hHelpDC);
                }
                */
         prev.x = LOWORD(lParam);
         prev.y = HIWORD(lParam);
         DPtoLP(hDC, &prev, 1);
         if (prev.x >= rectField.left && prev.x <= rectField.right
                &&
                prev.y >= rectField.bottom && prev.y <= rectField.top)
         {
                flagField = TRUE;
                // currMapIndex - is the MAP index calculated from Field coordinates
                                currMapIndex.x = GetMapRowIndex(prev.y);        // Gets
Current Row in the Field
                currMapIndex.y = GetMapColumnIndex(prev.x);     // Gets Current Column in the
Field
         }
         else
         {
                flagField = FALSE;
         }
         if (!(wParam & MK_SHIFT))  // If shift key is not pressed
         {
                org.x = LOWORD(lParam);
                org.y = HIWORD(lParam);
                DPtoLP(hDC, &org, 1);
         }
         SetCapture(hWnd);
         // currMapIndex - is the MAP index calculated from Field coordinates
```

```
                                //currMapIndex.x = GetMapRowIndex(prev.y);        // Gets Current
Row in the Field
        //currMapIndex.y = GetMapColumnIndex(prev.x);   // Gets Current Column in the Field
            //sprintf(str, "curr  %4d  %4d  ",currMapIndex.x, currMapIndex.y);
                                        //TextOut(hDC, 10, 550, str, strlen(str));
        if ((currMapIndex.x >= 0 && currMapIndex.y >= 0)
                &&
                (currMapIndex.x < nVer && currMapIndex.y < nHor)
                &&
                flagField == TRUE
                  )
        {
                bTrack = TRUE;

                                        // Store Bar Index for the current cursor position in the Map
                                        // prevBarIndex - is the initialll index of the BAR located at
the
                                        //                                        MAP position
currMapIndex
                                        prevBarIndex.x = (map + currMapIndex.x * nHor +
currMapIndex.y)->indexRow;
                                        prevBarIndex.y = (map + currMapIndex.x * nHor +
currMapIndex.y)->indexCol;

                // Capture all input even if the mouse goes outside of window
                //ReleaseDC(hWnd, hDC);
                //SetCapture(hWnd);
                //codeMove = 1;
                /*
                if ((currMapIndex.x >= 0 && currMapIndex.y >= 0)
                        &&
                        (currMapIndex.x < nVer && currMapIndex.y < nHor)
                          )
                        bTrack = TRUE;
                */
                if (!flagFirstMove)
                {
                        checkRowIndex = currMapIndex.x;
                        checkColIndex = currMapIndex.y;

                        clStart = clock();
                }
                //else PrintTime(hDC, &cont_frame_1);
                }
                        }
                        else
                        {
                                bTrack = FALSE;
                        }
        /*
        if (hHelpWnd)
        {
         hHelpDC = GetDC(hHelpWnd);
```

```
        sprintf(str, "LeftButtonDown - END    %5d      ", clock()/CLOCKS_PER_SEC);
                                TextOut(hHelpDC, 10, 20, str, strlen(str));
                                ReleaseDC(hHelpWnd, hHelpDC);
                        }
                        */
    break;

  case WM_MOUSEMOVE:
    {
      //RECT      rectClient;
      POINT                     next;
                        if (!bTrack)        break;

                                if (flagHelp) {flagHelp = FALSE; break;}

    if (hHelpWnd)
    {
     hHelpDC = GetDC(hHelpWnd);
     sprintf(str, "MouseMove - BEGIN      %5d      ", clock()/CLOCKS_PER_SEC);
                                TextOut(hHelpDC, 10, 20, str, strlen(str));
                                ReleaseDC(hHelpWnd, hHelpDC);
                        }

    //strcpy (str, "MOUSEMOVE");
      //MessageBox(hWnd, str, "MOUSE MOVE BOX", MB_OK);

    SetCursor(hArrowCursor);          // Returns cursor to ARROW after come back to the window
      //if (flagFirstMove) PrintTime(hDC, &cont_frame_1);

      if (bTrack)
      {
                                        //hDC = InitDraw(hWnd);
                                //sprintf(str, "MOVE1 CodeMove = %8d", codeMove);
                                        //TextOut(hDC, 600, 480, str, strlen(str));

        next.x = LOWORD(lParam);
        next.y = HIWORD(lParam);

        //sprintf(str, "PHYSICAL  next.x = %4d   .y = %4d  ",next.x, next.y);
                                        //TextOut(hDC, 10, 120, str, strlen(str));
                                        DPtoLP(hDC, &next, 1);
        //sprintf(str, "LOGICAL   next.x = %4d   .y = %4d  ",next.x, next.y);
                                        //TextOut(hDC, 10, 60, str, strlen(str));

        // Do not draw outside the window's client area
        //GetClientRect(hWnd, &rectClient);
        /*
        if (next.x < rectField.left)
          next.x = rectField.left;
        else
          if (next.x >= rectField.right)
            next.x = rectField.right;
```

```
        if (next.y >= rectField.top)
           next.y = rectField.top;
        else
           if (next.y < rectField.bottom)
              next.y = rectField.bottom;
        */
        move.x = next.x - prev.x;
        move.y = next.y - prev.y;
        //if ((move.x != 0) || (move.y != 0))
        //if ((abs(move.x) > 3) || (abs(move.y) > 3))
        if ((abs(move.x) > 10) || (abs(move.y) > 10))
        {
           if (move.x >= barSize.x)  move.x = barSize.x;
           if (move.x <= -barSize.x)  move.x = -barSize.x;
           if (move.y >= barSize.y)  move.y = barSize.y;
           if (move.y <= -barSize.y)  move.y = -barSize.y;

           if (codeMove == 0)
           {
                    if (abs(move.y) > abs(move.x)) codeMove = 2;
                    else codeMove = 1;
           }
           if (codeMove == 1)
           {
                    move.y = 0;
                    //sprintf(str, "MoveRow FOLLOWS");
                                                    //TextOut(hDC, 10, 240, str, strlen(str));
                              //sprintf(str, "MN-curr = %2d  %2d ; %3d  %3d ",
                    //                        currMapIndex.x, currMapIndex.y, move.x, move.y);
                                                    //TextOut(hDC, 10, 200, str, strlen(str));
                    MoveRow(hDC, &currMapIndex, &move);
                    //sprintf(str, "MoveRow PASSED ");
                                                    //TextOut(hDC, 10, 240, str, strlen(str));
           }
           else
           {
                    move.x = 0;
                    MoveColumn(hDC, &currMapIndex, &move);
           }
                    //OffsetRect(&((barSet+4)->rect), move.x, move.y);
                    //ShowBar(hDC, barSet+4);
        }
           prev.x = next.x;
           prev.y = next.y;
                    //sprintf(str, "MOVE2 CodeMove = %8d", codeMove);
                              //TextOut(hDC, 600, 440, str, strlen(str));
                         //ReleaseDC(hWnd, hDC);
     }
     //Sleep(clPause);
  }
  break;

case WM_LBUTTONUP:
```

```
                    if (flagHelp)
                    {
                              flagHelp = FALSE;
        hHelpDC = GetDC(hHelpWnd);
        sprintf(str, "LeftButtonUP - BREAK    %5d      ", clock()/CLOCKS_PER_SEC);
                              TextOut(hHelpDC, 10, 20, str, strlen(str));
                              ReleaseDC(hHelpWnd, hHelpDC);

                              break;
                    }

        if (hHelpWnd)
        {
         hHelpDC = GetDC(hHelpWnd);
         sprintf(str, "LeftButtonUP - BEGIN    %5d      ", clock()/CLOCKS_PER_SEC);
                              TextOut(hHelpDC, 10, 20, str, strlen(str));
                              ReleaseDC(hHelpWnd, hHelpDC);
                    }

        if (flagFinish) break;
        //if (!flagFinish)
        {
                              if (codeMove == 1)                // Horizontal Move
                              {
                                        FixRowPosition(hDC, &currMapIndex);
                              }
                              else
                              if (codeMove == 2)                // Vertical Move
                              {
                                        FixColumnPosition(hDC, &currMapIndex);
                              }
        CheckMove(&currMapIndex, &prevBarIndex);

                              if (numMoves > 0) PrintMoves(hDC, &cont_frame_2);
                    ReleaseDC(hWnd, hDC);
              bTrack = FALSE;          // No longer creating a selection

        if (!flagFirstMove)
        {
              //numMoves = 1;
                                        if ((/*(codeMove == 1)              // Horizontal
                                                  && */
                                                  (barSet + checkRowIndex * nHor +
checkColIndex)->nCurr.y
                                                  !=
                                                  (barSet + checkRowIndex * nHor +
checkColIndex)->nInit.y
                                                 )
                    ||
                                                 (/*(codeMove == 2)                // Verical
                                                        && */
```

```
                                        (barSet + checkRowIndex * nHor +
checkColIndex)->nCurr.x
                                        !=
                                        (barSet + checkRowIndex * nHor +
checkColIndex)->nInit.x
                                        )
                                    }
                                    {
                                        // Switch Menu To Game
                                        hMenu = hMenu2;
                                        SetMenu(hWnd, hMenu);
                        flagStart= 1;
                                        CaseGame(hMenu);

                                        flagFirstMove = TRUE;
                                        clStart = clock();
                                        hDC = InitDraw(hWnd);
                                        PrintOrder(hDC, &cont_frame_3);
                                ReleaseDC(hWnd, hDC);
            }
    }
                //ReleaseDC(hWnd, hDC);
    ReleaseCapture();       // Releases hold on mouse input
                            codeMove = 0;

                            //UpdateWindow(hWnd);

    PXY.x = LOWORD(lParam);     // Saves the current value
    PXY.y = HIWORD(lParam);
    //ScreenToLogic(hWnd, &PXY);

            // Check whether the game is over
                            if (CheckFinish() && flagFirstMove)
                            {
                                flagFinish = TRUE;
                                hDC = InitDraw(hWnd);
                                PrintCongratulations(hDC, &cont_frame_3);
                                ShowCongratulations(hDC, hLibraryFinish);
                                ReleaseDC(hWnd, hDC);
                            }


            }
            /*
            else // Game is Over
            {
            }
            */
            /*
    if (hHelpWnd)
    {
     hHelpDC = GetDC(hHelpWnd);
     sprintf(str, "LeftButtonUP - END     %5d     ", clock()/CLOCKS_PER_SEC);
```

```
                        TextOut(hHelpDC, 10, 20, str, strlen(str));
                        ReleaseDC(hHelpWnd, hHelpDC);
                }
                */
        break;

    case WM_RBUTTONDOWN:
        //if (flagFinish) break;

                hDC2 = InitDraw(hWnd);
                //ShowInitBarSet(hDC2);
        /*
                hNewBrush = GetStockObject(LTGRAY_BRUSH);
                hOldBrush = SelectObject(hDC2, hNewBrush);
                Rectangle(hDC2, rectField.left, rectField.top, rectField.right, rectField.bottom);

                SelectObject(hDC2, hOldBrush);
                DeleteObject(hNewBrush);
                */
                if (flagPicture)
                        ShowClue(hDC2, &rectField, TRUE, FALSE);        //
        ShowClue(HDC, RECT*. flagClue, frameClue);
                else
                        ShowInitBarSet(hDC2);
                ReleaseDC(hWnd, hDC2);
        break;

    case WM_RBUTTONUP:
        //if (flagFinish) break;
        //if (flagFinish) SendMessage(hWnd, IDM_GAME_NEWGAME, 0, 0L);

        if (flagFinish)
        {
                hMenu = hMenu1;
                NewGame(hMenu);
        }

                hDC2 = InitDraw(hWnd);
                ShowBarSet(hDC2);
                /*
                hNewBrush = CreateSolidBrush(RGB(255,0,0));
                hOldBrush = SelectObject(hDC2, hNewBrush);
                Rectangle(hDC2, rectField.left+100, rectField.top-100, rectField.right-100,
rectField.bottom+100);
                SelectObject(hDC2, hOldBrush);
                DeleteObject(hNewBrush);
        */
                ReleaseDC(hWnd, hDC2);
        break;

    case WM_ACTIVATE:

                //InitBar();
```

```
if (!GetSystemMetrics(SM_MOUSEPRESENT))
{
  if (!HIWORD(lParam))
  {
    if (wParam)
    {
      //SetCursor(LoadCursor(hInst, "bullseye"));
      //SetCursor(LoadCursor(hInst, IDC_ARROW));
      SetCursor(LoadCursor(hInst, IDC_WAIT));
      ptCursor.x = PXY.x;
      ptCursor.y = PXY.y;
      ClientToScreen(hWnd, &ptCursor);
      SetCursorPos(ptCursor.x, ptCursor.y);
    }
    ShowCursor(wParam);
    //ShowCursor(hHourCursor);
    //if (hWnd) InvalidateRect(hWnd, &rectPage, FALSE);
  }
}
//if (hHelpWnd) SetActiveWindow(hWnd);
break;

        case WM_CREATE:
                // Load Menus
                hInstance = GetWindowWord(hWnd, GWW_HINSTANCE);
hMenu1 = LoadMenu(hInstance, "BottaMenu");
hMenu2 = LoadMenu(hInstance, "BottaMenu2");
// Set Menu1
                SetMenu(hWnd, hMenu1);

                // Load Cursor Types
                hArrowCursor = LoadCursor(NULL, IDC_ARROW);
                hHourCursor  = LoadCursor(NULL, IDC_WAIT);

                // Check availability of *.dll picture files and correct Menu1
                CheckDLLs(hMenu1);

                // Load LibraryFinish
                if (hLibraryFinish >= 32)
                {
                        FreeLibrary(hLibraryFinish);
                }

                // Load new *.dll - bitmaps of the game
                if ((hLibraryFinish = LoadLibrary ("dll/finish.dll")) >= 32)
                {
        nCurrent = 1;
        hBitmap = LoadBitmap(hLibraryFinish, MAKEINTRESOURCE (nCurrent));
                }
 else
 {
                        DestroyWindow (hWnd);
 }
```

```
                SetSelections(&barNumberSelection, &numRowSelection, &numColSelection);

                SetField();

                /**/
                BuildControl(&cont_frame_1,
                                rectField.left,
                                rectPage.bottom + (framePanel -
rectPage.bottom)*2/3,
                                rectField.left + (rectField.right -
rectField.left)*13/30,
                                rectPage.bottom + (framePanel - rectPage.bottom)/4,
                                0, FALSE);
        /**/
                BuildControl(&cont_frame_2,
                                rectField.left + (rectField.right -
rectField.left)*26/30,
                                rectPage.bottom + (framePanel -
rectPage.bottom)*2/3,
                                rectField.right,
                                rectPage.bottom + (framePanel - rectPage.bottom)/4,
                                0, FALSE);
                BuildControl(&cont_frame_3,
                                rectField.left + (rectField.right -
rectField.left)*15/30,
                                rectPage.bottom + (framePanel -
rectPage.bottom)*2/3,
                                rectField.left + (rectField.right -
rectField.left)*24/30,
                                rectPage.bottom + (framePanel - rectPage.bottom)/4,
                                0, FALSE);

                return 0;

            case WM_PAINT:
                PaintField(hWnd);
                hDC = InitDraw(hWnd);           //      - included in
ShowBarSet()
                //ShowBar(hDC, barSet+4);
                ShowBarSet(hDC);
                //if (flagPicture) ShowClue(hDC, &rectClue, flagClue, TRUE);

                ShowControl(hDC, &cont_frame_1, TRUE);
                ShowControl(hDC, &cont_frame_2, TRUE);
                ShowControl(hDC, &cont_frame_3, TRUE);

                ReleaseDC(hWnd, hDC);           //      - included in
ShowBarSet()
                return 0;

    case WM_DESTROY:
```

```
                    if (hLibrary >= 32) FreeLibrary(hLibrary);
                    if (hLibraryFinish >= 32) FreeLibrary(hLibraryFinish);
                    FreeMemory();
                    if (hHelpWnd) DestroyWindow(hHelpWnd);
        PostQuitMessage(0);
        break;

      default:
        return (DefWindowProc(hWnd, message, wParam, lParam));
    }
    return (NULL);
}

/****************************************************************************

    FUNCTION: About(HWND, unsigned, WORD, LONG)

    PURPOSE:  Processes messages for "About" dialog box

    MESSAGES:

    WM_INITDIALOG - initialize dialog box
    WM_COMMAND    - Input received

****************************************************************************/

BOOL FAR PASCAL __export About(hDlg, message, wParam, lParam)
HWND hDlg;
unsigned message;
WORD wParam;
LONG lParam;
{
    switch (message)
    {
      case WM_INITDIALOG:
        return (TRUE);

      case WM_COMMAND:
        if (wParam == IDOK || wParam == IDCANCEL)
        {
          EndDialog(hDlg, TRUE);
          return (TRUE);
        }
        break;
    }
    return (FALSE);
}


/****************************************************************************
```

```
*****************************************************************************/

//BOOL PASCAL FAR OnHelp(HWND hWnd)
BOOL PASCAL FAR OnHelp()
{
        RECT rectHelpWindow;
        //DWORD dwStyle;

        if (!hHelpWnd)
        {
                rectHelpWindow.left             = GetSystemMetrics (SM_CXSCREEN)/2;
                rectHelpWindow.top              = 0;
                rectHelpWindow.right    = GetSystemMetrics (SM_CXSCREEN);
                rectHelpWindow.bottom   = GetSystemMetrics (SM_CYSCREEN);
        }
        else
        {
        GetWindowRect(hHelpWnd, &rectHelpWindow);

                // Destroy Help Window if exist - To call it again from Main Menu
                //ShowWindow(hHelpWnd, SW_SHOW);
                DestroyWindow(hHelpWnd);
                hHelpWnd = NULL;
        }

        if (!hHelpWnd)
        {
                hHelpWnd = CreateWindow("HelpWClass",
                                        "Botta Help",
                                        WS_OVERLAPPEDWINDOW,

                                        rectHelpWindow.left,
                                        rectHelpWindow.top,
                                        rectHelpWindow.right - rectHelpWindow.left,
                                        rectHelpWindow.bottom - rectHelpWindow.top,

                                        NULL, //hWnd,
                                        NULL,
                                        hInst,
                                        NULL);

                ShowWindow(hHelpWnd, SW_SHOW);
                //      UpdateWindow(hHelpWnd);
                //flagHelp = TRUE;      // TRUE - Help Window is Up
        }
        flagHelp = TRUE;        // TRUE - Help Window is Up
        return (TRUE);
}

//////////////////////////////////////////////////////////////////////////////

/*****************************************************************************
```

```
  FUNCTION: Help(HWND, unsigned, WORD, LONG)

  PURPOSE:  Processes Help Window

  MESSAGES:

  WM_INITDIALOG - initialize dialog box
  WM_COMMAND    - Input received

****************************************************************************/

long FAR PASCAL __export HelpWndProc(hWnd, message, wParam, lParam)
HWND hWnd;
UINT message;
WPARAM wParam;
LPARAM lParam;
{
        HDC                     helpDC;
        PAINTSTRUCT  psh;
        RECT                    helpRect;

  flagHelp = TRUE;
  switch (message)
  {
    case WM_COMMAND:
      //switch (wParam)
      {
       case IDM_HELPCLOSE:
                //SendMessage();
            //if (hwnd) ShowWindow(hwnd, SW_HIDE);
            if (hHelpWnd)
            {
                DestroyWindow(hHelpWnd);
                hHelpWnd = NULL;
            }
                                    flagHelp = FALSE;        // TRUE - Help Window is Up
                        break;
      }

    case WM_PAINT:
      helpDC = BeginPaint(hHelpWnd, &psh);
      GetClientRect(hHelpWnd, &helpRect);
      DrawText(helpDC, "Fedyunya is CHUCHELO !", -1, &helpRect,
                                DT_SINGLELINE | DT_CENTER | DT_VCENTER);
      EndPaint(hHelpWnd, &psh);
      break;

    case WM_DESTROY:
                        flagHelp = FALSE;        // TRUE - Help Window is Up
      //PostQuitMessage(0);
      break;
```

```
    default:
      return (DefWindowProc(hWnd, message, wParam, lParam));
      }
}

/*****************************************************************************

  FUNCTION:

  PURPOSE:

  COMMENTS:

*****************************************************************************/
//////////////////////////////////////////////////////////////////////////////

void SetSelections(WORD *barNumberSelection, WORD *numRowSelection, WORD *numColSelection)
{
        HMENU hMenu = GetMenu(hWnd);
        //*barNumberSelection     = IDM_PICTURE_COLORONLY;
        switch (nVer)
        {
                case 2:
                                *numRowSelection                =
IDM_SIZE_NUMBEROFROWS_2;
                                break;
                case 3:
                                *numRowSelection                =
IDM_SIZE_NUMBEROFROWS_3;
                                break;
                case 4:
                                *numRowSelection                =
IDM_SIZE_NUMBEROFROWS_4;
                                break;
                case 5:
                                *numRowSelection                =
IDM_SIZE_NUMBEROFROWS_5;
                                break;
                case 6:
                                *numRowSelection                =
IDM_SIZE_NUMBEROFROWS_6;
                                break;
                case 7:
                                *numRowSelection                =
IDM_SIZE_NUMBEROFROWS_7;
                                break;
                case 8:
                                *numRowSelection                =
IDM_SIZE_NUMBEROFROWS_8;
                                break;
        }
        CheckMenuItem(hMenu, *numRowSelection, MF_CHECKED);
```

```
        switch (nHor)
        {
                case 2:
                                *numColSelection                =
IDM_SIZE_NUMBEROFCOLUMNS_2;
                                break;
                case 3:
                                *numColSelection                =
IDM_SIZE_NUMBEROFCOLUMNS_3;
                                break;
                case 4:
                                *numColSelection                =
IDM_SIZE_NUMBEROFCOLUMNS_4;
                                break;
                case 5:
                                *numColSelection                =
IDM_SIZE_NUMBEROFCOLUMNS_5;
                                break;
                case 6:
                                *numColSelection                =
IDM_SIZE_NUMBEROFCOLUMNS_6;
                                break;
                case 7:
                                *numColSelection                =
IDM_SIZE_NUMBEROFCOLUMNS_7;
                                break;
                case 8:
                                *numColSelection                =
IDM_SIZE_NUMBEROFCOLUMNS_8;
                                break;
        }
        CheckMenuItem(hMenu, *numColSelection, MF_CHECKED);
}

//////////////////////////////////////////////////////////////////////////////

//void CaseGame(HMENU hMenu, short flagStart)
void CaseGame(HMENU hMenu)
{
        WORD idm_GAME_VARIATE                   = IDM_GAME_VARIATE;
        WORD idm_GAME_RANDOMIZE                         = IDM_GAME_RANDOMIZE;
        WORD idm_GAME_NEWGAME                   = IDM_GAME_NEWGAME;
        //WORD idm_GAME_SHOWSOLUTION            = IDM_GAME_SHOWSOLUTION;
        //WORD idm_GAME_GIVEUP                  = IDM_GAME_GIVEUP;

        HMENU hMenuPopup;
        hMenuPopup = GetSubMenu(hMenu, 1);
        //      EnableMenuItem(hMenu, hMenuPopup, MF_ENABLED);

        if (flagStart == 0)     // NEW GAME
        {
                EnableMenuItem(hMenu, idm_GAME_VARIATE, MF_ENABLED);
```

```
                EnableMenuItem(hMenu, idm_GAME_RANDOMIZE, MF_ENABLED);
                EnableMenuItem(hMenu, idm_GAME_NEWGAME, MF_GRAYED);
                //EnableMenuItem(hMenu, idm_GAME_SHOWSOLUTION, MF_GRAYED);
                //EnableMenuItem(hMenu, idm_GAME_GIVEUP, MF_GRAYED);
        }
        else if (flagStart == 1)  // VARIATE
        {
                EnableMenuItem(hMenu, idm_GAME_VARIATE, MF_GRAYED);
                EnableMenuItem(hMenu, idm_GAME_RANDOMIZE, MF_GRAYED);
                EnableMenuItem(hMenu, idm_GAME_NEWGAME, MF_ENABLED);
                //EnableMenuItem(hMenu, idm_GAME_SHOWSOLUTION, MF_ENABLED);
                //EnableMenuItem(hMenu, idm_GAME_GIVEUP, MF_ENABLED);
                //AppendMenu(hMenu, MF_STRING | MF_GRAYED, 1, "&Options");
                //SendMessage();
                //TrackPopupMenu();
                //EnableMenuItem(hMenu, hMenuPopup, MF_GRAYED);
                //DestroyMenu(hMenuPopup);
                //hMenuPopup = CreatePopupMenu();
        }
        else if (flagStart == 2)  // RANDOMIZE
        {
                EnableMenuItem(hMenu, idm_GAME_VARIATE, MF_GRAYED);
                EnableMenuItem(hMenu, idm_GAME_RANDOMIZE, MF_GRAYED);
                EnableMenuItem(hMenu, idm_GAME_NEWGAME, MF_ENABLED);
                //EnableMenuItem(hMenu, idm_GAME_SHOWSOLUTION, MF_GRAYED);
                //EnableMenuItem(hMenu, idm_GAME_GIVEUP, MF_ENABLED);
        }
        else if (flagStart == 3)  // SHOW SOLUTION
        {
                EnableMenuItem(hMenu, idm_GAME_VARIATE, MF_ENABLED);
                EnableMenuItem(hMenu, idm_GAME_RANDOMIZE, MF_ENABLED);
                EnableMenuItem(hMenu, idm_GAME_NEWGAME, MF_ENABLED);
                //EnableMenuItem(hMenu, idm_GAME_SHOWSOLUTION, MF_GRAYED);
                //EnableMenuItem(hMenu, idm_GAME_GIVEUP, MF_ENABLED);
        }

        if (flagStart > 0 && flagStart < 3)
        {
          hDC = InitDraw(hWnd);
                ShowControlField(hDC, &cont_frame_1);
                ReleaseDC(hWnd, hDC);
        }

        flagFinish = FALSE;      // Game is not over

}

//////////////////////////////////////////////////////////////////////////////

void CaseVariate(HMENU hMenu, WORD mess, WORD *numVarSelection)
{
        CheckMenuItem(hMenu, *numVarSelection, MF_UNCHECKED);
        *numVarSelection = mess;
```

```
        CheckMenuItem(hMenu, *numVarSelection, MF_CHECKED);
        //SetField();
        //hDC = InitDraw(hWnd);
        //ShowBarSet(hDC);
        //ReleaseDC(hWnd, hDC);
}

//////////////////////////////////////////////////////////////////////////////

void CaseBar(HMENU hMenu, WORD mess, WORD *barNumberSelection)
{
        //WORD idm_PICTURE_SHOWCLUE = IDM_PICTURE_SHOWCLUE;

        if (flagPicture)
        {
                flagPicture     = FALSE;
                //InvalidateRect (hWnd, NULL, TRUE);
        }
        //flagClue = FALSE;
        hBitmap = NULL;
        hDC = InitDraw(hWnd);
        ShowBarSet(hDC);
        //ShowClue(hDC, &rectClue, flagClue, TRUE);
        ReleaseDC(hWnd, hDC);
        //InvalidateRect (hWnd, NULL, TRUE);
        CheckMenuItem(hMenu, *barNumberSelection, MF_UNCHECKED);
        *barNumberSelection = mess;
        CheckMenuItem(hMenu, *barNumberSelection, MF_CHECKED);
        //EnableMenuItem(hMenu, idm_PICTURE_SHOWCLUE, MF_GRAYED);
}

//////////////////////////////////////////////////////////////////////////////

void CasePicture(HMENU hMenu, WORD mess, WORD *barNumberSelection, HANDLE *hLibrary,
char *strdll)
{
        //char strpp[255];
        int nCurrent;

                        // Free previous DLL library
                        if (*hLibrary >= 32)
                        {
                                //sprintf(strpp,"FreeLibrary - YES, hLibrary = %5d", *hLibrary);
                                //MessageBox (hWnd, strpp,
                                //                        "CasePicture1",
MB_ICONEXCLAMATION | MB_OK) ;
                                FreeLibrary(*hLibrary);
                                //sprintf(strpp,"FreeLibrary - YES, hLibrary = %5d", *hLibrary);
                                //MessageBox (hWnd, strpp,
                                //                        "CasePicture2",
MB_ICONEXCLAMATION | MB_OK) ;
                        }
```

```
                    // Load new *.dll - bitmaps of the game
                    if ((*hLibrary = LoadLibrary (strdll)) >= 32)
                    {
            nCurrent = 1;
            hBitmap = LoadBitmap(*hLibrary, MAKEINTRESOURCE (nCurrent));
                    }
        else
        {
                            DestroyWindow (hWnd);
        }

        flagPicture         = TRUE;
        //hBitmap = hBit;
        hDC = InitDraw(hWnd);
        ShowBarSet(hDC);
        //ShowClue(hDC, &rectClue, flagClue, TRUE);
        ReleaseDC(hWnd, hDC);
        //InvalidateRect (hWnd, NULL, TRUE);
        CheckMenuItem(hMenu, *barNumberSelection, MF_UNCHECKED);
        *barNumberSelection = mess;
        CheckMenuItem(hMenu, *barNumberSelection, MF_CHECKED);
        //EnableMenuItem(hMenu, idm_PICTURE_SHOWCLUE, MF_ENABLED);
}

////////////////////////////////////////////////////////////////////////////////

void CaseChangeNumRows(HMENU hMenu, WORD mess, WORD *numRowSelection)
{
        CheckMenuItem(hMenu, *numRowSelection, MF_UNCHECKED);
        *numRowSelection = mess;
        CheckMenuItem(hMenu, *numRowSelection, MF_CHECKED);
        SetField();
        hDC = InitDraw(hWnd);
        ShowBarSet(hDC);
        ReleaseDC(hWnd, hDC);
        if (flagVariateAuto) nVariate = nHor + nVer;                    // Prepare nVariate for
AUTO
}

////////////////////////////////////////////////////////////////////////////////

void CaseChangeNumColumns(HMENU hMenu, WORD mess, WORD *numColSelection)
{
        CheckMenuItem(hMenu, *numColSelection, MF_UNCHECKED);
        *numColSelection = mess;
        CheckMenuItem(hMenu, *numColSelection, MF_CHECKED);
        SetField();
        hDC = InitDraw(hWnd);
        ShowBarSet(hDC);
        ReleaseDC(hWnd, hDC);
        if (flagVariateAuto) nVariate = nHor + nVer;                    // Prepare nVariate for
AUTO
}
```

```
//////////////////////////////////////////////////////////////////////////////

void CheckDLLs(HMENU hMenu1)
{
        WORD idm;
        BOOL file_exist = FALSE;

                /*
                // Load Butmaps
                hBitmap1 = LoadBitmap(hInst, "face");
                hBitmap2 = LoadBitmap(hInst, "flowers");
                hBitmap9 = LoadBitmap(hInst, "flowers6");
                hBitmap3 = LoadBitmap(hInst, "circles");
                hBitmap4 = LoadBitmap(hInst, "dollar");
                hBitmap5 = LoadBitmap(hInst, "message");
                hBitmap6 = LoadBitmap(hInst, "dog");
                hBitmap7 = LoadBitmap(hInst, "cat");
                hBitmap8 = LoadBitmap(hInst, "arc");
                hBitmapCongratulations = LoadBitmap(hInst, "congratiy");
                */

                if (_access("dll/face.dll",0) == -1)
                {
                        idm = IDM_PICTURE_PICTURE_FACE;
                        DeleteMenu(hMenu1, idm, MF_BYCOMMAND);
                }
                else file_exist = TRUE;

                if (_access("dll/flowers.dll", 0) == -1)
                {
                        idm = IDM_PICTURE_PICTURE_FLOWERS;
                        DeleteMenu(hMenu1, idm, MF_BYCOMMAND);
                }
                else file_exist = TRUE;

                if (_access("dll/circles.dll", 0) == -1)
                {
                        idm = IDM_PICTURE_PICTURE_CIRCLES;
                        DeleteMenu(hMenu1, idm, MF_BYCOMMAND);
                }
                else file_exist = TRUE;

                if (_access("dll/dollar.dll", 0) == -1)
                {
                        idm = IDM_PICTURE_PICTURE_DOLLAR;
                        DeleteMenu(hMenu1, idm, MF_BYCOMMAND);
                }
                else file_exist = TRUE;

                if (_access("dll/message.dll", 0) == -1)
                {
                        idm = IDM_PICTURE_PICTURE_MESSAGE;
```

```
                        DeleteMenu(hMenu1, idm, MF_BYCOMMAND);
                    }
                    else file_exist = TRUE;

                    if (_access("dll/dog.dll", 0) == -1)
                    {
                        idm = IDM_PICTURE_PICTURE_DOG;
                        DeleteMenu(hMenu1, idm, MF_BYCOMMAND);
                    }
                    else file_exist = TRUE;

                    if (_access("dll/cat.dll", 0) == -1)
                    {
                        idm = IDM_PICTURE_PICTURE_CAT ;
                        DeleteMenu(hMenu1, idm, MF_BYCOMMAND);
                    }
                    else file_exist = TRUE;

                    if (_access("dll/arches.dll", 0) == -1)
                    {
                        idm = IDM_PICTURE_PICTURE_ARCHES;
                        DeleteMenu(hMenu1, idm, MF_BYCOMMAND);
                    }
                    else file_exist = TRUE;

                    /*
                    if (!file_exist)
                    {
    hMenu1 = LoadMenu(hInstance, "BottaMenu3");
    hMenu = hMenu1;
                        SetMenu(hWnd, hMenu);
    }
    */

                    if (_access("dll/finish.dll", 0) == -1)
                    {
                      MessageBox (GetFocus (),
    "File <<dll/finish.dll>> is missing"
    " that is vitale for BOTTA."
    "\nPlease restore the file and start BOTTA again."
    "\nBotta is now terminated",
    "Botta Error",
    MB_ICONSTOP | MB_OK);

    // Quit BOTTA
                        //DestroyWindow (hWnd) ;
                        FreeMemory();
            PostQuitMessage(0);
                    }
}

void NewGame(HMENU hMenu)
```

```
{
                    SetField();
                    hDC = InitDraw(hWnd);
                    ShowBarSet(hDC);
                    ShowControlField(hDC, &cont_frame_1);
                    ShowControlField(hDC, &cont_frame_2);
                    PrintNewGame(hDC, &cont_frame_3);
                    ReleaseDC(hWnd, hDC);
                    // Set Menu1 - Options & Size Enabled
                    //hMenu = hMenu1;
                    SetMenu(hWnd, hMenu);
          flagStart= 0;
                    CaseGame(hMenu);
                    flagFirstMove = FALSE;
                    numMoves = 0;
}
```

APPENDIX B

```
/*****************************************************************************
        Copyright by Sergey K. Aityan and Alexander V. Lysyansky

  BOTTA       Version 1.2
  PROGRAM: field.c

        August 11, 1995

  PURPOSE:    2-Dimensional Cyclic Game
                Game Field arrangement

  FUNCTIONS:

        void PaintField(HWND hWnd);
        void ShowFieldFrame(HDC hDC);
        void BuildFrame(RECT rectField, RECT *rectFrame1, RECT *rectFrame2,
                        POINT *polExt, POINT *polInt, int width);
        void BuildFrameShade(RECT *rect, POINT *pol, int wsh);
        void ShowFrameShade(HDC hDC, COLOR FrameColor, POINT *polInt, short upcode);
        void SetField();
        BOOL FreeMemory();
        BOOL SetMemory();
        BOOL ResetMemory();


        HDC InitDraw(HWND hWnd);

        void Sleep(clock_t wait);

*****************************************************************************/

#include "windows.h"
#include "string.h"
#include <math.h>
#include <malloc.h>
#include <time.h>
#include <stdio.h>
#include <stdlib.h>

#include "resource.h"

#include "field.h"
#include "botta.h"

HWND hWnd;
HANDLE hInst;

HDC hDC;
short cxClient, cyClient;

char str[255];          // general-purpose string buffer
```

```
HCURSOR hSaveCursor;            // handle to current cursor
HCURSOR hArrowCursor, hHourCursor;

BOOL bTrack;            // TRUE if left button clicked
POINT org;
POINT prev;
POINT currIndex;
POINT move;
POINT PXY;
//int OrgX = 0, OrgY = 0;          // original cursor position
//int PrevX = 0, PrevY = 0;        // current cursor position
//int X = 0, Y = 0;              // last cursor position

short nHor;
short nVer;

RECT rectPage;
RECT rectField;
RECT rectClue;
POINT fieldSize;
POINT barSize;
POINT frameWall;
//int framePanel;

int nRedPage = 0;
int nGreenPage = 120;
int nBluePage = 0;
int nRedField = 255;
int nGreenField = 255;
int nBlueField = 255;

//////////////////////////////////////////////////////////////////////////

BAR *barSet;
int *fieldGridHor, *fieldGridVer;

//////////////////////////////////////////////////////////////////////////


//int GetMapColumnIndex(int);
//int GetMapRowIndex(int);
//void MoveRow(HDC, POINT*, POINT*);
//void MoveColumn(HDC, POINT*, POINT*);
//void FixRowPosition(HDC, POINT);
//void FixColumnPosition(HDC, POINT);
MAP *map;

//////////////////////////////////////////////////////////////////////////

HBITMAP hBitmap;
BITMAP Bitmap;
//////////////////////////////////////////////////////////////////////////////
//
```

```
// InitDraw: Gets a device context and sets window scale
//
HDC InitDraw(HWND hWnd)
{
        HDC hDC;
        RECT clRect;

/*   if (NewRandom)                                          // if randomize just occurred
     NewRandom = FALSE;                                      // make sure next sorts use new
data
  else                                                  // if first sort has already been done
     InitPrevRandom(hWnd);                                   // restore last randomized Balls

  GetClientRect(hWnd, &clRect);
  cxClient = clRect.right - clRect.left;
  cyClient = clRect.bottom - clRect.top;
*/
  hDC = GetDC(hWnd);

  SetMapMode(hDC, MM_ANISOTROPIC);
  SetWindowExt(hDC, rectPage.right, rectPage.top);
  SetViewportExt(hDC, cxClient, -cyClient);                                  // Set up Window
  SetViewportOrg (hDC, 0, cyClient);
/*
  clStart = clock();
  clFinish = 0;
*/
        return (hDC);
}

//////////////////////////////////////////////////////////////////////////////
void PaintField(HWND hWnd)
{
        PAINTSTRUCT    ps;
        //HBRUSH                    hNewBrush, hOldBrush;
        static char sss[255];
        static int y = 300;

        InvalidateRect(hWnd, NULL, FALSE);        // Invalidate entire window

  hDC = BeginPaint (hWnd, &ps);

  // Define Client Area
  cxClient = ps.rcPaint.right - ps.rcPaint.left;
  cyClient = ps.rcPaint.bottom - ps.rcPaint.top;

        // Set Window Mode and Coordinate System
  SetMapMode(hDC, MM_ANISOTROPIC);
  SetWindowExt(hDC, rectPage.right, rectPage.top);
  SetViewportExt(hDC, cxClient, -cyClient);                  // Set up Window
  SetViewportOrg (hDC, 0, cyClient);                                 // Set up Window origin
(left/bottom)
```

```
    prev.x = org.x;
    prev.y = org.y;
    /*
            // Paint the Page
            hNewBrush = CreateSolidBrush(RGB(nRedPage, nGreenPage, nBluePage));
            hOldBrush = SelectObject(hDC, hNewBrush);

            Rectangle(hDC, rectPage.left, rectPage.top, rectPage.right, rectPage.bottom);


            SelectObject(hDC, hOldBrush);
            DeleteObject(hNewBrush);
    */
            // Paint the Field Frame
            ShowFieldFrame(hDC);
    /*
            // Paint the Field
            hNewBrush = CreateSolidBrush(RGB(nRedField, nGreenField, nBlueField));
            hOldBrush = SelectObject(hDC, hNewBrush);

            // Field
            //Rectangle(hDC, rectField.left-1, rectField.top, rectField.right+1, rectField.bottom-1);

            Rectangle(hDC, rectField.left, rectField.top, rectField.right, rectField.bottom);


            SelectObject(hDC, hOldBrush);
            DeleteObject(hNewBrush);
    */
            EndPaint (hWnd, &ps);
}

////////////////////////////////////////////////////////////////////////////////

void ShowFieldFrame(HDC hDC)
{
            HBRUSH hNewBrush, hOldBrush;//,hNewBallBrush, hOldBallBrush ;
            RECT rectFrame1, rectFrame2;
            POINT polExt[16], polInt[16];
            int fieldWall;      // = 36;
            short upcode = 1;
            COLOR FrameColor = {200, 200, 200};

            fieldWall = (rectField.right - rectField.left)/20;
            // Calculate Frame size
            BuildFrame(rectField, &rectFrame1, &rectFrame2, polExt, polInt, fieldWall);

            // External Frame
            hNewBrush = GetStockObject(LTGRAY_BRUSH);
            //hNewBrush = CreateSolidBrush(RGB(FrameColor.nRed, FrameColor.nGreen,
FrameColor.nBlue));
            hOldBrush = SelectObject(hDC, hNewBrush);
```

```
        // External Frame
        Rectangle(hDC, rectFrame1.left, rectFrame1.top, rectFrame1.right, rectFrame1.bottom);


        SelectObject(hDC, hOldBrush);
        DeleteObject(hNewBrush);

        // Internal Frame
        hNewBrush = GetStockObject(LTGRAY_BRUSH);
        //hNewBrush = CreateSolidBrush(RGB(FrameColor.nRed-50, FrameColor.nGreen-50,
FrameColor.nBlue-50));
        hOldBrush = SelectObject(hDC, hNewBrush);

        // Internal Frame
        Rectangle(hDC, rectFrame2.left, rectFrame2.top, rectFrame2.right, rectFrame2.bottom);


        SelectObject(hDC, hOldBrush);
        DeleteObject(hNewBrush);

        // Paint the External Field Frame Shades
        //ShowFrameShade(hDC, FrameColor, polExt, upcode);

        // Paint the Internal Field Frame Shades
        ShowFrameShade(hDC, FrameColor, polInt, -upcode);
}

//////////////////////////////////////////////////////////////////////////////

void BuildFrame(RECT rectField, RECT *rectFrame1, RECT *rectFrame2,
                                POINT *polExt, POINT *polInt, int width)
{
        int w1, w2, wsh;

        w1 = width;
        w2 = width*2/6;
        wsh = width/6;

  // Build External Rect - rectFrame1
        SetRect(rectFrame1, rectField.left  - w1, rectField.top + w1,
                                        rectField.right + w1, rectField.bottom - w1);

  // Build Internal Rect - rectFrame2
        SetRect(rectFrame2, rectField.left  - w2, rectField.top + w2,
                                        rectField.right + w2, rectField.bottom - w2);

        // Build External Shade - polExt[16];
        //BuildFrameShade(rectFrame1, polExt, wsh);
        // Build Medial Shade - polMid[16];
//      BuildShade(rectFrame2, polMid, wsh);
        // Build Internal Shade - polInt[16];
        BuildFrameShade(rectFrame2,  polInt, wsh);
}
```

```
//////////////////////////////////////////////////////////////////////////////

void BuildFrameShade(RECT *rect, POINT *pol, int wsh)
{
        // LEFT
        pol[0].x  = rect->left   - wsh;
        pol[0].y  = rect->top    + wsh;
        pol[1].x  = rect->left;
        pol[1].y  = rect->top;
        pol[2].x  = rect->left;
        pol[2].y  = rect->bottom;
        pol[3].x  = rect->left   - wsh;
        pol[3].y  = rect->bottom - wsh;

        //TOP
        pol[4].x  = rect->left  - wsh;
        pol[4].y  = rect->top        + wsh;
        pol[5].x  = rect->left;
        pol[5].y  = rect->top;
        pol[6].x  = rect->right;
        pol[6].y  = rect->top;
        pol[7].x  = rect->right + wsh;
        pol[7].y  = rect->top        + wsh;

        //RIGHT
        pol[8].x  = rect->right      + wsh;
        pol[8].y  = rect->top        + wsh;
        pol[9].x  = rect->right;
        pol[9].y  = rect->top;
        pol[10].x = rect->right;
        pol[10].y = rect->bottom;
        pol[11].x = rect->right  + wsh;
        pol[11].y = rect->bottom - wsh;

        //BOTTOM
        pol[12].x = rect->left   - wsh;
        pol[12].y = rect->bottom - wsh;
        pol[13].x = rect->left;
        pol[13].y = rect->bottom;
        pol[14].x = rect->right;
        pol[14].y = rect->bottom;
        pol[15].x = rect->right  + wsh;
        pol[15].y = rect->bottom - wsh;
}

//////////////////////////////////////////////////////////////////////////////

void ShowFrameShade(HDC hDC, COLOR FrameColor, POINT *pol, short upcode)
{
        int i, k;
        int cR, cG, cB;
        int dc[4] = {100, 100, -100, -100};
```

```
        POINT  polyg[4];
        HBRUSH hNewBrush, hOldBrush;

  for (i=0; i<4; i++)
  {
        cR = FrameColor.nRed    + upcode*dc[i];
        cG = FrameColor.nGreen + upcode*dc[i];
        cB = FrameColor.nBlue   + upcode*dc[i];

                if (cR    > 255) cR = 255;
                if (cG    > 255) cG = 255;
                if (cB    > 255) cB = 255;
                if (cR    < 0) cR = 0;
                if (cG    < 0) cG = 0;
                if (cB    < 0) cB = 0;

                hNewBrush = CreateSolidBrush(RGB(cR, cG, cB));
                hOldBrush = SelectObject(hDC, hNewBrush);

                for (k=0; k<4; k++) polyg[k] = pol[i*4+k];
                Polygon(hDC, polyg, sizeof(polyg)/sizeof(POINT));

                SelectObject(hDC, hOldBrush);
                DeleteObject(hNewBrush);
        }
}

//////////////////////////////////////////////////////////////////////////////

void Sleep( clock_t wait )
{
  clock_t goal;

  goal = wait + clock();
  while( goal >= clock() );
}

//////////////////////////////////////////////////////////////////////////////

void SetField()
{
        POINT pageSize;
        int correction;

        pageSize.x = rectPage.right          - rectPage.left;
        pageSize.y = rectPage.top - rectPage.bottom;

        frameWall.x = pageSize.x/30;
        frameWall.y = pageSize.y/25;
        framePanel        = pageSize.y/10;

  /*
        rectField.left        = rectPage.left;
```

```
        rectField.bottom = rectPage.bottom;
        rectField.right = rectPage.right;
        rectField.top = rectPage.top;
  */

  // Initial Estimate of the Field
        rectField.left          = rectPage.left          + frameWall.x;
        rectField.bottom  = rectPage.bottom        + frameWall.y + framePanel;
        rectField.right         = rectPage.right  - frameWall.x;
        rectField.top           = rectPage.top           - frameWall.y;

        // Calculation of the estimated Field Size
        fieldSize.x = rectField.right - rectField.left;
        fieldSize.y = rectField.top  - rectField.bottom;

        // Calculation of the Bar Size
        barSize.x = fieldSize.x/nHor;
        barSize.y = fieldSize.y/nVer;

        // Calculation of the real Field Size
        fieldSize.x = barSize.x * nHor;
        fieldSize.y = barSize.y * nVer;

        // Correction of the Field
        correction = (rectField.right - rectField.left - fieldSize.x)/2;
        rectField.left          += correction;
        rectField.right         = rectField.left + fieldSize.x - 1;
        rectField.bottom  = rectField.top  - fieldSize.y + 1;
//      rectField.right         = rectField.left + fieldSize.x;      // - 1;
//      rectField.bottom  = rectField.top  - fieldSize.y;      // + 1;

        /*
        rectClue.left      = (rectPage.left + rectPage.right)/40;
        rectClue.top       = rectField.top;
        rectClue.right     = rectField.left*2/3;
        rectClue.bottom    = rectField.top - (rectField.left + rectClue.right)*5/16;
  */

  //FreeMemory();
        //SetMemory();
        ResetMemory();
        InitBarSet();                                          //      - InitMap is called from
InitBarSet()
        //InitMap();
}

//////////////////////////////////////////////////////////////////////////////

BOOL FreeMemory()
{
        BOOL result = TRUE;
        if (barSet != NULL)
        {
```

```
                free (barSet);
                barSet = NULL;
        }
        /*
        if (fieldGridHor != NULL)
        {
                free (fieldGridHor);
                fieldGridHor = NULL;
  }
        if (fieldGridVer != NULL)
        {
                free (fieldGridVer);
    fieldGridVer = NULL;
  }
  */
        if (map != NULL)
        {
                free (map);
                map = NULL;
        }

        return result;
}

//////////////////////////////////////////////////////////////////////////////

BOOL SetMemory()
{
        BOOL result = TRUE;

        /*
        if (fieldGridHor == NULL) fieldGridHor = (int *) calloc(nHor, sizeof(int));
        else
        {
                MessageBox(hWnd, "Field Grid Aready Exists - Can't Be Created Again",
                                        "SetMemory", MB_OK);
          result = FALSE;
        }
        if (fieldGridVer == NULL) fieldGridVer = (int *) calloc(nVer, sizeof(int));
        else
        {
                MessageBox(hWnd, "Field Grid Aready Exists - Can't Be Created Again",
                                        "SetMemory", MB_OK);
          result = FALSE;
        }
  */

        if (barSet == NULL) barSet = (BAR *) calloc(nVer*nHor, sizeof(BAR));
        else
        {
                MessageBox(hWnd, "Array \"barSet\" Aready Exists - Can't Be Created Again",
                                        "SetMemory", MB_OK);
```

```
        result = FALSE;
    }

    if (map == NULL) map = (MAP *) calloc(nHor*nVer, sizeof(MAP));
    else
    {
            MessageBox(hWnd, "Array \"map\" Aready Exists - Can't Be Created Again",
                                        "SetMemory", MB_OK);
        result = FALSE;
    }

    return result;
}

//////////////////////////////////////////////////////////////////////////////

BOOL ResetMemory()
{
    BOOL result = FALSE;

    FreeMemory();
    SetMemory();

    return result;
}

//////////////////////////////////////////////////////////////////////////////
```

APPENDIX C

```
/*****************************************************************************
        Copyright by Sergey K. Aityan and Alexander V. Lysyansky

  BOTTA       Version 1.2
  PROGRAM: bar.c

        August 11, 1995

  PURPOSE:    2-Dimensional Cyclic Game
                        Bar/Picture Drawing Procedures

  FUNCTIONS:

        void ShowBarInitNumber(HDC TempDC, BAR *bar);
        void ShowBar(HDC hDC, BAR *bar);
        void ShowNormalBar(HDC TempDC, BAR *bar, int *dc, int width);
        void ShowNormalBarColor(HDC TempDC, BAR *bar, int *dc, int width);
        void ShowNormalBarPicture(HDC TempDC, BAR *bar, HBITMAP hBitmap);

        void ShowLeftShiftBar(HDC TempDC, BAR *bar, int *dc, int width);
        void ShowRightShiftBar(HDC TempDC, BAR *bar, int *dc, int width);
        void ShowRightShiftBarColor(HDC TempDC, BAR *bar, int *dc, int width);
        void ShowRightShiftBarPicture(HDC TempDC, BAR *bar, HBITMAP hBitmap);
        void ShowUpShiftBar(HDC TempDC, BAR *bar, int *dc, int width);
        void ShowUpShiftBarColor(HDC TempDC, BAR *bar, int *dc, int width);
        void ShowUpShiftBarPicture(HDC TempDC, BAR *bar, HBITMAP hBitmap);
        void ShowDownShiftBar(HDC TempDC, BAR *bar, int *dc, int width);
        void SetBarFilletColor(COLOR *clr, BAR *bar, int dc);

        void ShowBarSet(HDC hDC);
        void ShowInitBarSet(HDC hDC);
        void ShowClue(HDC hDC, RECT *rectClue, BOOL flagClue, BOOL frameClue);

        void InitBarSet();
        void SetBarSetMap();

*****************************************************************************/

#include "windows.h"
#include "string.h"
#include <math.h>
#include <malloc.h>
#include <stdio.h>

//#include "botta.h"
#include "bar.h"
//#include "botta.h"
#include "map.h"


//BAR rect1, rect2;
```

```
short nHor;
short nVer;

BAR *barSet;
//int *fieldGridHor, *fieldGridVer;

BOOL flagBarNumber;
BOOL flagPicture;

//RECT rectPage = {0, 1000, 1000, 0};
//RECT rectField = {300, 750, 700, 250};
BAR *bar;

COLOR Red          = {225, 0, 0};
COLOR Green   = {0, 225, 0};
COLOR Blue         = {0, 0, 255};
COLOR Yellow  = {225, 225, 0};
COLOR Cyan         = {0, 225, 225};

//HDC InitDraw(HWND hWnd);                    // Function from "botta.h"
RECT rectField;
POINT fieldSize, barSize;
POINT ptCursor;                  // x and y coordinates of cursor
HWND hWnd;
                                 // Function from "map.h"
void InitMap();
MAP *map;

HDC InitDraw(HWND);
char str[255];


////////////////////////////////////////////////////////////////////////


BITMAP Bitmap;
HBITMAP hBitmap;
HDC hMemoryDC;
int fStretchMode;                // type of stretch mode to use

////////////////////////////////////////////////////////////////////////

void ShowBar(HDC TempDC, BAR *bar)
{
        int width;
//      POINT barSize;
        int dc[4];
//   char szPosition[30];

        dc[0] = 100;            // left
        dc[1] = 200;            // top
        dc[2] = -100;           // right
```

```
        dc[3] = -200;           // bottom

        //      barSize.x = bar->rect.right - bar->rect.left;
        //      barSize.y = bar->rect.top - bar->rect.bottom;

        width = (barSize.x + barSize.y)/2/BAR_FILLET;
  //sprintf(szPosition, "      %3d    %3d ",bar->rect.left,bar->rect.top);
  //TextOut(TempDC, 10, 900, szPosition, strlen(szPosition));

        if (bar->rect.left < rectField.left)
        {
                bar->rect.left  += fieldSize.x;
                bar->rect.right += fieldSize.x;
                                                        //sprintf(szPosition, "LEFT->
%3d",bar->rect.left);
                                                        //TextOut(TempDC, 10, 600,
szPosition, strlen(szPosition));
                ShowRightShiftBar(TempDC, bar, dc, width);
        }
        //else if (bar->rect.right >= rectField.right)
        else if (bar->rect.right > rectField.right)
                {
                                                        //sprintf(szPosition, "RIGHT
%3d",bar->rect.left);
                                                                //TextOut(TempDC, 10,
600, szPosition, strlen(szPosition));
                        if (bar->rect.left > rectField.right)
                        //if (bar->rect.left >= rectField.right)
                        {
                                bar->rect.left      -= fieldSize.x;
                                bar->rect.right -= fieldSize.x;
                                                        //sprintf(szPosition, "RIGHT->
%3d",bar->rect.left);
                                                        //TextOut(TempDC, 10, 600,
szPosition, strlen(szPosition));
                                ShowNormalBar(TempDC, bar, dc, width);
                        }
                        else ShowRightShiftBar(TempDC, bar, dc, width);
                }
        else
        if (bar->rect.bottom < rectField.bottom)
        {
                bar->rect.bottom += fieldSize.y;
                bar->rect.top            += fieldSize.y;
                                                        //sprintf(szPosition, "DOWN
%3d",bar->rect.top);
                                                        //TextOut(TempDC, 10, 600,
szPosition, strlen(szPosition));
                ShowUpShiftBar(TempDC, bar, dc, width);
        }
        //else if (bar->rect.top >= rectField.top)
        else if (bar->rect.top > rectField.top)
```

```
                {
                                                        //sprintf(szPosition, "UP
%3d",bar->rect.top);
                                                                //TextOut(TempDC, 10,
600, szPosition, strlen(szPosition));
                        if (bar->rect.bottom > rectField.top)
                        //if (bar->rect.bottom >= rectField.top)
                        {
                                bar->rect.top          -= fieldSize.y;
                                bar->rect.bottom -= fieldSize.y;
                                                        //sprintf(szPosition, "UP->
%3d",bar->rect.top);
                                                        //TextOut(TempDC, 10, 600,
szPosition, strlen(szPosition));
                                ShowNormalBar(TempDC, bar, dc, width);
                        }
                        else ShowUpShiftBar(TempDC, bar, dc, width);
                }
        else ShowNormalBar(TempDC, bar, dc, width);
}

void ShowNormalBar(HDC TempDC, BAR *bar, int *dc, int width)
{
        //HBITMAP hBitmap;
        if (!flagPicture) ShowNormalBarColor(TempDC, bar, dc, width);
        else ShowNormalBarPicture(TempDC, bar, hBitmap);
}

void ShowNormalBarColor(HDC TempDC, BAR *bar, int *dc, int width)
{
        HBRUSH hNewBrush, hOldBrush; //,hNewBallBrush, hOldBallBrush ;
        POINT polyg[4], pol[16];
        int cR, cG, cB;
        int i, k;
        // LEFT
        pol[0].x = bar->rect.left;
        pol[0].y = bar->rect.top;
        pol[1].x = bar->rect.left  + width;
        pol[1].y = bar->rect.top   - width;
        pol[2].x = bar->rect.left  + width;
        pol[2].y = bar->rect.bottom + width;
        pol[3].x = bar->rect.left;
        pol[3].y = bar->rect.bottom;

        //TOP
        pol[4].x = bar->rect.left;
        pol[4].y = bar->rect.top;
        pol[5].x = bar->rect.left  + width;
        pol[5].y = bar->rect.top   - width;
        pol[6].x = bar->rect.right - width;
        pol[6].y = bar->rect.top   - width;
        pol[7].x = bar->rect.right;
```

```
        pol[7].y  = bar->rect.top;

        //RIGHT
        pol[8].x  = bar->rect.right;
        pol[8].y  = bar->rect.top;
        pol[9].x  = bar->rect.right  - width;
        pol[9].y  = bar->rect.top    - width;
        pol[10].x = bar->rect.right  - width;
        pol[10].y = bar->rect.bottom + width;
        pol[11].x = bar->rect.right;
        pol[11].y = bar->rect.bottom;

        //BOTTOM
        pol[12].x = bar->rect.left;
        pol[12].y = bar->rect.bottom;
        pol[13].x = bar->rect.left   + width;
        pol[13].y = bar->rect.bottom + width;
        pol[14].x = bar->rect.right  - width;
        pol[14].y = bar->rect.bottom + width;
        pol[15].x = bar->rect.right;
        pol[15].y = bar->rect.bottom;

        hNewBrush = CreateSolidBrush(RGB(bar->color.nRed, bar->color.nGreen,
                                                                    bar->color.nBlue));
        hOldBrush = SelectObject(TempDC, hNewBrush);

        Rectangle(TempDC, bar->rect.left + width, bar->rect.top - width,
                                bar->rect.right - width, bar->rect.bottom + width);


        SelectObject(TempDC, hOldBrush);
        DeleteObject(hNewBrush);

    for (i=0; i<4; i++)
    {
        cR = bar->color.nRed      + dc[i];
        cG = bar->color.nGreen    + dc[i];
        cB = bar->color.nBlue     + dc[i];

                if (cR   > 255) cR = 255;
                if (cG   > 255) cG = 255;
                if (cB   > 255) cB = 255;
                if (cR   < 0) cR = 0;
                if (cG   < 0) cG = 0;
                if (cB   < 0) cB = 0;
                hNewBrush = CreateSolidBrush(RGB(cR, cG, cB));
                hOldBrush = SelectObject(TempDC, hNewBrush);

      for (k=0; k<4; k++) polyg[k] = pol[i*4+k];
                Polygon(TempDC, polyg, sizeof(polyg)/sizeof(POINT));
```

```
                SelectObject(TempDC, hOldBrush);
                DeleteObject(hNewBrush);
    }
        ShowBarInitNumber(TempDC, bar);
}

void ShowNormalBarPicture(HDC TempDC, BAR *bar, HBITMAP hBitmap)
{
        HPEN    hNewPen, hOldPen;

        hMemoryDC = CreateCompatibleDC(TempDC);
        GetObject(hBitmap, sizeof(BITMAP), (LPSTR) &Bitmap);
        SelectObject(hMemoryDC, hBitmap);

        SetStretchBltMode(TempDC, fStretchMode);
        /*
        StretchBlt(TempDC, bar->rect.left, bar->rect.top,
                                                bar->rect.right - bar->rect.left, bar->rect.bottom -
bar->rect.top,
                hMemoryDC, 0, 0, Bitmap.bmWidth, Bitmap.bmHeight,
                SRCCOPY);
        */

        StretchBlt(TempDC, bar->rect.left, bar->rect.top,
                                        bar->rect.right - bar->rect.left,
                                        bar->rect.bottom - bar->rect.top,
            hMemoryDC,
            //Bitmap.bmWidth/nHor * bar->nInit.y,
            Bitmap.bmWidth/nHor * bar->nInit.y,
            Bitmap.bmHeight/nVer * bar->nInit.x,
            //Bitmap.bmWidth/nHor - 1, Bitmap.bmHeight/nVer - 1,
            Bitmap.bmWidth/nHor, Bitmap.bmHeight/nVer,
            SRCCOPY);

        // Show Border
        hNewPen = CreatePen(PS_SOLID, 1, RGB(255, 0, 0));
        hOldPen = SelectObject(TempDC, hNewPen);
        //SetROP2(TempDC, R2_MERGEPENNOT);  //

        MoveTo(TempDC, bar->rect.left,  bar->rect.top);
        LineTo(TempDC, bar->rect.right, bar->rect.top);
        LineTo(TempDC, bar->rect.right, bar->rect.bottom);
        LineTo(TempDC, bar->rect.left,  bar->rect.bottom);
        LineTo(TempDC, bar->rect.left,  bar->rect.top);

        //SetROP2(TempDC, R2_COPYPEN);  //

        SelectObject(TempDC, hOldPen);
        DeleteObject(hNewPen);
        // End Show Border

        DeleteDC(hMemoryDC);
```

```
}

void ShowRightShiftBar(HDC TempDC, BAR *bar, int *dc, int width)
{
        //HBITMAP hBitmap;
        if (!flagPicture) ShowRightShiftBarColor(TempDC, bar, dc, width);
        else ShowRightShiftBarPicture(TempDC, bar, hBitmap);
}

void ShowRightShiftBarColor(HDC TempDC, BAR *bar, int *dc, int width)
{
        HBRUSH hNewBrush, hOldBrush; //,hNewBallBrush, hOldBallBrush ;
        POINT polL[4], polT[6], polR[4], polB[6];
        COLOR clr;
        int wdL, wdR;
        int wd = width;
        BAR tempBar;

        //if (bar->rect.left + width >= rectField.right) wdL = rectField.right - 1 - bar->rect.left;
        if (bar->rect.left + width > rectField.right)
                //wdL = rectField.right - 1 - bar->rect.left;
                wdL = rectField.right - bar->rect.left;
        else wdL = width;
        //if (bar->rect.right - width < rectField.right - 1) wdR = bar->rect.right - rectField.right + 1;
        if (bar->rect.right - width <= rectField.right - 1)
                //wdR = bar->rect.right - rectField.right + 1;
                wdR = bar->rect.right - rectField.right;
        else wdR = width;

        // LEFT PART
        // LEFT PART - LEFT
        if (wdL != width)
        {
        polL[0].x  = bar->rect.left                          + wdL                  - fieldSize.x;
        polL[0].y  = bar->rect.top                           - wdL;
        polL[1].x  = bar->rect.left          + width                                - fieldSize.x;
        polL[1].y  = bar->rect.top           - width;
        polL[2].x  = bar->rect.left          + width                                - fieldSize.x;
        polL[2].y  = bar->rect.bottom        + width;
        polL[3].x  = bar->rect.left                          + wdL                  - fieldSize.x;
        polL[3].y  = bar->rect.bottom                        + wdL;
        }

        // LEFT PART - TOP
        polT[0].x  = rectField.left;
        polT[0].y  = bar->rect.top;
        polT[1].x  = rectField.left;
        polT[1].y  = bar->rect.top           + width - wdL   - wdR;
        polT[2].x  = rectField.left          + width - wdL;
        polT[2].y  = bar->rect.top                                        - wdR;
        polT[3].x  = bar->rect.right                                      - wdR   - fieldSize.x;
        polT[3].y  = bar->rect.top                                        - wdR;
```

```
        polT[4].x  = bar->rect.right                                    - wdR   - fieldSize.x;
        polT[4].y  = bar->rect.top                                      - wdR;
        polT[5].x  = bar->rect.right                                                    -
fieldSize.x;
        polT[5].y  = bar->rect.top;

        // LEFT PART - RIGHT
        polR[0].x  = bar->rect.right                                                    -
fieldSize.x;
        polR[0].y  = bar->rect.top;
        polR[1].x  = bar->rect.right                                    - wdR   - fieldSize.x;
        polR[1].y  = bar->rect.top                                      - wdR;
        polR[2].x  = bar->rect.right                                    - wdR   - fieldSize.x;
        polR[2].y  = bar->rect.bottom                                   + wdR;
        polR[3].x  = bar->rect.right                                                    -
fieldSize.x;
        polR[3].y  = bar->rect.bottom;

        // LEFT PART - BOTTOM
        polB[0].x = rectField.left;
        polB[0].y = bar->rect.bottom;
        polB[1].x = rectField.left;
        polB[1].y = bar->rect.bottom      - width  + wdL   + wdR;
        polB[2].x = rectField.left        + width  - wdL;
        polB[2].y = bar->rect.bottom                                    + wdR;
        polB[3].x = bar->rect.right                                             - wdR   -
fieldSize.x;
        polB[3].y = bar->rect.bottom                                    + wdR;
        polB[4].x = bar->rect.right                                             - wdR   -
fieldSize.x;
        polB[4].y = bar->rect.bottom                                    + wdR;
        polB[5].x = bar->rect.right
        - fieldSize.x;
        polB[5].y = bar->rect.bottom;

        hNewBrush = CreateSolidBrush(RGB(bar->color.nRed, bar->color.nGreen,
                                                                        bar->color.nBlue));
        hOldBrush = SelectObject(TempDC, hNewBrush);

        Rectangle(TempDC, rectField.left + width - wdL,         bar->rect.top   - width,
                                bar->rect.right - wdR - fieldSize.x, bar->rect.bottom +
width);

        SelectObject(TempDC, hOldBrush);
        DeleteObject(hNewBrush);

        if (wdL != width)
        {
                tempBar.rect.left = bar->rect.left   - fieldSize.x;
                tempBar.rect.top = bar->rect.top;
                tempBar.rect.right        = bar->rect.right - fieldSize.x;
                tempBar.rect.bottom       = bar->rect.bottom;
```

```
            tempBar.nInit.x          = bar->nInit.x;
            tempBar.nInit.y          = bar->nInit.y;

            ShowBarInitNumber(TempDC, &tempBar);
        }

        if (wdL != width)
        {
            SetBarFilletColor(&clr, bar, dc[0]);
            hNewBrush = CreateSolidBrush(RGB(clr.nRed, clr.nGreen, clr.nBlue));
            hOldBrush = SelectObject(TempDC, hNewBrush);
            Polygon(TempDC, polL, sizeof(polL)/sizeof(POINT));
            SelectObject(TempDC, hOldBrush);
            DeleteObject(hNewBrush);
    }

        SetBarFilletColor(&clr, bar, dc[1]);
        hNewBrush = CreateSolidBrush(RGB(clr.nRed, clr.nGreen, clr.nBlue));
        hOldBrush = SelectObject(TempDC, hNewBrush);
        Polygon(TempDC, polT, sizeof(polT)/sizeof(POINT));
        SelectObject(TempDC, hOldBrush);
        DeleteObject(hNewBrush);

        SetBarFilletColor(&clr, bar, dc[2]);
        hNewBrush = CreateSolidBrush(RGB(clr.nRed, clr.nGreen, clr.nBlue));
        hOldBrush = SelectObject(TempDC, hNewBrush);
        Polygon(TempDC, polR, sizeof(polR)/sizeof(POINT));
        SelectObject(TempDC, hOldBrush);
        DeleteObject(hNewBrush);

        SetBarFilletColor(&clr, bar, dc[3]);
        hNewBrush = CreateSolidBrush(RGB(clr.nRed, clr.nGreen, clr.nBlue));
        hOldBrush = SelectObject(TempDC, hNewBrush);
        Polygon(TempDC, polB, sizeof(polB)/sizeof(POINT));
        SelectObject(TempDC, hOldBrush);
        DeleteObject(hNewBrush);

        // RIGHT PART
        // RIGHT PART - LEFT
        polL[0].x  = bar->rect.left;
        polL[0].y  = bar->rect.top;
        polL[1].x  = bar->rect.left                    + wdL;
        polL[1].y  = bar->rect.top                     - wdL;
        polL[2].x  = bar->rect.left                    + wdL;
        polL[2].y  = bar->rect.bottom                  + wdL;
        polL[3].x  = bar->rect.left;
        polL[3].y  = bar->rect.bottom;

        // RIGHT PART - TOP
        polT[0].x  = bar->rect.left;
        polT[0].y  = bar->rect.top;
        polT[1].x  = bar->rect.left                    + wdL;
```

```
polT[1].y = bar->rect.top                          - wdL;
polT[2].x = bar->rect.left                         + wdL;
polT[2].y = bar->rect.top                          - wdL;
polT[3].x = rectField.right - 1      - width                    + wdR;
polT[3].y = bar->rect.top                          - wdL;
polT[4].x = rectField.right - 1;
polT[4].y = bar->rect.top            + width - wdL - wdR;
polT[5].x = rectField.right - 1;
polT[5].y = bar->rect.top;

// RIGHT PART - RIGHT
if (wdR != width)
{
polR[0].x = bar->rect.right                                        - wdR;
polR[0].y = bar->rect.top                                          - wdR;
polR[1].x = bar->rect.right          - width;
polR[1].y = bar->rect.top            - width;
polR[2].x = bar->rect.right          - width;
polR[2].y = bar->rect.bottom         + width;
polR[3].x = bar->rect.right                                        - wdR;
polR[3].y = bar->rect.bottom                                       + wdR;
}

// RIGHT PART - BOTTOM
polB[0].x = bar->rect.left;
polB[0].y = bar->rect.bottom;
polB[1].x = bar->rect.left                         + wdL;
polB[1].y = bar->rect.bottom                       + wdL;
polB[2].x = bar->rect.left                         + wdL;
polB[2].y = bar->rect.bottom                       + wdL;
polB[3].x = rectField.right - 1 - width                    + wdR;
polB[3].y = bar->rect.bottom                       + wdL;
polB[4].x = rectField.right - 1;
polB[4].y = bar->rect.bottom         - width + wdL + wdR;
polB[5].x = rectField.right - 1;
polB[5].y = bar->rect.bottom;

hNewBrush = CreateSolidBrush(RGB(bar->color.nRed, bar->color.nGreen,
                                                          bar->color.nBlue));
hOldBrush = SelectObject(TempDC, hNewBrush);

Rectangle(TempDC, bar->rect.left + wdL,          bar->rect.top       - width,
                          rectField.right - width + wdR, bar->rect.bottom + width);


SelectObject(TempDC, hOldBrush);
DeleteObject(hNewBrush);

if (wdR != width) ShowBarInitNumber(TempDC, bar);

SetBarFilletColor(&clr, bar, dc[0]);
hNewBrush = CreateSolidBrush(RGB(clr.nRed, clr.nGreen, clr.nBlue));
```

```
        hOldBrush = SelectObject(TempDC, hNewBrush);
        Polygon(TempDC, polL, sizeof(polL)/sizeof(POINT));
        SelectObject(TempDC, hOldBrush);
        DeleteObject(hNewBrush);

        SetBarFilletColor(&clr, bar, dc[1]);
        hNewBrush = CreateSolidBrush(RGB(clr.nRed, clr.nGreen, clr.nBlue));
        hOldBrush = SelectObject(TempDC, hNewBrush);
        Polygon(TempDC, polT, sizeof(polT)/sizeof(POINT));
        SelectObject(TempDC, hOldBrush);
        DeleteObject(hNewBrush);

        if (wdR != width)
        {
                SetBarFilletColor(&clr, bar, dc[2]);
                hNewBrush = CreateSolidBrush(RGB(clr.nRed, clr.nGreen, clr.nBlue));
                hOldBrush = SelectObject(TempDC, hNewBrush);
                Polygon(TempDC, polR, sizeof(polR)/sizeof(POINT));
                SelectObject(TempDC, hOldBrush);
                DeleteObject(hNewBrush);
        }

        SetBarFilletColor(&clr, bar, dc[3]);
        hNewBrush = CreateSolidBrush(RGB(clr.nRed, clr.nGreen, clr.nBlue));
        hOldBrush = SelectObject(TempDC, hNewBrush);
        Polygon(TempDC, polB, sizeof(polB)/sizeof(POINT));
        SelectObject(TempDC, hOldBrush);
        DeleteObject(hNewBrush);
}

void SetBarFilletColor(COLOR *clr, BAR *bar, int dc)
{
                clr->nRed = bar->color.nRed         + dc;
                clr->nGreen = bar->color.nGreen     + dc;
                clr->nBlue = bar->color.nBlue       + dc;

                        if (clr->nRed       > 255) clr->nRed = 255;
                        if (clr->nGreen     > 255) clr->nGreen = 255;
                        if (clr->nBlue      > 255) clr->nBlue = 255;
                        if (clr->nRed       < 0) clr->nRed = 0;
                        if (clr->nGreen     < 0) clr->nGreen = 0;
                        if (clr->nBlue      < 0) clr->nBlue = 0;
}

void ShowRightShiftBarPicture(HDC TempDC, BAR *bar, HBITMAP hBitmap)
{
        float fraction = ((float)(rectField.right - bar->rect.left))/
                                        ((float)(bar->rect.right - bar->rect.left));
        HPEN hNewPen, hOldPen;

        hMemoryDC = CreateCompatibleDC(TempDC);
        //hBitmap0 = LoadBitmap(hInst, "arches");
```

```
        //hBitmap1 = LoadBitmap(hInst, "dog");
        GetObject(hBitmap, sizeof(BITMAP), (LPSTR) &Bitmap);
        SelectObject(hMemoryDC, hBitmap);

        SetStretchBltMode(TempDC, fStretchMode);
        /*
        StretchBlt(TempDC, bar->rect.left, bar->rect.top,
                                        bar->rect.right - bar->rect.left, bar->rect.bottom -
bar->rect.top,
            hMemoryDC, 0, 0, Bitmap.bmWidth, Bitmap.bmHeight,
            SRCCOPY);
        */

        StretchBlt(TempDC, bar->rect.left, bar->rect.top,
                                rectField.right - bar->rect.left,
                                bar->rect.bottom - bar->rect.top,
            hMemoryDC,
            Bitmap.bmWidth/nHor * bar->nInit.y,
            Bitmap.bmHeight/nVer * bar->nInit.x,
            (int) ( (float) Bitmap.bmWidth/nHor * fraction) - 1,
            Bitmap.bmHeight/nVer - 1,
            SRCCOPY);

        StretchBlt(TempDC, rectField.left, bar->rect.top,
                                bar->rect.right - fieldSize.x - rectField.left,
                                bar->rect.bottom - bar->rect.top,
            hMemoryDC,
            (int) ( (float) Bitmap.bmWidth/nHor * (bar->nInit.y + fraction)),
            Bitmap.bmHeight/nVer * bar->nInit.x,
            (int) ( (float) Bitmap.bmWidth/nHor * (1 - fraction)) - 1,
                                Bitmap.bmHeight/nVer - 1,
            SRCCOPY);
        /*
        StretchBlt(TempDC, bar->rect.left, bar->rect.top,
                                bar->rect.right - bar->rect.left,
                                bar->rect.bottom - bar->rect.top,
            hMemoryDC,
            Bitmap.bmWidth/nHor * bar->nInit.y,
            Bitmap.bmHeight/nVer * bar->nInit.x,
            Bitmap.bmWidth/nHor, Bitmap.bmHeight/nVer,
            SRCCOPY);
    */

        // Show Border
        hNewPen = CreatePen(PS_SOLID, 1, RGB(255, 0, 0));
        hOldPen = SelectObject(TempDC, hNewPen);
        //SetROP2(TempDC, R2_MERGEPENNOT);  //

        // Right-side border
        MoveTo(TempDC, rectField.right, bar->rect.top);
        LineTo(TempDC, bar->rect.left,  bar->rect.top);
        LineTo(TempDC, bar->rect.left,  bar->rect.bottom);
```

```
        LineTo(TempDC, rectField.right, bar->rect.bottom);

        // Left-side border
        MoveTo(TempDC, rectField.left,  bar->rect.top);
        LineTo(TempDC, bar->rect.right - fieldSize.x, bar->rect.top);
        LineTo(TempDC, bar->rect.right - fieldSize.x, bar->rect.bottom);
        LineTo(TempDC, rectField.left,  bar->rect.bottom);

        //SetROP2(TempDC, R2_COPYPEN);  //

        SelectObject(TempDC, hOldPen);
        DeleteObject(hNewPen);
        // End Show Border

        DeleteDC(hMemoryDC);
}

void ShowUpShiftBar(HDC TempDC, BAR *bar, int *dc, int width)
{
        //HBITMAP hBitmap;
        if (!flagPicture) ShowUpShiftBarColor(TempDC, bar, dc, width);
        else ShowUpShiftBarPicture(TempDC, bar, hBitmap);
}

void ShowUpShiftBarColor(HDC TempDC, BAR *bar, int *dc, int width)
{
        HBRUSH hNewBrush, hOldBrush; //,hNewBallBrush, hOldBallBrush ;
        POINT polL[6], polT[4], polR[6], polB[4];
        COLOR clr;
        int wdT, wdD;
        BAR tempBar;
  /*
        if (bar->rect.bottom + width >= rectField.top) wdD = rectField.top - 1 - bar->rect.bottom;
        else wdD = width;
        if (bar->rect.top - width < rectField.top - 1) wdT = bar->rect.top - rectField.top + 1;
        else wdT = width;
        */
        if (bar->rect.bottom + width >= rectField.top) wdD = rectField.top - bar->rect.bottom;
        else wdD = width;
        if (bar->rect.top - width <= rectField.top) wdT = bar->rect.top - rectField.top;
        else wdT = width;

        // BOTTOM PART
        // BOTTOM PART - LEFT
        polL[0].x  = bar->rect.left;
        polL[0].y  = rectField.bottom;
        polL[1].x  = bar->rect.left          - width  + wdD   + wdT;
        polL[1].y  = rectField.bottom;
        polL[2].x  = bar->rect.left                                    + wdT;
        polL[2].y  = rectField.bottom                 + width  - wdD;
        polL[3].x  = bar->rect.left                                    + wdT;
        polL[3].y  = bar->rect.top                                 - wdT          - fieldSize.y;
```

```
        polL[4].x  = bar->rect.left                                    + wdT;
        polL[4].y  = bar->rect.top                              - wdT          - fieldSize.y;
        polL[5].x  = bar->rect.left;
        polL[5].y  = bar->rect.top                                                    -
fieldSize.y;

        // BOTTOM PART - TOP
        polT[0].x  = bar->rect.left;
        polT[0].y  = bar->rect.top                                                    -
fieldSize.y;
        polT[1].x  = bar->rect.left        + wdT;
        polT[1].y  = bar->rect.top         - wdT                                      - fieldSize.y;
        polT[2].x  = bar->rect.right       - wdT;
        polT[2].y  = bar->rect.top         - wdT                                      - fieldSize.y;
        polT[3].x  = bar->rect.right;
        polT[3].y  = bar->rect.top                                                    -
fieldSize.y;

        // BOTTOM PART - RIGHT
        polR[0].x = bar->rect.right;
        polR[0].y = rectField.bottom;
        polR[1].x = bar->rect.right                + width - wdD   - wdT;
        polR[1].y = rectField.bottom;
        polR[2].x = bar->rect.right                                    - wdT;
        polR[2].y = rectField.bottom               + width - wdD;
        polR[3].x = bar->rect.right                                    - wdT;
        polR[3].y = bar->rect.top                                      - wdT   - fieldSize.y;
        polR[4].x = bar->rect.right                                    - wdT;
        polR[4].y = bar->rect.top                                      - wdT   - fieldSize.y;
        polR[5].x = bar->rect.right;
        polR[5].y = bar->rect.top                                                     -
fieldSize.y;

        // BOTTOM PART - BOTTOM
        if (wdD != width)
        {
        polB[0].x  = bar->rect.left                + wdD;
        polB[0].y  = rectField.bottom;
        polB[1].x  = bar->rect.left                             + width;
        polB[1].y  = bar->rect.bottom                           + width         - fieldSize.y;
        polB[2].x  = bar->rect.right                            - width;
        polB[2].y  = bar->rect.bottom                           + width         - fieldSize.y;
        polB[3].x  = bar->rect.right               - wdD;
        polB[3].y  = rectField.bottom;
        }

        hNewBrush = CreateSolidBrush(RGB(bar->color.nRed, bar->color.nGreen,
                                                                       bar->color.nBlue));
        hOldBrush = SelectObject(TempDC, hNewBrush);

        Rectangle(TempDC, bar->rect.left  + width, bar->rect.top - wdT - fieldSize.y,
```

```
                                        bar->rect.right - width, rectField.bottom + width - wdD);

        SelectObject(TempDC, hOldBrush);
        DeleteObject(hNewBrush);

        if (wdD != width)
        {
                tempBar.rect.left = bar->rect.left;
                tempBar.rect.top = bar->rect.top            - fieldSize.y;
                tempBar.rect.right          = bar->rect.right;
                tempBar.rect.bottom         = bar->rect.bottom          - fieldSize.y;
                tempBar.nInit.x             = bar->nInit.x;
                tempBar.nInit.y             = bar->nInit.y;

                ShowBarInitNumber(TempDC, &tempBar);
}

        SetBarFilletColor(&clr, bar, dc[0]);
        hNewBrush = CreateSolidBrush(RGB(clr.nRed, clr.nGreen, clr.nBlue));
        hOldBrush = SelectObject(TempDC, hNewBrush);
        Polygon(TempDC, polL, sizeof(polL)/sizeof(POINT));
        SelectObject(TempDC, hOldBrush);
        DeleteObject(hNewBrush);

        SetBarFilletColor(&clr, bar, dc[1]);
        hNewBrush = CreateSolidBrush(RGB(clr.nRed, clr.nGreen, clr.nBlue));
        hOldBrush = SelectObject(TempDC, hNewBrush);
        Polygon(TempDC, polT, sizeof(polT)/sizeof(POINT));
        SelectObject(TempDC, hOldBrush);
        DeleteObject(hNewBrush);

        SetBarFilletColor(&clr, bar, dc[2]);
        hNewBrush = CreateSolidBrush(RGB(clr.nRed, clr.nGreen, clr.nBlue));
        hOldBrush = SelectObject(TempDC, hNewBrush);
        Polygon(TempDC, polR, sizeof(polR)/sizeof(POINT));
        SelectObject(TempDC, hOldBrush);
        DeleteObject(hNewBrush);

        if (wdD != width)
        {
                SetBarFilletColor(&clr, bar, dc[3]);
                hNewBrush = CreateSolidBrush(RGB(clr.nRed, clr.nGreen, clr.nBlue));
                hOldBrush = SelectObject(TempDC, hNewBrush);
                Polygon(TempDC, polB, sizeof(polB)/sizeof(POINT));
                SelectObject(TempDC, hOldBrush);
                DeleteObject(hNewBrush);
}

        // TOP PART
        // TOP PART - LEFT
        polL[0].x  = bar->rect.left;
```

```
polL[0].y = bar->rect.bottom;
polL[1].x = bar->rect.left                    + wdD;
polL[1].y = bar->rect.bottom                  + wdD;
polL[2].x = bar->rect.left                    + wdD;
polL[2].y = bar->rect.bottom                  + wdD;
polL[3].x = bar->rect.left                    + wdD;
//polL[3].y = rectField.top - 1 - width                + wdT;
polL[3].y = rectField.top - width             + wdT;
polL[4].x = bar->rect.left            + wdD + wdT - width;
//polL[4].y = rectField.top - 1;
polL[4].y = rectField.top;
polL[5].x = bar->rect.left;
//polL[5].y = rectField.top - 1;
polL[5].y = rectField.top;

// TOP PART - TOP
if (wdT != width)
{
        polT[0].x = bar->rect.right                                  - wdT;
        polT[0].y = bar->rect.top                                    - wdT;
        polT[1].x = bar->rect.right           - width;
        polT[1].y = bar->rect.top             - width;
        polT[2].x = bar->rect.left            + width;
        polT[2].y = bar->rect.top             - width;
        polT[3].x = bar->rect.left                                   + wdT;
        polT[3].y = bar->rect.top                                    - wdT;
}

// TOP PART - RIGHT
polR[0].x = bar->rect.right;
polR[0].y = bar->rect.bottom;
polR[1].x = bar->rect.right                   - wdD;
polR[1].y = bar->rect.bottom                  + wdD;
polR[2].x = bar->rect.right                   - wdD;
polR[2].y = bar->rect.bottom                  + wdD;

polR[3].x = bar->rect.right                   - wdD;
polR[3].y = rectField.top - 1         - width                + wdT;
polR[4].x = bar->rect.right                   - wdD - wdT + width     ;
polR[4].y = rectField.top - 1;
polR[5].x = bar->rect.right;
polR[5].y = rectField.top - 1;

polR[3].x = bar->rect.right                   - wdD;
polR[3].y = rectField.top             - width                + wdT;
polR[4].x = bar->rect.right                   - wdD - wdT + width     ;
polR[4].y = rectField.top;
polR[5].x = bar->rect.right;
polR[5].y = rectField.top;

// TOP PART - BOTTOM
polB[0].x = bar->rect.right;
```

```
        polB[0].y = bar->rect.bottom;
        polB[1].x = bar->rect.right                                  - wdD;
        polB[1].y = bar->rect.bottom                                 + wdD;
        polB[2].x = bar->rect.left                                   + wdD;
        polB[2].y = bar->rect.bottom                                 + wdD;
        polB[3].x = bar->rect.left;
        polB[3].y = bar->rect.bottom;

        hNewBrush = CreateSolidBrush(RGB(bar->color.nRed, bar->color.nGreen,
                                                                    bar->color.nBlue));
        hOldBrush = SelectObject(TempDC, hNewBrush);

//      Rectangle(TempDC, bar->rect.left + width, rectField.top - 1 - width + wdT,
//                                  bar->rect.right - width, bar->rect.bottom + wdD);

        Rectangle(TempDC, bar->rect.left + width, rectField.top - width + wdT,
                                  bar->rect.right - width, bar->rect.bottom + wdD);


        SelectObject(TempDC, hOldBrush);
        DeleteObject(hNewBrush);

        if (wdT != width) ShowBarInitNumber(TempDC, bar);

        SetBarFilletColor(&clr, bar, dc[0]);
        hNewBrush = CreateSolidBrush(RGB(clr.nRed, clr.nGreen, clr.nBlue));
        hOldBrush = SelectObject(TempDC, hNewBrush);
        Polygon(TempDC, polL, sizeof(polL)/sizeof(POINT));
        SelectObject(TempDC, hOldBrush);
        DeleteObject(hNewBrush);

        if (wdT != width)
        {
        SetBarFilletColor(&clr, bar, dc[1]);
        hNewBrush = CreateSolidBrush(RGB(clr.nRed, clr.nGreen, clr.nBlue));
        hOldBrush = SelectObject(TempDC, hNewBrush);
        Polygon(TempDC, polT, sizeof(polT)/sizeof(POINT));
        SelectObject(TempDC, hOldBrush);
        DeleteObject(hNewBrush);
        }

        SetBarFilletColor(&clr, bar, dc[2]);
        hNewBrush = CreateSolidBrush(RGB(clr.nRed, clr.nGreen, clr.nBlue));
        hOldBrush = SelectObject(TempDC, hNewBrush);
        Polygon(TempDC, polR, sizeof(polR)/sizeof(POINT));
        SelectObject(TempDC, hOldBrush);
        DeleteObject(hNewBrush);

        SetBarFilletColor(&clr, bar, dc[3]);
        hNewBrush = CreateSolidBrush(RGB(clr.nRed, clr.nGreen, clr.nBlue));
        hOldBrush = SelectObject(TempDC, hNewBrush);
        Polygon(TempDC, polB, sizeof(polB)/sizeof(POINT));
```

```
        SelectObject(TempDC, hOldBrush);
        DeleteObject(hNewBrush);
}

void ShowUpShiftBarPicture(HDC TempDC, BAR *bar, HBITMAP hBitmap)
{
        float fraction = ((float)(rectField.top - bar->rect.bottom))/
                                        ((float)(bar->rect.top - bar->rect.bottom));
        HPEN hNewPen, hOldPen;

        hMemoryDC = CreateCompatibleDC(TempDC);
        //hBitmap0 = LoadBitmap(hInst, "arches");
        //hBitmap1 = LoadBitmap(hInst, "dog");
        GetObject(hBitmap, sizeof(BITMAP), (LPSTR) &Bitmap);
        SelectObject(hMemoryDC, hBitmap);

        SetStretchBltMode(TempDC, fStretchMode);
        /*
        StretchBlt(TempDC, bar->rect.left, bar->rect.top,
                                        bar->rect.right - bar->rect.left, bar->rect.bottom -
bar->rect.top,
                hMemoryDC, 0, 0, Bitmap.bmWidth, Bitmap.bmHeight,
                SRCCOPY);
        */

        /*
        StretchBlt(TempDC, bar->rect.left, rectField.top - 1,
                                bar->rect.right - bar->rect.left,
                                bar->rect.bottom - rectField.top - 1,
        */
        StretchBlt(TempDC, bar->rect.left, rectField.top,
                                bar->rect.right - bar->rect.left,
                                bar->rect.bottom - rectField.top,
            hMemoryDC,
            Bitmap.bmWidth/nHor * bar->nInit.y,
            (int) (Bitmap.bmHeight/nVer * (bar->nInit.x + 1 - fraction)),
            Bitmap.bmWidth/nHor,
            (int) ( (float) Bitmap.bmHeight/nVer * fraction),
            SRCCOPY);

        StretchBlt(TempDC, bar->rect.left, bar->rect.top - fieldSize.y,
                                bar->rect.right - bar->rect.left,
                                + rectField.bottom - bar->rect.top + fieldSize.y,
            hMemoryDC,
            Bitmap.bmWidth/nHor * bar->nInit.y,
            (int) (Bitmap.bmHeight/nVer * bar->nInit.x),
            Bitmap.bmWidth/nHor,
            (int) ( (float) Bitmap.bmHeight/nVer * (1 - fraction)),
            SRCCOPY);
        /*
        StretchBlt(TempDC, bar->rect.left, bar->rect.top,
                                bar->rect.right - bar->rect.left,
```

```
                                        bar->rect.bottom - bar->rect.top,
            hMemoryDC,
            Bitmap.bmWidth/nHor * bar->nInit.y,
            Bitmap.bmHeight/nVer * bar->nInit.x,
            Bitmap.bmWidth/nHor, Bitmap.bmHeight/nVer,
            SRCCOPY);
  */

        // Show Border
        hNewPen = CreatePen(PS_SOLID, 1, RGB(255, 0, 0));
        hOldPen = SelectObject(TempDC, hNewPen);
        //SetROP2(TempDC, R2_MERGEPENNOT);  //

        // Up-side border
        MoveTo(TempDC, bar->rect.left,  rectField.top);
        LineTo(TempDC, bar->rect.left,  bar->rect.bottom);
        LineTo(TempDC, bar->rect.right, bar->rect.bottom);
        LineTo(TempDC, bar->rect.right, rectField.top);

        // Bottom-side border
        MoveTo(TempDC, bar->rect.left,  rectField.bottom);
        LineTo(TempDC, bar->rect.left,  bar->rect.top - fieldSize.y);
        LineTo(TempDC, bar->rect.right, bar->rect.top - fieldSize.y);
        LineTo(TempDC, bar->rect.right, rectField.bottom);

        //SetROP2(TempDC, R2_COPYPEN);  //

        SelectObject(TempDC, hOldPen);
        DeleteObject(hNewPen);
        // End Show Border
        DeleteDC(hMemoryDC);
}

//////////////////////////////////////////////////////////////////////////////

//DrawTime: Paints the statistics on the window during the sort
//
void ShowBarInitNumber(HDC TempDC, BAR *bar)
{
        RECT internal_rect;
  char szPosition[30];
  int xPos, yPos;
  float fraction = 0.35;

        if (flagBarNumber)
        {
                SetRect(&internal_rect,
                        (bar->rect.left          + (int) ((float) (bar->rect.right - bar-
>rect.left)*fraction)),
                        (bar->rect.top           - (int) ((float) (bar->rect.top - bar-
>rect.bottom)*fraction)),
                        (bar->rect.right   - (int) ((float) (bar->rect.right - bar->rect.left)*fraction)),
```

```
                    (bar->rect.bottom+ (int) ((float) (bar->rect.top - bar->rect.bottom)*fraction)));

            //SetBkColor(TempDC, RGB(bar->color.nRed, bar->color.nGreen, bar->color.nBlue));

            Ellipse(TempDC, internal_rect.left, internal_rect.top,
                                        internal_rect.right, internal_rect.bottom);

        sprintf(szPosition, "%2d",(bar->nInit.x)*nHor + bar->nInit.y + 1);

        xPos = (bar->rect.left + bar->rect.right)/2 - 3*strlen(szPosition);
        yPos = (bar->rect.top + bar->rect.bottom)/2 + 15; //10;

        // Print the number of seconds elapsed
        //TextOut(TempDC, xPos, yPos, szPosition, strlen(szPosition));
        DrawText(TempDC, szPosition, -1, &internal_rect,
                    DT_SINGLELINE | DT_CENTER | DT_VCENTER);
    }
}

//////////////////////////////////////////////////////////////////////////////
/*
//DrawTime: Paints the statistics on the window during the sort
//
void ShowBarInitNumber(HDC TempDC, BAR *bar)
{
   char szPosition[30];
   int xPos, yPos;

   sprintf(szPosition, "%2d%2d",bar->nInit.x + 1,bar->nInit.y + 1);

   xPos = (bar->rect.left + bar->rect.right)/2 - 3*strlen(szPosition);
   yPos = (bar->rect.top + bar->rect.bottom)/2 + 10;

        //SetBkColor(TempDC, RGB(bar->color.nRed, bar->color.nGreen, bar->color.nBlue));

   // Print the number of seconds elapsed
   if (flagBarNumber) TextOut(TempDC, xPos, yPos, szPosition, strlen(szPosition));
}
*/
//////////////////////////////////////////////////////////////////////////////

void InitBarSet()
{
        //HDC TempDC;

        int i, k;
        BAR *barCurr;
        /*
        if (barSet == NULL) barSet = (BAR *) calloc(nVer*nHor, sizeof(BAR));
        else MessageBox(hWnd, "Array \"barSet\" Aready Exists - Can't Be Created Again",
"InitBarSet", MB_OK);
   */
```

```
    barCurr = barSet;

    for (i = 0; i < nVer; i++)
    for (k = 0; k < nHor; k++)              // Order: 11, 12, 13, ..., 21, 22, 23, ...
    {
            barCurr = barSet + i*nHor + k;
barCurr->nInit.x = i;
            barCurr->nInit.y = k;
            barCurr->nCurr.x = barCurr->nInit.x;
            barCurr->nCurr.y = barCurr->nInit.y;

            barCurr->rect.left   = rectField.left   + barSize.x * barCurr->nInit.y;
            barCurr->rect.bottom = rectField.bottom + barSize.y * (nVer - 1 - barCurr->nInit.x);
            barCurr->rect.right  = barCurr->rect.left + barSize.x - 1;
            barCurr->rect.top            = barCurr->rect.bottom + barSize.y - 1;

            barCurr->color.nRed       = 255 - i*50;
            barCurr->color.nGreen = 0 + i*50;
            barCurr->color.nBlue  = 0 + i*25;
if (i == 0)
{
   barCurr->color.nRed        = Red.nRed;
                    barCurr->color.nGreen = Red.nGreen;
                    barCurr->color.nBlue  = Red.nBlue;
}
if (i == 1)
{
   barCurr->color.nRed        = Green.nRed;
                    barCurr->color.nGreen = Green.nGreen;
                    barCurr->color.nBlue  = Green.nBlue;
}
if (i == 2)
{
   barCurr->color.nRed        = Yellow.nRed;
                    barCurr->color.nGreen = Yellow.nGreen;
                    barCurr->color.nBlue  = Yellow.nBlue;
}
if (i == 3)
{
   barCurr->color.nRed        = Blue.nRed;
                    barCurr->color.nGreen = Blue.nGreen;
                    barCurr->color.nBlue  = Blue.nBlue;
}
if (i == 4)
{
   barCurr->color.nRed        = Cyan.nRed;
                    barCurr->color.nGreen = Cyan.nGreen;
                    barCurr->color.nBlue  = Cyan.nBlue;
}

            //barCurr++;
    }
```

```
    /*
        TempDC = InitDraw(hWnd);
        sprintf(str, "InitBarSet: %5d", deltaVer);
        TextOut(TempDC, 10, 320, str, strlen(str));
        ReleaseDC(hWnd, TempDC);
    */
        InitMap();
}

//////////////////////////////////////////////////////////////////////////////

//void ShowBarSet(HWND hWnd)
void ShowBarSet(HDC hDC)
{
        int i, k;

        for (i = 0; i < nVer; i++)
        for (k = 0; k < nHor; k++)
        {
                ShowBar(hDC, barSet + i * nHor + k);
        }
}

//////////////////////////////////////////////////////////////////////////////

//void ShowInitBarSet(HWND hWnd)
void ShowInitBarSet(HDC hDC)
{
        int i, k, ii, kk;
        BAR *barClue;

        for (i = 0; i < nVer; i++)
        for (k = 0; k < nHor; k++)
        {
                ii = (barSet + i * nHor + k)->nInit.x;
                kk = (barSet + i * nHor + k)->nInit.y;

                barClue->rect.left          = rectField.left + barSize.x * kk;
                barClue->rect.right         = barClue->rect.left + barSize.x - 1;
                barClue->rect.bottom        = rectField.bottom + barSize.y * (nVer - 1 - ii);
                barClue->rect.top           = barClue->rect.bottom + barSize.y - 1;

                barClue->nInit.x            = (barSet + i * nHor + k)->nInit.x;
                barClue->nInit.y            = (barSet + i * nHor + k)->nInit.y;

                barClue->color.nRed         = (barSet + i * nHor + k)->color.nRed;
                barClue->color.nGreen       = (barSet + i * nHor + k)->color.nGreen;
                barClue->color.nBlue        = (barSet + i * nHor + k)->color.nBlue;

                ShowBar(hDC, barClue);
        }
```

```
}

////////////////////////////////////////////////////////////////////////////

void ShowClue(HDC hDC, RECT *rectClue, BOOL flagClue, BOOL frameClue)
{
        HDC hMemoryDC;
  //HPEN hNewPen, hOldPen;
  //HBRUSH hNewBrush, hOldBrush;
        int fStretchMode;                // type of stretch mode to use
        /*
        int border = (rectField.right - rectField.left)/40;

          hNewPen = CreatePen(PS_NULL, 1, RGB(nRedPage, nGreenPage, nBluePage));
          hOldPen = SelectObject(hDC, hNewPen);
 */
       //if (flagClue)
       {
               /*
               if (frameClue)
               {
                       hNewBrush = GetStockObject(LTGRAY_BRUSH);
                       hOldBrush = SelectObject(hDC, hNewBrush);

                       Rectangle(hDC,  rectClue.left-border, rectClue.top+border,
                                       rectClue.right+border, rectClue.bottom-border);


                       SelectObject(hDC, hOldBrush);
                       DeleteObject(hNewBrush);
  }
  */
               hMemoryDC = CreateCompatibleDC(hDC);
               GetObject(hBitmap, sizeof(BITMAP), (LPSTR) &Bitmap);
               SelectObject(hMemoryDC, hBitmap);

               SetStretchBltMode(hDC, fStretchMode);

               StretchBlt(hDC, rectClue->left, rectClue->top,
rectClue->top,                          rectClue->right - rectClue->left, rectClue->bottom -

Bitmap.bmHeight,                        hMemoryDC, 0, 0, Bitmap.bmWidth,

                                        SRCCOPY);

               DeleteDC(hMemoryDC);
               //ReleaseDC(hWnd, hDC);
       }
       /*
       else
       {
```

```
                hNewBrush = CreateSolidBrush(RGB(nRedPage, nGreenPage, nBluePage));
                hOldBrush = SelectObject(hDC, hNewBrush);

                Rectangle(hDC,  rectClue.left-border, rectClue.top+border,
                                        rectClue.right+border, rectClue.bottom-border);


                SelectObject(hDC, hOldBrush);
                DeleteObject(hNewBrush);

            // Create and select the brush to draw the chart data itself
            //
        }
        */
        /*
            SelectObject(hDC, hOldPen);
            DeleteObject(hNewPen);
        */
}

////////////////////////////////////////////////////////////////////////////////

// Sets barSet according to map
void SetBarSetMap()
{
        //HDC TempDC;

        int iMap, kMap, iBar, kBar;
        BAR *barCurr;

        barCurr = barSet;

        for (iMap = 0; iMap < nVer; iMap++)
        for (kMap = 0; kMap < nHor; kMap++)          // Order: 11, 12, 13, ..., 21, 22, 23, ...
        {
                iBar = (map + iMap * nHor + kMap)->indexRow;
                kBar = (map + iMap * nHor + kMap)->indexCol;

                barCurr = barSet + iBar * nHor + kBar;

                barCurr->nCurr.x = iMap;
                barCurr->nCurr.y = kMap;

                barCurr->rect.left   = rectField.left   + barSize.x * barCurr->nCurr.y;
                barCurr->rect.bottom = rectField.bottom + barSize.y * (nVer - 1 - barCurr->nCurr.x);
                barCurr->rect.right  = barCurr->rect.left + barSize.x - 1;
                barCurr->rect.top            = barCurr->rect.bottom + barSize.y - 1;
        }

/*
        TempDC = InitDraw(hWnd);
```

```
        sprintf(str, "InitBarSet: %5d", deltaVer);
        TextOut(TempDC, 10, 320, str, strlen(str));
        ReleaseDC(hWnd, TempDC);
  */
}

//////////////////////////////////////////////////////////////////////////////
```

APPENDIX D

```
/*****************************************************************************
        Copyright by Sergey K. Aityan and Alexander V. Lysyansky

  BOTTA        Version 1.2
  PROGRAM: map.c

        August 11, 1995

  PURPOSE:    2-Dimensional Cyclic Game
                Moves Control

  FUNCTIONS:

        void InitMap();
        void SetMap();
        int GetMapColumnIndex(int x);
        int GetMapRowIndex(int y);
        void MoveRow(HDC, POINT *currIndex,POINT *move);
        void MoveColumn(HDC, POINT *currIndex,POINT *move);
        void FixRowPosition(HDC hDC, POINT *currIndex);
        void FixColumnPosition(HDC hDC, POINT *currIndex);
        void FixBarPosition(HDC hDC, BAR *bar);

        void CheckMove(POINT *currIndex, POINT *prevBarIndex);

        void SetVariatedMap();
        void SetRandomizedMap();

        BOOL CheckFinish();

        #define GetRandom( min, max ) ((rand() % (int)(((max) + 1) - (min))) + (min))
*****************************************************************************/

#include "windows.h"
#include "string.h"
#include <math.h>
#include <time.h>
#include <malloc.h>
#include <stdio.h>
#include <stdlib.h>

#include "map.h"
#include "bar.h"
#include "controls.h"
//#include "botta.h"

//////////////////////////////////////////////////////////////////////////////

HWND hWnd;
```

```
MAP *map;

char str[255];

////////////////////////////////////////////////////////////////////////////

int nVer, nHor;
HDC InitDraw(HWND hWnd);
RECT rectField;
POINT barSize;
POINT fieldSize;
BAR *barSet;

int numMoves;
CONTFRAME cont_frame_1, cont_frame_2, cont_frame_3;

short nVariate;

BOOL flagBarNumber, flagPicture;
////////////////////////////////////////////////////////////////////////////

void InitMap()
{
        int i, k, ii;
  /*
        if (map == NULL) map = (MAP *) calloc(nHor*nVer, sizeof(MAP));
        else MessageBox(hWnd, "Array \"map\" Aready Exists - Can't Be Created Again", "InitMap",
MB_OK);
  */
  for (i = 0; i < nVer; i++)
  for (k = 0; k < nHor; k++)
  {
        ii = i*nHor + k;
        (map + ii)->indexRow = (barSet + ii)->nCurr.x;
        (map + ii)->indexCol = (barSet + ii)->nCurr.y;
  }

        /*
        hTC = InitDraw(hWnd);
  for (i = 0; i < nVer; i++)
  //for (k = 0; k < nHor; k++)
  {
                sprintf(str, "MAP: ( %2d  %2d )   ( %2d  %2d )   ( %2d  %2d )   ",
                                (map+i*nHor+0)->indexRow, (map+i*nHor+0)->indexCol,
                                (map+i*nHor+1)->indexRow, (map+i*nHor+1)->indexCol,
                                (map+i*nHor+2)->indexRow, (map+i*nHor+2)->indexCol);
                TextOut(hTC, 10, 120 - i*40, str, strlen(str));
        }
        //TextOut(TempDC, 10, 10, str, strlen(str));
        ReleaseDC(hWnd, hTC);
        */
}
```

```
////////////////////////////////////////////////////////////////////////////

// SetMap(): Sets map.indexRow & map.indexCol equal to the initial indeces of
//                                the bars located in map
void SetMap()
{
        int i, k;
        int ii, kk;

  for (i = 0; i < nVer; i++)
  for (k = 0; k < nHor; k++)
  {
        ii = (barSet + i*nHor + k)->nCurr.x;
        kk = (barSet + i*nHor + k)->nCurr.y;

        (map + ii*nHor + kk)->indexRow = (barSet + i*nHor + k)->nInit.x;
        (map + ii*nHor + kk)->indexCol = (barSet + i*nHor + k)->nInit.y;
        k = k;
  }
  /*
  for (i = 0; i < nVer; i++)
  //for (k = 0; k < nHor; k++)
  {
                sprintf(str, "MAP: ( %2d %2d )  ( %2d %2d )  ( %2d %2d )  ( %2d %2d )  ",
                                (map+i*nHor+0)->indexRow, (map+i*nHor+0)->indexCol,
                                (map+i*nHor+1)->indexRow, (map+i*nHor+1)->indexCol,
                                (map+i*nHor+2)->indexRow, (map+i*nHor+2)->indexCol,
                                (map+i*nHor+3)->indexRow, (map+i*nHor+3)->indexCol);
                TextOut(hDC, 10, 160 - i*40, str, strlen(str));
        }
        */
}

////////////////////////////////////////////////////////////////////////////

// Returns COLUMN index from the field coordinate
int GetMapColumnIndex(int x)
{
//HDC TempDC;

        int k;
  k = x - rectField.left;

//      if (k > 0) k /= barSize.x;                      else    k = nHor - 1;
        if (k >= 0) k /= barSize.x;                     else    k = - 1;
        if (k >= nHor) k = -1;
  /*
        TempDC = InitDraw(hWnd);
        sprintf(str, "GetMapColumnIndex: %2d", k);
        TextOut(TempDC, 10, 200, str, strlen(str));
  ReleaseDC(hWnd, TempDC);
```

```
  */
        return k;
}

////////////////////////////////////////////////////////////////////////////////

// Returns ROW index from the field coordinate
int GetMapRowIndex(int y)
{
        //HDC TempDC;
        int i;
  /*
        TempDC = InitDraw(hWnd);
        sprintf(str, "GetMapRowIndex: %5d", barSize.y);
        TextOut(TempDC, 10, 280, str, strlen(str));
        ReleaseDC(hWnd, TempDC);
  */
  i = y - rectField.bottom;

        if (i >= 0) i = nVer - 1 - i/barSize.y;          else      i = -1;
        if (i >= nVer) i = -1;
        if (i < 0) i = -1;
        /*
        TempDC = InitDraw(hWnd);
        sprintf(str, "GetMapRowIndex: %2d", i);
        TextOut(TempDC, 10, 240, str, strlen(str));
        ReleaseDC(hWnd, TempDC);
        */
        return i;
}

////////////////////////////////////////////////////////////////////////////////

void MoveRow(HDC hDC, POINT *currIndex, POINT *move)
{
        int i, k, ii, kk;
            //sprintf(str, "Check 1 MoveRow   ");
                                        //TextOut(hDC, 10, 160, str, strlen(str));
        i = currIndex->x;
  for (k = 0; k < nHor; k++)
  {
                ii = (map + i*nHor + k)->indexRow;
                kk = (map + i*nHor + k)->indexCol;
                //OffsetRect(&barSet[currIndex.x, k].rect, move.x, move.y);
                (barSet+ii*nHor+kk)->rect.left  += move->x;
                (barSet+ii*nHor+kk)->rect.right += move->x;
                //(barSet+ii*nHor+kk)->nCurr.x = currIndex->x;
                //(barSet+ii*nHor+kk)->nCurr.y = k;
                /*
            sprintf(str, "Check 2 MoveRow   ");
                                        TextOut(hDC, 10, 160, str, strlen(str));
```

```
                    sprintf(str, "MR-curr:      %2d  %2d init: %2d  %2d XY = %4d  %4d F =
%4d  %4d ",
                        (barSet+ii*nHor+kk)->nCurr.x, (barSet+ii*nHor+kk)->nCurr.y,
                        (barSet+ii*nHor+kk)->nInit.x, (barSet+ii*nHor+kk)->nInit.y,
                        (barSet+ii*nHor+kk)->rect.left, (barSet+ii*nHor+kk)->rect.right,
                        rectField.left, rectField.right);
                            TextOut(hDC, 10, 120 - k*40, str, strlen(str));
            sprintf(str, "Check 3 MoveRow   ");
                            TextOut(hDC, 10, 160, str, strlen(str));
                */
                ShowBar(hDC, (barSet+ii*nHor+kk));
    }
}

////////////////////////////////////////////////////////////////////////////////

void MoveColumn(HDC hDC, POINT *currIndex, POINT *move)
{
        int i, k, ii, kk;
            //sprintf(str, "Check 1 MoveColumn");
                            //TextOut(hDC, 10, 160, str, strlen(str));
        k = currIndex->y;
    for (i = 0; i < nVer; i++)
    {
                ii = (map + i*nHor + k)->indexRow;
                kk = (map + i*nHor + k)->indexCol;
                //OffsetRect(&barSet[currIndex.x, k].rect, move.x, move.y);
                (barSet+ii*nHor+kk)->rect.top    += move->y;
                (barSet+ii*nHor+kk)->rect.bottom += move->y;
                //(barSet+ii*nHor+kk)->nCurr.x = i;
                //(barSet+ii*nHor+kk)->nCurr.y = currIndex->y;
                /*
            sprintf(str, "Check 2 MoveColumn");
                            TextOut(hDC, 10, 160, str, strlen(str));

                    sprintf(str, "MR-curr:      %2d  %2d init: %2d  %2d ",
                        (barSet+ii*nHor+kk)->nCurr.x, (barSet+ii*nHor+kk)->nCurr.y,
                        (barSet+ii*nHor+kk)->nInit.x, (barSet+ii*nHor+kk)->nInit.y);
                            TextOut(hDC, 10, 120 - i*40, str, strlen(str));
            sprintf(str, "Check 3 MoveColumn");
                            TextOut(hDC, 10, 160, str, strlen(str));
                */
                ShowBar(hDC, (barSet+ii*nHor+kk));
    }
    //ShowVerDivider(hDC, i);
    //ShowVerDivider(hDC, i+1);
}

////////////////////////////////////////////////////////////////////////////////

void FixRowPosition(HDC hDC, POINT *currIndex)
{
```

```
        int k, ii, kk;
        //MessageBox(hWnd, "Entered FixRowPosition", "FIX", MB_OK);
        //              sprintf(str, "currIndex  .x = %4d  .y = %4d  ",
        //                              currIndex->x, currIndex->y);
        //                              TextOut(hDC, 400, 580, str, strlen(str));
  for (k = 0; k < nHor; k++)
  {
        ii = (map + currIndex->x * nHor + k)->indexRow;
        if (ii < 0) MessageBox(hWnd, "ii < 0", "FixRowPosition", MB_OK);

        if (ii >= nVer) MessageBox(hWnd, "ii >= nVer", "FixRowPosition", MB_OK);

                        //sprintf(str, "ii  = %4d  .y = %4d  ",
                        //                      currIndex->x, currIndex->y);
                                        //TextOut(hDC, 400, 580, str, strlen(str));
        kk = (map + currIndex->x * nHor + k)->indexCol;
        if (kk < 0) MessageBox(hWnd, "kk < 0", "FixRowPosition", MB_OK);

        if (kk > nHor) MessageBox(hWnd, "kk >= nHor", "FixRowPosition", MB_OK);

                        //sprintf(str, "ii = %4d  kk = %4d  ii*nHor+kk = %4d", ii, kk,ii*nHor+kk);
                                        //TextOut(hDC, 400, 540, str, strlen(str));
                FixBarPosition(hDC, (barSet + ii * nHor + kk));
  }
        SetMap();
}

////////////////////////////////////////////////////////////////////////////////

void FixColumnPosition(HDC hDC, POINT *currIndex)
{
        int i, ii, kk;

  for (i = 0; i < nVer; i++)
  {
        ii = (map + i * nHor + currIndex->y)->indexRow;
        if (ii < 0) MessageBox(hWnd, "ii < 0", "FixRowPosition", MB_OK);

        if (ii >= nVer) MessageBox(hWnd, "ii >= nVer", "FixRowPosition", MB_OK);

                        //sprintf(str, "ii  = %4d  .y = %4d  ",
                        //                      currIndex->x, currIndex->y);
                                        //TextOut(hDC, 400, 580, str, strlen(str));

        kk = (map + i * nHor + currIndex->y)->indexCol;
        if (kk < 0) MessageBox(hWnd, "kk < 0", "FixRowPosition", MB_OK);

        if (kk >= nHor) MessageBox(hWnd, "kk >= nHor", "FixRowPosition", MB_OK);

                        //sprintf(str, "ii = %4d  kk = %4d  ii*nHor+kk = %4d", ii, kk,ii*nHor+kk);
                                        //TextOut(hDC, 400, 540, str, strlen(str));
```

```
                FixBarPosition(hDC, (barSet + ii * nHor + kk));
  }
        SetMap();
}

////////////////////////////////////////////////////////////////////////////////

void FixBarPosition(HDC hDC, BAR *bar)
{
        int i, k;

  i = (bar->rect.bottom + barSize.y/2 - rectField.bottom);
  if (i >= 0)
        {
                if (i < fieldSize.y) i/= barSize.y;
                else i = 0;
        }
  else i = nVer - 1;

  k = (bar->rect.left        + barSize.x/2 - rectField.left);
  if (k >= 0)
        {
                if (k < fieldSize.x) k /= barSize.x;
                else k = 0;
        }
  else k = nHor - 1;
  /*
                        sprintf(str, "FixBar1: i = %2d   nVer = %2d  bar->nCurr.x = %2d ", i, nVer,
bar->nCurr.x);
                                TextOut(hDC, 500, 160, str, strlen(str));
                        sprintf(str, "FixBar1: k = %2d   nHor = %2d  bar->nCurr.y = %2d ", k, nHor,
bar->nCurr.y);
                                TextOut(hDC, 500, 120, str, strlen(str));
  */
        if (i < 0) MessageBox(hWnd, "i < 0", "FixBarPosition", MB_OK);
        if (i >= nVer) MessageBox(hWnd, "i >= nVer", "FixBarPosition", MB_OK);
        if (k < 0) MessageBox(hWnd, "k < 0", "FixBarPosition", MB_OK);
        if (k >= nHor) MessageBox(hWnd, "k >= nHor", "FixBarPosition", MB_OK);

        bar->rect.left   = rectField.left   + k * barSize.x;
        bar->rect.bottom = rectField.bottom + i * barSize.y;
        bar->rect.right  = bar->rect.left   + (barSize.x -1 );
        bar->rect.top    = bar->rect.bottom + (barSize.y - 1);

        bar->nCurr.x = nVer - 1 - i;
        bar->nCurr.y = k;
        /*
                        sprintf(str, "FixBar2: i = %2d   nVer = %2d  bar->nCurr.x = %2d ", i, nVer,
bar->nCurr.x);
                                TextOut(hDC, 500, 80, str, strlen(str));
                        sprintf(str, "FixBar2: k = %2d   nHor = %2d  bar->nCurr.y = %2d ", k, nHor,
bar->nCurr.y);
```

```
                                        TextOut(hDC, 500, 40, str, strlen(str));
        */
        if (bar->nCurr.x < 0) MessageBox(hWnd, "bar->nCurr.x < 0", "FixBarPosition", MB_OK);

        if (bar->nCurr.x >= nVer) MessageBox(hWnd, "bar->nCurr.x >= nVer", "FixBarPosition",
MB_OK);
        bar->nCurr.y = k;
        if (bar->nCurr.y < 0) MessageBox(hWnd, "bar->nCurr.y < 0", "FixBarPosition", MB_OK);

        if (bar->nCurr.y >= nHor) MessageBox(hWnd, "bar->nCurr.y >= nHor", "FixBarPosition",
MB_OK);

        ShowBar(hDC, bar);
}

////////////////////////////////////////////////////////////////////////////////

// Checks whether the move is produced and adds one to the move's count
void CheckMove(POINT *currMapIndex, POINT *prevBarIndex)
{
        //HDC TempDC;
        //char str[200];

        int i, k, ii, kk;

        ii = currMapIndex->x;
        kk = currMapIndex->y;

        i = (map + ii * nHor + kk)->indexRow;
        k = (map + ii * nHor + kk)->indexCol;
        ;
        if (
                (   // Horizontal
                        (barSet + i * nHor + k)->nInit.y
                        !=
                        (prevBarIndex->y)
                )
    ||
                (   // Vertical
                        (barSet + i * nHor + k)->nInit.x
                        !=
                        (prevBarIndex->x)
                )
          )
        {
                numMoves++;
        }
        /*
        TempDC = InitDraw(hWnd);
        sprintf(str, "ii: %2d", ii);
        TextOut(TempDC, 20, 520, str, strlen(str));
        sprintf(str, "kk: %2d", kk);
```

```
        TextOut(TempDC, 20, 490, str, strlen(str));
        sprintf(str, "i: %2d", i);
        TextOut(TempDC, 20, 460, str, strlen(str));
        sprintf(str, "k: %2d", k);
        TextOut(TempDC, 20, 430, str, strlen(str));

        sprintf(str, "CheckMove - nInit.x: %2d", (barSet + i * nHor + k)->nInit.x);
        TextOut(TempDC, 20, 400, str, strlen(str));
        sprintf(str, "CheckMove - bar.x  : %2d", prevBarIndex->x);
        TextOut(TempDC, 20, 360, str, strlen(str));
        sprintf(str, "CheckMove - nInit.y: %2d", (barSet + i * nHor + k)->nInit.y);
        TextOut(TempDC, 20, 320, str, strlen(str));
        sprintf(str, "CheckMove - bar.y  : %2d", prevBarIndex->y);
        TextOut(TempDC, 20, 280, str, strlen(str));
        ReleaseDC(hWnd, TempDC);
  */
}

////////////////////////////////////////////////////////////////////////////////

void SetVariatedMap()
{
        int z, iMap, kMap, /* iBar, kBar,*/ moveLength, ind;
        MAP *workMap;
        MAP *tempMap = NULL;
        int sz;

        if (nHor >= nVer) sz = nHor; else sz = nVer;

  // Allocate Memory for the temporary array
        if (tempMap == NULL) tempMap = (MAP *) calloc(sz, sizeof(MAP));
        else
        {
                MessageBox(hWnd, "TempMap Aready Exists - Can't Be Created Again",
"SetVariatedMap", MB_OK);
          //result = FALSE;
        }

  // Seed the random-number generator.
  srand( (unsigned) time( NULL ) );

        for (z = 0; z < nVariate; z++)
        {
                if (z % 2 != 0)             // Select Row
                {
                        moveLength = GetRandom(1, nHor - 1);
                        iMap = GetRandom(0, nVer - 1);
                        workMap = map + iMap * nHor;
                        // Mapping to the temporary array
                        for (kMap = 0; kMap < nHor; kMap++)
                        {
                                ind = kMap + moveLength;
```

```
                        if (ind >= nHor) ind %= nHor;
                        else if (ind < 0) ind += nHor;

                        (tempMap + ind)->indexRow = (workMap + kMap)->indexRow;
                        (tempMap + ind)->indexCol = (workMap + kMap)->indexCol;
                }
                // Mapping back to the map row
                for (kMap = 0; kMap < nHor; kMap++)
                {
                        (workMap + kMap)->indexRow = (tempMap + kMap)->indexRow;
                        (workMap + kMap)->indexCol = (tempMap + kMap)->indexCol;
                }
        }
        else            // Select Column
        {
                moveLength = GetRandom(1, nVer - 1);
                kMap = GetRandom(0, nHor - 1);
                workMap = map + kMap;
                // Mapping to the temporary array
                for (iMap = 0; iMap < nVer; iMap++)
                {
                        ind = iMap + moveLength;
                        if (ind >= nVer) ind %= nVer;
                        else if (ind < 0) ind += nVer;

                        (tempMap + ind)->indexRow = (workMap + iMap * nHor)-
>indexRow;
                        (tempMap + ind)->indexCol = (workMap + iMap * nHor)->indexCol;
                }
                // Mapping back to the map column
                for (iMap = 0; iMap < nVer; iMap++)
                {
                        (workMap + iMap * nHor)->indexRow = (tempMap + iMap)-
>indexRow;
                        (workMap + iMap * nHor)->indexCol = (tempMap + iMap)-
>indexCol;
                }
        }
  }

  // Free Memory allocated for the temporary array
        if (tempMap != NULL)
        {
                free (tempMap);
                tempMap = NULL;
        }
}

//////////////////////////////////////////////////////////////////////////////

void SetRandomizedMap()
{
```

```
        int i, k; //, iMap, kMap, /* iBar, kBar,*/ moveLength, ind;
        //HDC hTC;
        int *tempInt = NULL;
        int sz;                    // Temporary array size for random numbers sz = nVer * nHor;
        int maxInt = 0, maxIndex = -1;
        int currInd = 0;   // Map index

        sz = nHor * nVer;

  // Allocate Memory for the temporary array
        if (tempInt == NULL) tempInt = (int *) calloc(sz, sizeof(int));
        else
        {
                MessageBox(hWnd, "tempINT Aready Exists - Can't Be Created Again",
"SetRandomizedMap", MB_OK);
          //result = FALSE;
        }

  // Seed the random-number generator.
  srand( (unsigned) time( NULL ) );

        for (i = 0; i < sz; i++)
        {
                tempInt[i] = GetRandom(1, sz * 10);
        }

        /*
        hTC = InitDraw(hWnd);

sprintf(str, "RANDOM  : %3d %3d %3d %3d %3d %3d %3d %3d %3d %3d %3d %3d %3d
%3d %3d %3d",
                                        tempInt[0],tempInt[1],tempInt[2],tempInt[3],
                                        tempInt[4],tempInt[5],tempInt[6],tempInt[7],
                                        tempInt[8],tempInt[9],tempInt[10],tempInt[11],
                                        tempInt[12],tempInt[13],tempInt[14],tempInt[15]
                                        );
        TextOut(hTC, 30, 560, str, strlen(str));
        ReleaseDC(hWnd, hTC);
        */

  // Find maximum of tempInt
  for (i = 0; i < sz; i++)
        {
        maxInt = 0;
        for (k = 0; k < sz; k++)
        {
                if (tempInt[k] > maxInt)
                {
                        maxInt = tempInt[k];
                        maxIndex = k;
                }
        }
```

```
            tempInt[maxIndex] = 0;                    // Terminate element

        // Build the bar
        if (maxInt > 0)
        {
            (map + i)->indexRow = maxIndex/nHor;
            (map + i)->indexCol = maxIndex%nHor;
            i = i;
        }
        else
        { /*
                //if (i < sz - 1)
                //MessageBox(hWnd, "i < sz", "SetRandomizedMap", MB_OK);
            // Free Memory allocated for the temporary array
                if (tempInt != NULL)
                {
                    free (tempInt);
                    tempInt = NULL;
                }
                */
            }
            /*
        hTC = InitDraw(hWnd);
sprintf(str, "RANDOM %2d: %3d %3d %3d %3d %3d %3d %3d %3d %3d %3d %3d %3d %3d
%3d %3d %3d",
                    i,      tempInt[0],tempInt[1],tempInt[2],tempInt[3],
                            tempInt[4],tempInt[5],tempInt[6],tempInt[7],
                            tempInt[8],tempInt[9],tempInt[10],tempInt[11],
                            tempInt[12],tempInt[13],tempInt[14],tempInt[15]
                            );
            TextOut(hTC, 30, 520 - i*30, str, strlen(str));
            ReleaseDC(hWnd, hTC);
            */
        }
        if (tempInt != NULL)
        {
            free (tempInt);
            tempInt = NULL;
        }
}

//////////////////////////////////////////////////////////////////////////////

BOOL CheckFinish()
{
        int i, k;
        BOOL gameOver = TRUE;
        k = k;

        if (flagBarNumber || flagPicture)
        // Full Solution (Color&Number or Picture)
```

```
        {
                //while (flagFinish == TRUE && i <  nVer * nHor)
                for (i = 0; i < nVer /*, gameOver*/; i++)
                for (k = 0; k < nHor /*, gameOver*/; k++)
                {
                        if ((map + i * nHor + k)->indexRow == i
                                &&
                    (map + i * nHor + k)->indexCol == k
                        )
                        {
                                k = k;
                        }
                        else gameOver = FALSE;
                }
        }
        else
        // Partial Rowwise Solution (Color Only)
        {
                for (i = 0; i < nVer /*, gameOver*/; i++)
                for (k = 0; k < nHor /*, gameOver*/; k++)
                {
                        if ((map + i * nHor + k)->indexRow == i)
                        {
                                k = k;
                        }
                        else gameOver = FALSE;
                }
        }
        return gameOver;
}

//////////////////////////////////////////////////////////////////////////////
//////////////////////////////////////////////////////////////////////////////
```

APPENDIX E

```
/*****************************************************************************
        Copyright by Sergey K. Aityan and Alexander V. Lysyansky

  BOTTA       Version 1.2
  PROGRAM: controls.c

        August 11, 1995

  PURPOSE:    2-Dimensional Cyclic Game
                        Output Control Fields Procedures

  FUNCTIONS:

        void ShowControl(HDC hDC, CONTFRAME *cont_frame, BOOL doShade);
        void ShowControlShade(HDC hDC, CONTFRAME *cont_frame);
        void ShowControlField(HDC hDC, CONTFRAME *cont_frame);

        void BuildControl(CONTFRAME *cont_frame,
                                        int c_left, int c_top, int c_right, int c_bottom,
                                        int shadeWidth, BOOL upFlag);

        void PrintTime(HDC hDC, CONTFRAME *cont_frame);
        void PrintMoves(HDC hDC, CONTFRAME *cont_frame);
        void PrintNewGame(HDC hDC, CONTFRAME *cont_frame);
        void PrintOrder(HDC hDC, CONTFRAME *cont_frame);
        void PrintVariation(HDC hDC, CONTFRAME *cont_frame);
        void PrintRandomize(HDC hDC, CONTFRAME *cont_frame);

        void PrintCongratulations(HDC hDC, CONTFRAME *cont_frame);

        void ShowCongratulations(HDC hDC, HANDLE hLibrary);

*****************************************************************************/

//////////////////////////////////////////////////////////////////////////////


#include "windows.h"
#include "string.h"
#include <stdio.h>
#include <time.h>

#include "field.h"
#include "controls.h"

HWND hWnd;

CONTFRAME cont_frame_1, cont_frame_2, cont_frame_3;
clock_t clStart, clFinish, clTemp;

int numMoves;
short nVariate;
```

```
char str[255];

HBITMAP hBitmap;
HBITMAP hBitmap1, hBitmap2, hBitmap3, hBitmap4, hBitmap5, hBitmap6, hBitmap7, hBitmap8,
hBitmap9;
HBITMAP hBitmapCongratulations;
RECT rectField;

////////////////////////////////////////////////////////////////////////////////

void ShowControl(HDC hDC, CONTFRAME *cont_frame, BOOL doShade)
{
        //HDC           hCDC;

        //hCDC = InitDraw(hWnd);

  // Show Control Frame
  if (doShade)
  {
        ShowControlShade(hDC, cont_frame);
        }

        ShowControlField(hDC, cont_frame);

        //ReleaseDC(hWnd, hCDC);
}

////////////////////////////////////////////////////////////////////////////////

void ShowControlShade(HDC hDC, CONTFRAME *cont_frame)
{
        HPEN    hNewPen, hOldPen;
        HBRUSH          hNewBrush, hOldBrush, hLeftTopBrush, hRightBottomBrush;

        hNewPen = GetStockObject(NULL_PEN);
        hOldPen = SelectObject(hDC, hNewPen);

        if (cont_frame->upFlag)
        {
                hLeftTopBrush = GetStockObject(WHITE_BRUSH);
                hRightBottomBrush = GetStockObject(GRAY_BRUSH);
        }
        else
        {
                hLeftTopBrush = GetStockObject(GRAY_BRUSH);
                hRightBottomBrush = GetStockObject(WHITE_BRUSH);
        }

        // Left-Top Shade
        hNewBrush = hLeftTopBrush;
  hOldBrush = SelectObject(hDC, hNewBrush);
```

```
        Polygon(hDC, cont_frame->polLeftTop, sizeof(cont_frame->polLeftTop)/sizeof(POINT));

        SelectObject(hDC, hOldBrush);
        DeleteObject(hNewBrush);

        // Right-Bottom Shade
        hNewBrush = hRightBottomBrush;
        hOldBrush = SelectObject(hDC, hNewBrush);

        Polygon(hDC, cont_frame->polRightBottom, sizeof(cont_frame-
>polRightBottom)/sizeof(POINT));

        SelectObject(hDC, hOldBrush);
        DeleteObject(hNewBrush);

        SelectObject(hDC, hOldPen);
        DeleteObject(hNewPen);
}

////////////////////////////////////////////////////////////////////////////////

void ShowControlField(HDC hDC, CONTFRAME *cont_frame)
{
        HPEN    hNewPen, hOldPen;
        HBRUSH          hNewBrush, hOldBrush;

        hNewPen = GetStockObject(NULL_PEN);
        hOldPen = SelectObject(hDC, hNewPen);
        // Show Control Field
        hNewBrush = GetStockObject(LTGRAY_BRUSH);
        hOldBrush = SelectObject(hDC, hNewBrush);

        // External Frame
        Rectangle(hDC,  cont_frame->rect.left,          cont_frame->rect.top,
                                        cont_frame->rect.right,   cont_frame->rect.bottom);


        SelectObject(hDC, hOldBrush);
        DeleteObject(hNewBrush);

        SelectObject(hDC, hOldPen);
        DeleteObject(hNewPen);
}

////////////////////////////////////////////////////////////////////////////////

void BuildControl(CONTFRAME *cont_frame,
        int c_left, int c_top, int c_right, int c_bottom, int shadeWidth, BOOL c_upFlag)
{
        int wsh;
        short SHADE_FRACTION = 60;
```

```
cont_frame->rect.left          = c_left;
cont_frame->rect.top           = c_top;
cont_frame->rect.right         = c_right;
cont_frame->rect.bottom        = c_bottom;

cont_frame->rectSize.x         = cont_frame->rect.right - cont_frame->rect.left;
cont_frame->rectSize.y         = cont_frame->rect.top   - cont_frame->rect.bottom;

cont_frame->upFlag     = c_upFlag;

// Control Shade
//
wsh = ((cont_frame->rect.top - cont_frame->rect.bottom)
            +
        (cont_frame->rect.right - cont_frame->rect.left)
       )/2/SHADE_FRACTION;
//
//wsh = shadeWidth;


// LEFT-TOP
cont_frame->polLeftTop[0].x = cont_frame->rect.left          - wsh;
cont_frame->polLeftTop[0].y = cont_frame->rect.top                   + wsh;
cont_frame->polLeftTop[1].x = cont_frame->rect.right         + wsh;
cont_frame->polLeftTop[1].y = cont_frame->rect.top                   + wsh;
cont_frame->polLeftTop[2].x = cont_frame->rect.right;
cont_frame->polLeftTop[2].y = cont_frame->rect.top;
cont_frame->polLeftTop[3].x = cont_frame->rect.left;
cont_frame->polLeftTop[3].y = cont_frame->rect.top;
cont_frame->polLeftTop[4].x = cont_frame->rect.left;
cont_frame->polLeftTop[4].y = cont_frame->rect.bottom;
cont_frame->polLeftTop[5].x = cont_frame->rect.left          - wsh;
cont_frame->polLeftTop[5].y = cont_frame->rect.bottom        - wsh;

//RIGHT
cont_frame->polRightBottom[0].x = cont_frame->rect.right  + wsh;
cont_frame->polRightBottom[0].y = cont_frame->rect.bottom        - wsh;
cont_frame->polRightBottom[1].x = cont_frame->rect.left   - wsh;
cont_frame->polRightBottom[1].y = cont_frame->rect.bottom        - wsh;
cont_frame->polRightBottom[2].x = cont_frame->rect.left;
cont_frame->polRightBottom[2].y = cont_frame->rect.bottom;
cont_frame->polRightBottom[3].x = cont_frame->rect.right;
cont_frame->polRightBottom[3].y = cont_frame->rect.bottom;
cont_frame->polRightBottom[4].x = cont_frame->rect.right;
cont_frame->polRightBottom[4].y = cont_frame->rect.top;
cont_frame->polRightBottom[5].x = cont_frame->rect.right  + wsh;
cont_frame->polRightBottom[5].y = cont_frame->rect.top           + wsh;

}

//////////////////////////////////////////////////////////////////////////////
```

```
//////////////////////////////////////////////////////////////////////////////

//PrintTime: Prints elapsed time
//
void PrintTime(HDC hDC, CONTFRAME *cont_frame)
{
        //HDC hDC;
  char szTimeHours[30], szTimeMinutes[30], szTimeSeconds[30];
        // szSwaps[20], szCompares[20];
        //int line1 = 20;
        int line;
        int offset;
        //static float fTime, ftimeSeconds;
        //static int timeHours, timeMinutes;
        //static long timeSeconds;
        float fTime, ftimeSeconds;
        int timeHours, timeMinutes;
        long timeSeconds;
        short lastHour = 100;

  //clFinish = clock();
  //hDC = InitDraw(hWnd);

  fTime =  (float)(clock() - clStart) / CLOCKS_PER_SEC ;
  //fTime =  (float)(clock() - clStart)* 1;

  timeSeconds   = (long) fTime ;
  timeHours     = (int)(timeSeconds/3600);
  //timeMinutes = (timeSeconds - timeHours * 3600)/60;
  timeMinutes   = (int) (timeSeconds / 60) % 60;
  timeSeconds   %= 60 ;
  ftimeSeconds = fTime - (float) timeMinutes * 60 - (float) timeHours * 3600;

        line = cont_frame->rect.bottom + cont_frame->rectSize.y*3/4;
  offset = cont_frame->rect.left + 205;
        //SetTextColor(hDC, RGB(255,0,0));
        //SetBkColor(hDC, GetSysColor(COLOR_WINDOW));
        SetBkColor(hDC, RGB(200,200,200));
        //SetBkMode(hDC, OPAQUE);

  if (timeHours < lastHour)
  {
                if (timeSeconds > 0)
          {
                //sprintf(szTimeSeconds, "Seconds: %2d", timeSeconds);
                sprintf(szTimeSeconds, "Seconds: %4.1f", ftimeSeconds);
                  TextOut(hDC, offset, line, szTimeSeconds, strlen(szTimeSeconds));
          }
                else
                {
                sprintf(szTimeSeconds, "Seconds:        ");
```

```
                TextOut(hDC, offset, line, szTimeSeconds, strlen(szTimeSeconds));
            }
            offset -= 100;
            if (timeMinutes > 0)
            {
            sprintf(szTimeMinutes, "Minutes: %2d  ", timeMinutes);
                TextOut(hDC, offset, line, szTimeMinutes, strlen(szTimeMinutes));
        }
            else
            {
            sprintf(szTimeMinutes, "Minutes:      ");
                TextOut(hDC, offset, line, szTimeMinutes, strlen(szTimeMinutes));
            }
            offset -= 100;
            if (timeHours > 0)
            {
                    sprintf(szTimeHours, "Hours: %2d  ",timeHours);
                    //offset = cont_frame->rect.left + (cont_frame->rectSize.x -
strlen(szTimeHours))/2 - 10;
            TextOut(hDC, offset, line, szTimeHours, strlen(szTimeHours));
        }
            else
            {
            sprintf(szTimeHours, "Hours:      ");
                TextOut(hDC, offset, line, szTimeHours, strlen(szTimeHours));
            }
    }
    else
    {
        if (timeHours > lastHour) return;
        else
        {
            offset = cont_frame->rect.left + 5;
            ShowControlField(hDC, &cont_frame_1);
            //sprintf(szTimeHours, "YOU PLAY MORE THAN 100 HOURS - PLEASE RELAX
!!!");
            //sprintf(szTimeHours, "YOU'VE PLAYED TOO MUCH - PLEASE RELAX !!!");
            sprintf(szTimeHours, "YOU PLAYED TOO MUCH - RELAX !");
            TextOut(hDC, offset, line, szTimeHours, strlen(szTimeHours));
            //sprintf(szTimeHours, "KWA !!!");
            //TextOut(hDC, offset+ 500, line, szTimeHours, strlen(szTimeHours));
        }
    }

    //ReleaseDC(hWnd, hDC);
}

//////////////////////////////////////////////////////////////////////////////

//PrintMoves: Prints Game Moves
//
void PrintMoves(HDC hDC, CONTFRAME *cont_frame)
```

```
{
   char szMoves[30];
         int line;
         int offset;

         line = cont_frame->rect.bottom + cont_frame->rectSize.y*3/4;
   offset = cont_frame->rect.left + 5;
         //SetTextColor(hDC, RGB(255,0,0));
         //SetBkColor(hDC, GetSysColor(COLOR_WINDOW));
         SetBkColor(hDC, RGB(200,200,200));
         //SetBkMode(hDC, OPAQUE);

         if (numMoves > 0)
   {
         sprintf(szMoves, "Moves: %5d", numMoves);
            TextOut(hDC, offset, line, szMoves, strlen(szMoves));
   }
         else
         {
         sprintf(szMoves, "Moves:      ");
            TextOut(hDC, offset, line, szMoves, strlen(szMoves));
         }
}

////////////////////////////////////////////////////////////////////////////////

void PrintNewGame(HDC hDC, CONTFRAME *cont_frame)
{
         int line;
         int offset;

         line = cont_frame->rect.bottom + cont_frame->rectSize.y*3/4;
   offset = cont_frame->rect.left + 5;
         //SetTextColor(hDC, RGB(255,0,0));
         //SetBkColor(hDC, GetSysColor(COLOR_WINDOW));
         ShowControlField(hDC, cont_frame);
         SetBkColor(hDC, RGB(200,200,200));
         sprintf(str, "NEW GAME");
   TextOut(hDC, offset, line, str, strlen(str));
}

////////////////////////////////////////////////////////////////////////////////

void PrintOrder(HDC hDC, CONTFRAME *cont_frame)
{
         int line;
         int offset;

         line = cont_frame->rect.bottom + cont_frame->rectSize.y*3/4;
   offset = cont_frame->rect.left + 5;
         //SetTextColor(hDC, RGB(255,0,0));
         //SetBkColor(hDC, GetSysColor(COLOR_WINDOW));
```

```
        SetBkColor(hDC, RGB(200,200,200));
        ShowControlField(hDC, cont_frame);
        sprintf(str, "Start From Order");
  TextOut(hDC, offset, line, str, strlen(str));
}

//////////////////////////////////////////////////////////////////////////////

void PrintVariation(HDC hDC, CONTFRAME *cont_frame)
{
        int line;
        int offset;

        line = cont_frame->rect.bottom + cont_frame->rectSize.y*3/4;
  offset = cont_frame->rect.left + 5;
        //SetTextColor(hDC, RGB(255,0,0));
        //SetBkColor(hDC, GetSysColor(COLOR_WINDOW));
        SetBkColor(hDC, RGB(200,200,200));
        ShowControlField(hDC, cont_frame);
        sprintf(str, "Variation: %2d Moves", nVariate);
  TextOut(hDC, offset, line, str, strlen(str));
}

//////////////////////////////////////////////////////////////////////////////

void PrintRandomize(HDC hDC, CONTFRAME *cont_frame)
{
        int line;
        int offset;

        line = cont_frame->rect.bottom + cont_frame->rectSize.y*3/4;
  offset = cont_frame->rect.left + 5;
        //SetTextColor(hDC, RGB(255,0,0));
        //SetBkColor(hDC, GetSysColor(COLOR_WINDOW));
        SetBkColor(hDC, RGB(200,200,200));
        ShowControlField(hDC, cont_frame);
        sprintf(str, "RANDOMIZATION");
  TextOut(hDC, offset, line, str, strlen(str));
}

//////////////////////////////////////////////////////////////////////////////

void PrintCongratulations(HDC hDC, CONTFRAME *cont_frame)
{
        int line;
        int offset;

        line = cont_frame->rect.bottom + cont_frame->rectSize.y*3/4;
  offset = cont_frame->rect.left + 5;
        //SetTextColor(hDC, RGB(255,0,0));
        //SetBkColor(hDC, GetSysColor(COLOR_WINDOW));
        SetBkColor(hDC, RGB(200,200,200));
```

```
        ShowControlField(hDC, cont_frame);
        sprintf(str, "GAME IS OVER");
  TextOut(hDC, offset, line, str, strlen(str));
}

////////////////////////////////////////////////////////////////////////////////

void ShowCongratulations(HDC hDC, HANDLE hLibraryFinish)
{
        HBITMAP hBitOld;
        int nCurr = 1;

        hBitOld = hBitmap;
        //hBitmap = hBitmap5;
        //hBitmap = hBitmapCongratulations;
                if (hLibraryFinish >= 32)
                {
                        nCurr = 1;
                        hBitmap = LoadBitmap(hLibraryFinish, MAKEINTRESOURCE (nCurr));
                }
        ShowClue(hDC, &rectField, 0, 0);
        hBitmap = hBitOld;
}

////////////////////////////////////////////////////////////////////////////////
```

We claim:

1. A two-dimensional cyclic game for creating and implementing a puzzle-type game, said game comprising:

(a) a two-dimensional playing field having a border enclosing said playing field;

(b) a plurality of sites defined on said playing field within said border thereof; and (c) a plurality of game objects occupying said plurality of sites on said playing field, said game objects being movable relative to said sites to restore said game objects from an initial pattern to a final pattern through performance of a succession of moves of said game objects;

(d) said game objects being movable in a plurality of selected groups thereof relative to a plurality of sets of said sites on said playing field wherein said sites of each set are the same in number as said game objects of said selected group that occupy said sites and wherein said game objects in each of said selected groups on said sites of respective ones of said sets thereof extend between spaced first and second portions of said border of said playing field and are movable simultaneously between said sites of said respective ones of said sets about a portion of an endless cyclic path in a given direction over said playing field through a cyclic translational move;

(e) said game objects in each of said groups, with reference to the given direction of the cyclic translational move of said group of game objects and with reference to said sites in said respective ones of said sets thereof occupied by said each group of game objects, including a leading game object occupying a first one site being located adjacent to said first portion of said border of said playing field and a trailing game object occupying a second one site being located adjacent to said second portion of said border of said playing field wherein, as said selected one group of game objects is moved relative to said sites of said respective one set during a given one cyclic translational move of said selected one group, said leading game object of said selected one group leaves said playing field from said first one site adjacent to said first portion of said border and reenters said playing field to said second one site thereof adjacent to said second portion of said border of said playing field simultaneously as said trailing game object moves from said second one site to another one of said sites of said respective one set.

2. The game of claim 1 wherein said sites are arranged in rows and columns in said playing field.

3. The game of claim 2 wherein said sites are arranged in a rectangular grid pattern.

4. The game of claim 2 wherein said game objects in respective ones of said groups occupy either a common one of said rows of sites or a common one of said columns of sites and extend between said spaced first and second portions of said border of said playing field.

5. The game of claim 2 wherein said game objects in respective ones of said groups occupy a different one of said rows and columns of sites.

6. The game of claim 1 wherein said game objects in respective ones of said selected groups on respective ones of said sets of sites are spaced apart by game objects on sites in other ones of said respective selected groups on other ones of said sets of sites.

7. The game of claim 1 wherein each of said game objects of a selected one of said groups is simultaneously movable along a portion of an endless cyclic path in a given direction through a cyclic rotational move such that said each game object occupying one of said sites of said playing field remains on said one site during said move and rotates thereon through a portion of a complete rotation cycle.

8. The game of claim 1 wherein said playing field is of planar shape.

9. The game of claim 1 wherein said playing field is of curved shape.

10. A two-dimensional cyclic game for creating and implementing a puzzle-type game, said game comprising:

(a) a two-dimensional playing field;

(b) a plurality of sites defined on said playing field; and (c) a plurality of game objects occupying said sites on said playing field, said game objects being movable relative to said sites to restore said game objects from an initial pattern to a final pattern through performance of a succession of moves of said game objects;

(d) said game objects being movable in a plurality of selected groups thereof relative to a plurality of sets of sites on said playing field wherein said sites of each set are the same in number as said game objects of said selected group that occupy said sites and wherein said game objects in each of said selected groups on said sites of respective ones of said sets are movable simultaneously between said sites of said respective ones of said sets about a portion of an endless cyclic path in a given direction over said playing field through a cyclic translational move such that, during a given one cyclic translational move of one selected group of game objects, said game objects of said selected group are moved in said given direction about said portions of said endless cyclic path between said sites of said respective one set thereof so that all of said sites initially occupied by respective ones of all of said game objects of said selected group at a start of said cyclic translational move are occupied by respective others of all of said game objects of said selected group at a finish of said cyclic translational move.

11. The game of claim 10 wherein said playing field is cylindrical in configuration.

12. The game of claim 10 wherein each of said game objects of a selected one of said groups is simultaneously movable along a portion of an endless cyclic path in a given direction through a cyclic rotational move such that said each game object occupying one of said sites of said playing field remains on said one site during said move and rotates thereon through a portion of a complete rotation cycle.

13. The game of claim 10 wherein said game objects in respective ones of said selected groups on respective ones of said sets of sites are spaced apart by game objects on sites in other ones of said respective selected groups on other ones of said sets of sites.

14. The game of claim 10 wherein said playing field is of planar shape.

15. The game of claim 10 wherein said playing field is of curved shape.

16. A two-dimensional cyclic game for creating and implementing a puzzle-type game, said game comprising:

(a) a two-dimensional playing field having a border with spaced apart portions;

(b) a plurality of sites defined on said playing field between said spaced portions of said border thereof; and (c) a plurality of game objects occupying said sites on said playing field, said game objects being movable relative to said sites to restore said game objects from an initial pattern to a final pattern through performance of a succession of moves of said game objects;

(d) said game objects being movable in a plurality of selected groups thereof, relative to a plurality of sets of said sites on said playing field wherein said sites of each set are the same in number as said game objects of said selected group that occupy said sites and wherein said game objects in each of said selected groups extend between said spaced portions of said playing field and are movable simultaneously between said sites of said respective ones of said sets about a portion of an endless cyclic path in a given direction over said playing field through a cyclic translational move;

(e) said game objects in each of said groups, with reference to the given direction of the cyclic translational move of said group of game objects and with reference to said sites in said respective ones of said sets thereof occupied by said each group of game objects, including a leading game object occupying a first one site being located adjacent to a first of said spaced portion of said border of said playing field and a trailing game object occupying a second one site being located adjacent to a second of said spaced portions of said border of said playing field wherein, as said selected one group of game objects is moved relative to said sites of said respective one set during a given one cyclic translational move of said selected one group, said leading game object of said selected one group leaves said playing field from said first one site adjacent to said first of said spaced portions of said border and reenters said playing field to said second one site thereof adjacent to said second of said spaced portions of said border of said playing field simultaneously as said trailing game object moves from said second one site to another one of said sites of said respective one set.

17. The game of claim 16 wherein said two-dimensional playing field is planar in configuration.

18. The game of claim 16 wherein said two-dimensional playing field in substantially curved in configuration.

19. The game of claim 16 wherein each of said game objects of a selected one of said groups is simultaneously movable along a portion of an endless cyclic path in a given direction through a cyclic rotational move such that said each game object occupying one of said sites of said playing field remains on said one site during said move and rotates thereon through a portion of a complete rotation cycle.

20. The game of claim 16 wherein said sites are arranged in a rectangular grid pattern.

21. The game of claim 16 wherein said game objects are segments of a picture.

* * * * *